US007824258B2

(12) United States Patent
Walker et al.

(10) Patent No.: US 7,824,258 B2
(45) **Date of Patent: *Nov. 2, 2010**

(54) METHODS AND SYSTEMS FOR PROVIDING PAPER BASED OUTCOMES

(75) Inventors: Jay S. Walker, Ridgefield, CT (US); James A. Jorasch, Stamford, CT (US); Stephen C. Tulley, Fairfield, CT (US); Geoffrey M. Gelman, Stamford, CT (US)

(73) Assignee: IGT, Reno, NV (US)

( * ) Notice: Subject to any disclaimer, the term of this patent is extended or adjusted under 35 U.S.C. 154(b) by 1184 days.

This patent is subject to a terminal disclaimer.

(21) Appl. No.: 11/422,341

(22) Filed: Jun. 6, 2006

(65) Prior Publication Data

US 2006/0227635 A1 Oct. 12, 2006

Related U.S. Application Data

(63) Continuation of application No. 10/885,570, filed on Jul. 6, 2004.

(60) Provisional application No. 60/484,816, filed on Jul. 3, 2003.

(51) Int. Cl.
*A63F 3/06* (2006.01)

(52) U.S. Cl. ..... 463/17; 463/10; 273/138.2; 273/139

(58) Field of Classification Search ..... 463/16–17, 463/40–42; 273/138.2, 139
See application file for complete search history.

(56) References Cited

U.S. PATENT DOCUMENTS 4,191,376 A 3/1980 Goldman et al. ..... 273/139
4,299,637 A 11/1981 Oberdeck et al. ..... 156/64
4,677,553 A 6/1987 Roberts et al. ..... 364/412
4,982,337 A 1/1991 Burr et al. ..... 365/479
5,178,389 A 1/1993 Bentley et al. ..... 273/138 A
5,216,595 A 6/1993 Protheroe ..... 364/412
5,277,424 A 1/1994 Wilms ..... 273/85 CP
5,290,033 A 3/1994 Bittner et al. ..... 273/138 A
5,344,144 A 9/1994 Canon ..... 273/138 A
5,377,975 A 1/1995 Clapper, Jr. ..... 273/138 A
5,551,692 A 9/1996 Pettit et al. ..... 273/143 R
5,569,082 A 10/1996 Kaye
5,709,603 A 1/1998 Kaye ..... 463/17
5,768,382 A 6/1998 Schneier et al.
5,800,268 A 9/1998 Molnick ..... 463/40

(Continued)

OTHER PUBLICATIONS

Flyer: "Play Super Slots, Win up to $10,000", 2 pp., undated.

(Continued)

*Primary Examiner*—Peter DungBa Vo
*Assistant Examiner*—Masud Ahmed
(74) *Attorney, Agent, or Firm*—K&L Gates LLP

(57) ABSTRACT

Gaming devices may generate outcomes to be sold in printed form. Representations of the outcomes, corresponding payouts, and other information are printed on sheets of paper. Multiple printed outcomes are assembled into books, wrapped, and sold to consumers. Consumers may purchase the books and browse through the printed outcomes at their leisure. When finished with a book, a consumer may submit a portion of the book to the casino that sold the outcomes. The casino may then pay the player based on the payouts associated with the outcomes in the book.

19 Claims, 21 Drawing Sheets

U.S. PATENT DOCUMENTS

| | | | | |
|---|---|---|---|---|
| 5,830,067 | A | 11/1998 | Graves et al. | |
| 5,908,354 | A | 6/1999 | Okuniewicz | |
| 5,988,688 | A | 11/1999 | Such | 283/100 |
| 6,007,426 | A | 12/1999 | Kelly et al. | |
| 6,012,983 | A | 1/2000 | Walker et al. | |
| 6,017,032 | A | 1/2000 | Grippo et al. | 273/138.1 |
| 6,077,163 | A | 6/2000 | Walker et al. | |
| 6,142,872 | A | 11/2000 | Walker et al. | |
| 6,146,276 | A | 11/2000 | Okuniewicz | |
| 6,173,267 | B1 | 1/2001 | Cairns | 705/14 |
| 6,309,298 | B1 | 10/2001 | Gerow | 463/20 |
| 6,508,709 | B1 | 1/2003 | Karmarkar | 463/42 |
| 6,634,942 | B2 | 10/2003 | Walker et al. | |
| 6,645,075 | B1 | 11/2003 | Gatto et al. | 463/25 |
| 6,709,331 | B2 | 3/2004 | Berman | 463/16 |
| 6,780,564 | B2 | 8/2004 | Lawandy et al. | 430/270.1 |
| 6,840,860 | B1 | 1/2005 | Okuniewicz | |
| 6,863,608 | B1 | 3/2005 | LeMay et al. | 463/24 |
| 6,884,170 | B2 | 4/2005 | Rowe | |
| 6,918,831 | B2 | 7/2005 | Nguyen et al. | 463/20 |
| 6,929,546 | B2 | 8/2005 | Moore et al. | 463/30 |
| 6,935,949 | B1 | 8/2005 | Murphy | 463/20 |
| 6,964,609 | B2 | 11/2005 | Haag et al. | 463/20 |
| 7,140,964 | B2 | 11/2006 | Walker et al. | |
| 7,188,186 | B1 | 3/2007 | Meyer et al. | |
| 7,233,922 | B2 | 6/2007 | Asher et al. | |
| 2002/0090986 | A1 | 7/2002 | Cote et al. | |
| 2002/0169018 | A1 | 11/2002 | Schneier et al. | |
| 2003/0100357 | A1 | 5/2003 | Walker et al. | |
| 2003/0177347 | A1 | 9/2003 | Schneier et al. | |
| 2004/0022520 | A1 | 2/2004 | Kinzer et al. | 386/69 |
| 2004/0053675 | A1 | 3/2004 | Nguyen et al. | |
| 2004/0137987 | A1 | 7/2004 | Nguyen et al. | 463/42 |
| 2004/0147308 | A1 | 7/2004 | Walker et al. | |
| 2004/0152504 | A1 | 8/2004 | Herrmann et al. | 463/16 |
| 2004/0210507 | A1 | 10/2004 | Asher et al. | |
| 2004/0023550 | A1 | 11/2004 | McNally et al. | 463/16 |
| 2004/0229677 | A1 | 11/2004 | Gray et al. | 463/17 |
| 2005/0059493 | A1 | 3/2005 | Tyson et al. | 463/42 |
| 2005/0114272 | A1 | 5/2005 | Herrmann et al. | 705/67 |
| 2005/0119042 | A1 | 6/2005 | Chamberlain et al. | 463/19 |
| 2005/0130728 | A1 | 6/2005 | Nguyen et al. | 463/16 |
| 2005/0170881 | A1 | 8/2005 | Muskin | 463/20 |
| 2005/0181854 | A1 | 8/2005 | Moshal | |
| 2005/0192087 | A1 | 9/2005 | Friedman et al. | 463/25 |
| 2005/0193209 | A1 | 9/2005 | Saunders et al. | 713/182 |
| 2005/0250567 | A1 | 11/2005 | Kane et al. | 463/16 |
| 2005/0277459 | A1 | 12/2005 | Haag et al. | 463/13 |
| 2006/0172794 | A1 | 8/2006 | Walker et al. | |

OTHER PUBLICATIONS

"Lady Luck Casino Hotel Players on 'Best Value' Win Streak", PR Newswire, Apr. 25, 1995, Section: Financial News.

Halbfinger, David M. and Golden, Daniel, "Many are cashing in on the state's coupons; Lax security and a flood of free plays are encouraging abuse by agents, players and the gaming agency itself", The Boston Globe, Apr. 10, 1997, Section: Metro/Region; p. A1.

Website: "Australia's scratch ticket history", (http // www scottware com au/tickets/ausinfo htm), downloaded date: Oct. 3, 1999.

Website: "Nebraska Lottery—What we mean by overall odds", (http //www nelottery com/scratch/sodds htm), download date: Nov. 4, 1999.

Website: "Nebraska Lottery—Nebraska lottery sales pass $500 million", (http //www nelottery com/news/500million html), Jun. 1, 2000.

Website: "The Printers Shoppe", (http //www theprintersshop com/novelties html), download date: Dec. 4, 2000.

Website: "Global ePoint, Inc.—The On-Line Instant Ticket", (http //www globalepoint com/lottery htm), Copyright 2001.

Website: "Jar Tickets—Jar-O'-Do, Universal Manufacturing Company, Kansas City, Missouri, U.S.A.", (http //www jarodo com/products/pjar stm), Copyright 2001.

Website: "Lucky Tab II Audio-Video Pull-Tab Dispenser Quick Review", (http //www wgtc net/pages/LuckyTabReview html), Copyright 2001.

"Lottery Not Such a Good Bet, Some States Finding Washington Ticket Sales Remain Steady, But 'Jackpot Fatigue' is Taking Its Toll", The Seattle Post-Intelligencer, Sep. 10, 2001, Section: News, p. B4.

Company Information and Investment Highlights, "Scientific Games Corporation Leading the World in Lottery and Pari-Mutuel Technology, AMEX : SGM", Oct. 23, 2001.

Website: "Welcome to Discovery Packaging Inc.", (http //www discoverypackaging com/Main htm), download date: Feb. 2002.

"Lottery officials say winners don't always claim prizes", The Associated Press, Mar. 4, 2002, Section: State and Regional.

Website: "Lotology Interview Series", (http scottware com au/tickets/intl htm), download date: Aug. 10, 2002.

Website: "Wheel of Fortune 2002 Calendar", (http shop store yahoo com/spestore/wheeloffor20.html), download date: download date: Jul. 3, 2003.

Website: "Lottery Insider—Pulltabs", (http //www lotteryinsider com/products/pulltabs htm), download date: Dec. 11, 2003.

Website: "Video pull tab machines, tournaments—Rod N Reel", (http www rodnreelinc com/pulltabs htm), download date: Dec. 11, 2003.

Rose, Nelson, "Is it Bingo, or a Slot Machine?", Gambling and the Law, Gaming Studies Research Center-I, Whittier Law School, Copyright 2002, (http //gaming unlv edu/research/reading/Rose82 html).

"DVD 8800S", [online], [retrieved May 24, 2005], Retrieved from the Internet: <http://www.convactech.com/product/dvd8800mid.html>. 1 pg.

"Kansas Lottery presents eScratch", [online], [retrieved Jun. 8, 2005], Retrieved from the Internet: <http://www.escratchks.com/escratch/postHome.do>. 7 pgs.

"Quarter Play: The Instant-Scratch Game Goes Electronic", Iowa Lottery Press Room, [online], [retrieved Jun. 13, 2005], Retrieved from the Internet: <http://www.ialottery.com/PressRoom/N10-01-04.html>. 2 pgs.

"Remote Access Gaming", Legal iGaming, [online], [retrieved Jun. 13, 2005], Retrieved from the Internet: <http://www.legaligaming.com/remote.htm>. 2 pgs.

"Welcome to the Future of Gaming . . .", Legal iGaming, [online], [retrieved Jun. 13, 2005], Retrieved from the Internet: <http://www.legaligaming.com/main.htm>. 3 pgs.

Brochure: "Unlock the power of DVD with Optreve", www.screenlifedve.com, undated. 1 pg.

McQueen, Patricia A., "New game in town—Electronic Game Card hopes gaming and promotional innovation leads to casino and lottery inroads", Casino Journal, May 2005, pp. 40,42 and 50. 3 pgs.

Nice, Karim, "How DVDs Work", [online], [retrieved Apr. 8, 2005], Retrieved from the Internet: <http://electronics.howstuffworks.com/dvd.htm/printable>. 15 pgs.

Overview: "DVD Manufacturing Process", Technicolor, a Thomson Service, undated. 2 pgs.

Press Release: "Correction—Legal iGaming—LV NV", PR Newswire, Apr. 4, 2004. 3 pgs.

Website: "Introducing Foxwoods PlayAway" Foxwoods PlayAway::Play Any Time (http://www.foxwoods.com/playaway/ , download date: Jul. 19, 2005, 2 pgs.

Welch, Sara, "Foxwood's new Playway game stirs up controversy", WTNH.com, [online], [retrieved Jul. 20, 2005], Retrieved from the Internet: <http://www.wtnh.com/Global/story.asp?S=3615729>. 1 pg.

Nelson, Rose, "Is It Bingo, or a slot Machine", Gaming Studies Research Center, University of Nevada Las Vegas, #82 (2002) 3 pgs.

250

| CONSUMER IDENTIFIER 802 | PLAYER TRACKING CARD NUMBER 804 | NAME 806 | ADDRESS 808 | CONTACT INFORMATION 810 |
|---|---|---|---|---|
| P123456 | 11112222 | JOHN DOE | ANYWHERE, USA | JDOE@ISP.COM |
| P654321 | 22223333 | BILL ROBERTS | SOMEWHERE, USA | BROBERTS@COMPANY.COM (111) 222-3332 |
| P111222 | 33334444 | LINDA GREEN | ANYPLACE, USA | (999) 888-7777 |

FIG. 8

260

| OUTCOME IDENTIFIER 902 | DATE GENERATED 904 | TIME GENERATED 906 | GAMING DEVICE IDENTIFIER 908 | TYPE OF GAMING DEVICE 910 | SLOT BOOK IDENTIFIER 912 | OUTCOME 914 | PAYOUT 916 |
|---|---|---|---|---|---|---|---|
| OC11221122 | 6/4/05 | 12:31:26AM | G113366 | JEWEL BANDIT | SB123321 | NECKLACE-NECKLACE-BRACELET | 20 CENTS |
| OC11221123 | 6/4/05 | 12:31:29AM | G113366 | JEWEL BANDIT | SB123321 | EARING-PENDANT-MEDALLION | 0 |
| OC66556655 | 6/5/05 | 3:14:02PM | G224477 | EASTERN SPICES | SB234432 | CINNAMON-CARDAMOM-SUMAC | $1 |
| OC99889988 | 6/6/05 | 9:55:59PM | G558899 | CALIFORNIA PROSPECTOR | SB345543 | PAN-PICK-GOLD NUGGET | 5X (IMPLIED WAGER) |

FIG. 9

270

| SLOT BOOK IDENTIFIER 1002 | THEME 1004 | OUTCOME DENOMINATION 1006 | TOTAL NUMBER OF OUTCOMES 1008 | PRICE 1010 | OUTCOMES 1012 |
|---|---|---|---|---|---|
| SB111222 | JEWEL BANDIT | 10 CENTS | 1000 | $10 | OC11221122, OC11221123... |
| SB222333 | MIXED | VARIED | 100 | $20 | OC11119999, OC22220000... |
| SB333444 | BONUS SLOT GAME | 25 CENTS | 250 | $5 | OC33334444, OC44445555... |

| BOOK VALUE 1014 | DATE SOLD 1016 | EXPIRATION DATE 1018 | BUYER 1020 | REDEEMED 1022 |
|---|---|---|---|---|
| $8.70 | 7/9/05 | 9/1/05 | P123456 | NO |
| $33.27 | 7/10/05 | 12/31/05 | RICK JONES | YES |
| $5.75 | 7/10/05 | 10/10/05 | UNKNOWN | NO |

FIG. 10

280

| GAMING DEVICE IDENTIFIER 1102 | DATE 1104 | TIME PERIOD 1106 | NUMBER OF OUTCOMES 1108 | VIDEO CLIP 1110 |
|---|---|---|---|---|
| G111122 | 5/12/05 | 2:00AM-2:59AM | 1000 | <VIDEO DATA> |
| G222233 | 5/12/05 | 3:15PM-3:20PM | 200 | <VIDEO DATA> |
| G333344 | 5/13/05 | 11:00:08AM-11:00:11AM | 100 | <VIDEO DATA> |

FIG. 11

474

| SYMBOL IDENTIFIER 1202 | SYMBOL GRAPHIC 1204 | SYMBOL GRAPHIC DATA 1206 |
|---|---|---|
| SL111 | BELL | <GRAPHIC DATA> |
| SL222 | JACK OF HEARTS | <GRAPHIC DATA> |
| SL333 | LAMP | <GRAPHIC DATA> |

FIG. 12

476

| BACKGROUND IDENTIFIER 1302 | BACKGROUND DESCRIPTION 1304 | BACKGROUND GRAPHIC DATA 1306 |
|---|---|---|
| B11 | JUNGLE SCENE | <GRAPHIC DATA> |
| B22 | ISLAND SCENE (COCONUT PALM SLOT MACHINE) | <GRAPHIC DATA> |
| B33 | FIREWORKS | <GRAPHIC DATA> |

FIG. 13

1510

APPLICABLE RULES:

*TOTAL WINNINGS FOR THIS SLOT BOOK MAY BE REDEEMED BY MAILING THE BASE LEAF OF THIS SLOT BOOK WITH A SELF-ADDRESSED, STAMPED ENVELOPE TO:*

*123 MAIN STREET*
*SUNNYVILLE, USA*

*OR BY VISITING THE WEB SITE: WWW.SLOTOUTCOMEBOOK.COM AND ENTERING THE CODE FOUND ON THE BASE LEAF.*

*THE PRIZE ON THIS PAGE MAY BE REDEEMED IN THE SAME WAY, EITHER BY MAILING IN THIS PAGE OR BY ENTERING THE CODE FOUND BENEATH THE BAR CODE ON THE FRONT OF THIS PAGE AT THE ABOVE WEB SITE.*

*USE OF THIS PAGE TO REDEEM A PRIZE WILL INVALIDATE THE BASE LEAF, REQUIRING THAT EACH PAGE OF THIS SLOT BOOK BE REDEEMED INDIVIDUALLY.*

*WINNINGS FOR THIS SLOT BOOK MAY ALSO BE REDEEMED IN PERSON AT THE MEGALAND CASINO.*

*EACH COIN OF WINNINGS REDEEMABLE FOR 25-CENTS ($0.25) IN CASH*

*MUST BE 21 OR OLDER TO PLAY*

*EXPIRES 6/1/06 - WINNINGS MUST BE REDEEMED BEFORE THE DATE OF EXPIRATION*

*GENERATED 2/10/06 AT 8:05AM EST ON GAMING DEVICE G982498*

FIG. 15

METHODS AND SYSTEMS FOR PROVIDING PAPER BASED OUTCOMES

The present Application is a continuation of U.S. patent application Ser. No. 10/885,570 filed Jul. 6, 2004, which claims the benefit of U.S. Provisional Application No. 60/484,816 filed Jul. 3, 2003, in the name of Walker et al.

Each of the above-referenced applications is incorporated by reference herein in its entirety.

BRIEF DESCRIPTION OF THE FIGURES

FIG. 8 is a table illustrating an example data structure of an example consumer database as depicted in FIG. 2 for use in some embodiments of the present invention.

FIG. 9 is a table illustrating an example data structure of an example outcome database as depicted in FIG. 2 for use in some embodiments of the present invention.

FIG. 10 is a table illustrating an example data structure of an example slot book database as depicted in FIG. 2 for use in some embodiments of the present invention.

FIG. 11 is a table illustrating an example data structure of an example audit database as depicted in FIG. 2 for use in some embodiments of the present invention.

FIG. 12 is a table illustrating an example data structure of an example symbol graphics database as depicted in FIG. 4 for use in some embodiments of the present invention.

FIG. 13 is a table illustrating an example data structure of an example background graphics database as depicted in FIG. 4 for use in some embodiments of the present invention.

FIG. 15 is a diagram illustrating an example of the appearance of the backside of an outcome leaf according to some embodiments of the present invention.

DETAILED DESCRIPTION

Figure 1A:
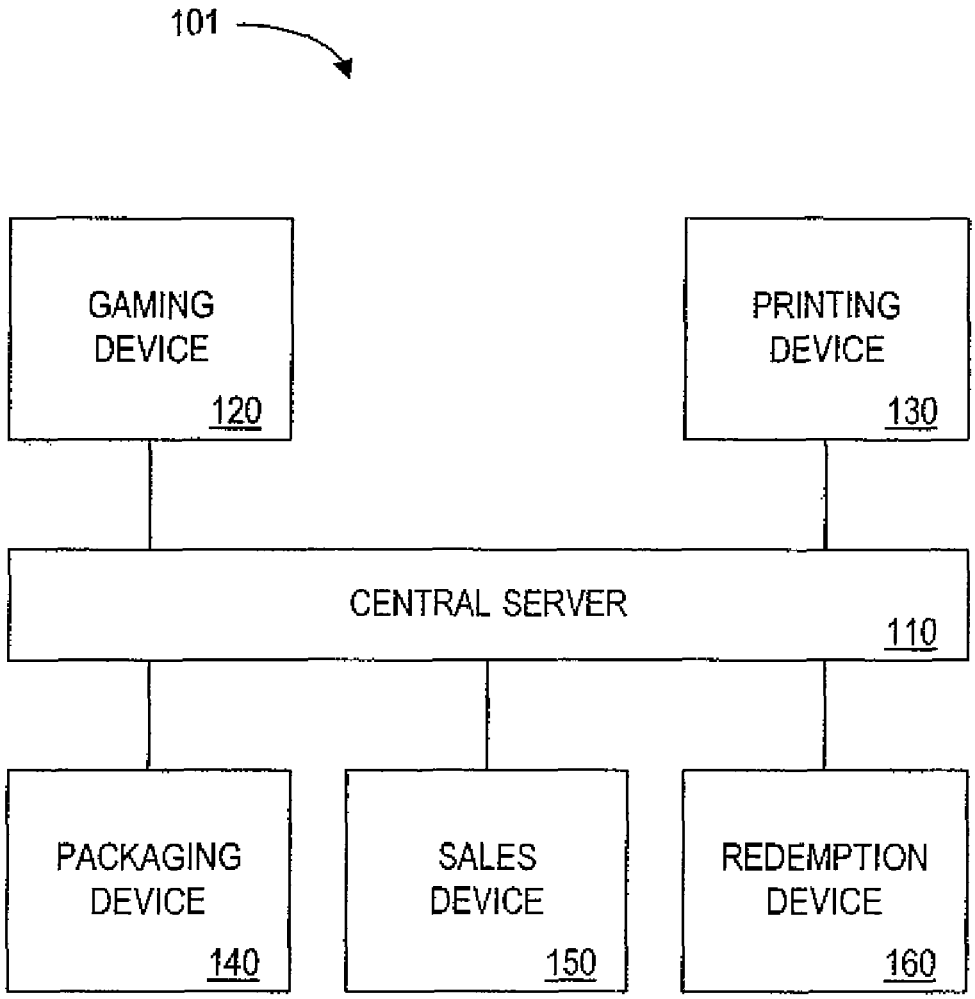
FIG. 1A is a block diagram illustrating an example system according to some embodiments of the present invention.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

It will be readily apparent that the various methods and algorithms described herein may be implemented by, e.g., appropriately programmed general purpose computers and computing devices. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments of the present invention need not include the device itself.

The term "computer-readable medium" as used herein refers to any medium that participates in providing instructions that may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (1R) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable-media may be involved in carrying a sequence of instructions to a processor.

Various embodiments of the present invention are described herein with reference to the accompanying drawings. The leftmost digit(s) of a reference numeral typically identifies the FIG. in which the reference numeral first appears. As will be understood by those skilled in the art, the drawings and accompanying descriptions presented herein are exemplary arrangements for stored representations of information. A number of other arrangements may be employed besides the tables shown. Similarly, the illustrated entries represent exemplary information, but those skilled in the art will understand that the number and content of the entries can be different from those illustrated herein.

Various embodiments of the present invention provide for a series of printed outcomes. Each outcome preferably has an associated denomination and an associated payout. In some embodiments, each outcome is randomly generated by a gaming device, and the outcomes are packaged together to form a slot book. Slot books may be sold or given to consumers and redeemed for the cumulative payouts of the outcomes contained within. In one embodiment, each outcome is printed on a separate page of the slot book. Prior to its being provided to a consumer, a slot book and all of its outcomes are preferably hidden from human view (e.g., underneath a wrapper). A consumer may purchase a slot book, and may then view the outcomes at his leisure. The consumer may later claim any payouts (e.g., a cumulative payout for all outcomes, a payout for one or more particular outcomes) associated with the outcomes of his slot book.

In one example, a slot book with 200 outcomes of 5-cent denomination each might sell for $10. Each outcome, in turn, might pay back an average of 4.5 cents. Therefore, the slot book with 200 outcomes would be expected to pay back $9.

Applicants have recognized that a consumer who purchases a slot book in accordance with one or more embodiments of the present invention may enjoy an experience akin to gambling even when away from a gaming device. In many embodiments, a slot book is small and portable, and so may be carried anywhere. Even though the outcomes the consumer has purchased are determined in advance, the consumer has not yet seen them. Therefore, the consumer may enjoy looking at the outcomes one by one, relishing the winning outcomes, and anticipating the unseen outcomes on subsequent pages of the slot book. Outcomes may be displayed, for example, using symbol graphics, such as pictures of cherries, oranges, playing cards, and other symbols used on gaming devices. The pages on which outcomes are printed may also contain background graphics. The background graphics may depict scenes or images in keeping with the theme of the gaming device at which the outcomes were generated. For example, a page with an outcome generated on a "King of Beasts" machine might contain a scene depicting the plains of Africa. A page containing an outcome may also show the payout for the outcome, the cumulative winnings for all the outcomes thus far in the slot book, and any other statistics of interest.

Applicants have recognized that some types of entities (e.g., casinos) may benefit from this invention by selling gaming entertainment that can be experienced by a consumer away from the casino. Some types of consumers may find the ability to extend their gaming experience appealing. Some consumers may find the flexibility of the experience allowed by some embodiments appealing. For example, in some embodiments, a consumer may enjoy an experience akin to gambling whenever the player chooses, such as when engaged in otherwise boring activities. For example, a consumer may peruse slot books while waiting in line to eat at a casino restaurant, or while waiting in line for an amusement park ride. Applicants have recognized that entities such as casinos may find it appealing to be able to earn revenue for entertaining a consumer beyond the time that he is physically present at the casino. As a typical consumer might be physically present at a casino for only a few days out of the year, the potential for additional revenue is large.

Applicants have also recognized that a casino and other types of entities may find it appealing to be able to sell a block of outcomes at one time to a consumer, thereby assuring the casino a larger share of the consumer's business than might otherwise be possible. With respect to some embodiments, consumers may enjoy discounts on gambling outcomes by purchasing them in bulk (e.g., as provided to the consumer in a slot book).

In some embodiments, a casino benefits from the ability to maintain an ongoing relationship with a consumer who purchases its slot books. Applicants have also recognized that some operators and owners of casinos may find it appealing to be able to increase opportunities to interact with consumers. According to some embodiments, when a consumer redeems his slot book, the casino may have an additional chance to interact with the consumer (and thus possibly to promote itself and/or other businesses to the consumer). The slot book itself, in the hands of the consumer, may help promote the casino through ads, coupons, and other devices in the slot book. Furthermore, in some embodiments, the casino may interact with the consumer when the consumer redeems the slot book, for example, on the casino's Web site, or in person at the casino. In some embodiments, the casino may also send reminders to a consumer to redeem his slot book before any expiration date, and may include self-promotions with the reminders. In some embodiments, a casino benefits by promoting third-party merchants using slot books, and by receiving payments from third-party merchants accordingly. For example, a third-party merchant may have advertisements in slot books, or may allow losing outcomes to be used as valuable coupons with the merchant, thereby alleviating the disappointment typically associated with losing outcomes. Some types of consumers may find it appealing to be able to benefit from discounts and other marketing promotions included in slot books.

Applicants have recognized that with respect to some embodiments, both consumers and entities such as casinos may find it appealing to be able to give consumers the ability to purchase a slot book and to then give it as a gift to another person. The gift recipient, after experiencing the casino's products (e.g., the slot book, the outcomes), may become a new customer of the casino.

Applicants have further recognized that casinos may find it advantageous, in accordance with some embodiments of the present invention, to be able to put gaming devices to use generating printed outcomes at times when the gaming devices would otherwise be idle.

Some embodiments of the present invention may provide the benefit to a casino that a consumer may purchase a slot book but fail to redeem winnings associated with the slot book. Also, because, in accordance with some embodiments, there may be a period of time between when the consumer purchases a slot book and when someone tries to redeem any payout for the slot book, a casino may find it appealing to be able to earn interest on or otherwise use money with which a consumer purchased a slot book, before having to pay back a portion of the money to compensate the consumer for his winnings.

According to one or more embodiments, once a consumer has finished viewing all of the outcomes in a slot book, he may come to the last page, or the base leaf, of the book. The base leaf may contain summary statistics, such as the cumulative winnings for the entire book. The base leaf may also contain a code, such as an alphanumeric character sequence, or a bar code, that the consumer can use to redeem the slot book and receive his cumulative winnings. The base leaf may also contain instructions for how to redeem the slot book. Instructions might direct the consumer to a Web site or to a mailing address, for example. A consumer may visit the indicated Web site, enter his mailing address and the code from his base leaf, and have his cumulative winnings mailed to him. A consumer might also send in the base leaf to the indicated mailing address, or may bring the base leaf to a casino help desk or to a gaming device in person in order to receive his winnings. In some embodiments, a consumer may redeem individual outcomes. For example, a consumer might enter into a casino's Web site a code printed on a page with a single outcome in order to receive the payout associated with that outcome.

In some embodiments, marketing promotions are printed on the pages of slot books. Marketing promotions may take many forms, including advertisements, coupons, and offers to provide the consumer with a benefit (e.g., in exchange for the consumer committing to do business with a particular merchant). For example, every losing outcome may double as a coupon, which may be used for a discount at participating merchants. Therefore, according to some embodiments, a consumer would win some benefit from every outcome, such as a cash payout or a coupon good for a discount.

Some embodiments of the present invention provide a system that includes one or more of the following: a gaming device for generating outcomes, a printing device for printing the outcomes; a packaging device for packaging the printed outcomes into slot books; a sales device for recording the sale of slot books and for receiving payment for them; a redemption device for receiving an identifier from a slot book, determining the associated winnings for the slot book and providing the payment of the winnings; and a central server for coordinating one or more of the above devices and for tracking the generation, sale, and redemption of slot books.

Throughout the description that follows and unless otherwise indicated, the following terms may include and/or encompass example meanings described herein. These terms and illustrative example meanings are provided to clarify the language selected to describe embodiments of the invention both in the specification and in the appended claims.

Base Leaf. A sheet of paper or other substrate that typically is the last sheet in a slot book. The base leaf is typically made of a relatively sturdy material so as to be durable and so as to support the structure of the rest of the slot book (i.e. prevent it from bending or sagging). Additionally, the base leaf typically contains summary statistics describing all the outcomes contained in a slot book. In many embodiments, it is sufficient for a consumer to submit only the base leaf of a slot book in order to collect any winnings associated with the slot book. This is because the summary statistics, especially if presented in the form of a bar code or other machine-readable code, allow a redemption device to determine the amount of winnings due to a consumer for the entire slot book.

Denomination. The implied wager associated with an outcome. (See implied wager). For example, a 10-cent denomination outcome might pay, on average 9.5 cents, and might pay only in multiples of 10 cents.

Gaming Device. Any electrical, mechanical, or electromechanical device that accepts wagers, steps through a process to determine an outcome, and pays winnings based on the outcome. The outcome may be randomly generated, as with a slot machine; may be generated through a combination of randomness and player skill, as with video poker; or may be generated entirely through player skill. Gaming devices may include slot machines, video poker machines, video blackjack machines, video roulette machines, video keno machines, video bingo machines, and the like.

Handle Pull. A single play at a gaming device, including video poker, video blackjack, video roulette, video keno, video bingo, and other devices. The definition is intended to be flexible in that a single play might constitute a single complete game, or a single wager. For example, in video blackjack, a player might play a single game in which he splits a pair of sevens, requiring an additional wager. This one game might thereby constitute either one or two handle pulls, in different embodiments.

Implied Wager. A wager amount based on which an outcome in a slot book pays out. In many embodiments, the wager amount is implied because the purchaser of the slot book does not actually place a separate wager for each outcome. Rather, the purchaser pays a fixed price for all the outcomes of the slot book. In some instances, the implied wager may be the price of the slot book divided by the number of outcomes in the slot book. For example, if a purchaser pays $10 for a slot book with two hundred outcomes, then the implied wager for each outcome may be five cents. However, an implied wager need not be based on the purchase price as, for example, a consumer may receive a slot book for free or for a discount. The payout of an outcome may be based on the implied wager amount in the sense that payouts may be designed to return, on average, a predetermined percentage of the implied wager, e.g., 95%. Furthermore, in some embodiments, payouts may only be in integer multiples of the implied wager amount. For example, if the implied wager amount is 10 cents, then payouts might be 0, 10 cents, 20 cents, 30 cents, etc., but not, 7 cents, 15 cents, etc.

Outcome. The output or result of a handle pull. Outcomes may include a set of indicia associated with a reel slot machine, a video poker machine, a video keno machine, a video blackjack machine, a video roulette machine, a video bingo machine or the like. Exemplary outcomes include, but are not limited to: "cherry-cherry-bell"; "Ks Qs 10s 10h 10d"; and "A J" (in blackjack).

Outcome Leaf. A sheet of paper or other substrate containing information about an outcome generated on a gaming device. The information may include the symbols that comprise the outcome, the payout associated with the outcome, the time and date during which the outcome was generated, and the gaming device at which the outcome was generated. The substrate may also include graphical illustrations, such as an illustration of a jungle scene, of a treasure trove, of a jewelry store, or of any other scene that is thematic to the gaming device at which the outcome was generated. Of course, illustrations may also have nothing to do with the gaming device at which the outcome was generated.

Redeem. Generally done by a consumer, to redeem is to submit a slot book or an outcome leaf in exchange for an associated payment. For example, a consumer may redeem an outcome leaf with an associated payout of $4.50 in exchange for a payment of $4.50. Similarly, a slot book may be redeemed for a payment, whose value may be the sum of the payouts of outcomes contained within. To redeem an outcome leaf, a consumer may insert the leaf into a redemption device and receive a cash payment. The consumer may also mail the outcome leaf to a casino or transmit information to the casino electronically using, e.g., email. To redeem a slot book, the consumer may act in similar fashion, but substituting the base leaf for the outcome leaf, in some embodiments. For example, the consumer may insert a base leaf of a slot book into a redemption device and receive a payout associated with the slot book.

Slot Book. A group of outcome leaves that are packaged and sold together. A slot book is typically bought by a consumer for a fixed price or in exchange for any of various types of consideration (e.g., the consumer agreeing to perform an obligation), but may be provided to the consumer for free. When purchasing the slot book, preferably the consumer does not know all of the outcomes contained in the book (and may not know any of the outcomes). In some embodiments, the consumer may later redeem the slot book for an amount of money equal to the sum of all the payouts of the outcomes displayed on the outcome leaves. In some embodiments, the consumer may redeem one or more particular outcomes for a respective payout.

System

Figure 1B:
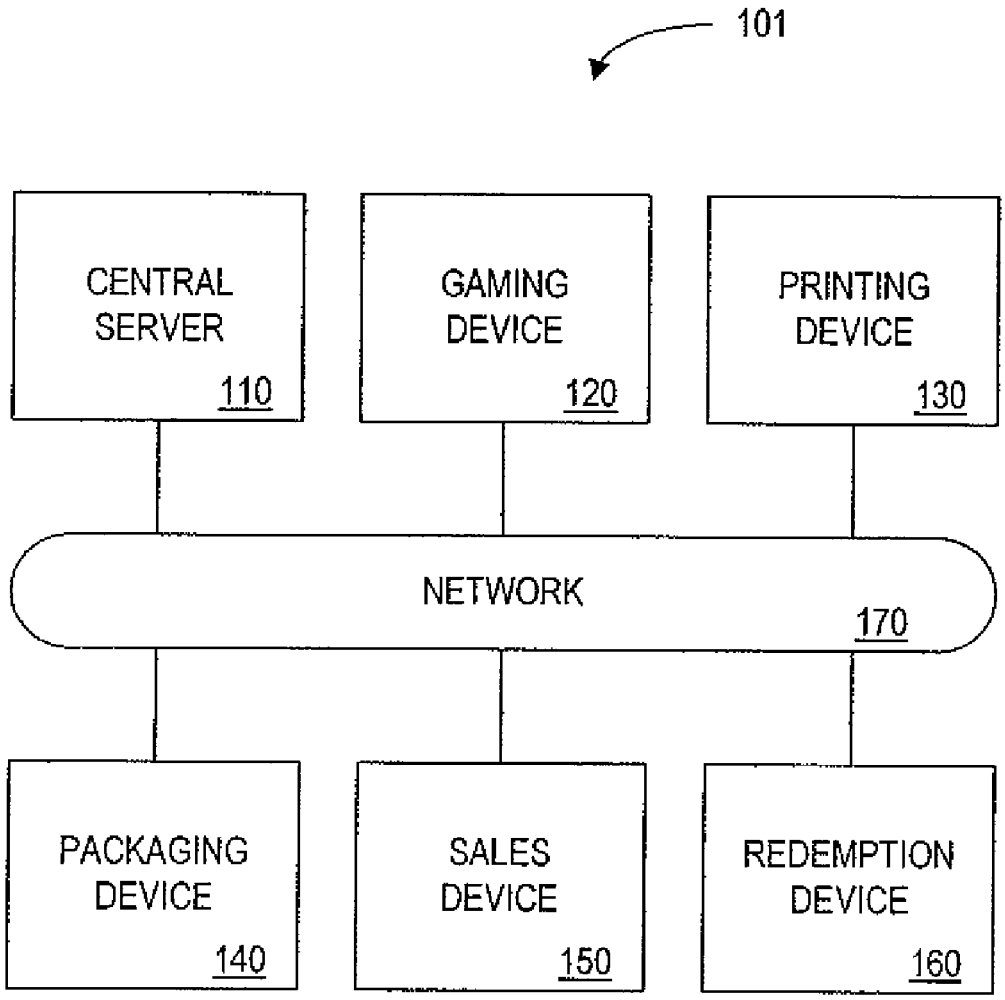
FIG. 1B is a block diagram illustrating another example system according to some embodiments of the present invention.

With reference to FIG. 1A, a system 100 according to one embodiment of the present invention is shown. In general, the system 100 comprises a central server 110 (FIG. 2) in communication with one or more gaming devices 120 (FIG. 3), one or more printing devices 130 (FIG. 4), one or more packaging devices 140 (FIG. 5), one or more sales devices 150 (FIG. 6), and one or more redemption devices 160 (FIG. 7). FIG. 1B shows an alternate system configuration 101 in which the central server 110, gaming device 120, printing device 130, packaging device 140, sales device 150 and redemption device 160 are connected to a common network 170, such as a casino network. Such devices may communicate with one another via the network.

In various embodiments, each gaming device 120 communicates with the central server 110 via a slot network. The slot network is preferably a conventional local area network controlled by the central server 110. It is to be understood, however, that other arrangements in which the gaming devices 120 communicate with the central server 110 are within the scope of the present invention.

As will be described in greater detail below, the gaming device 120 may receive instructions from the central server 110 to generate outcomes. The gaming device may, in turn, transmit indications of the outcomes to the central server. The central server may then transmit indications of the outcomes to the printing device 130. The printing device may print indications of the outcomes on sheets of paper, e.g., printing one outcome per sheet of paper. The printing device may thereby create outcome leaves. The leaves may then be transported to the packaging device 140. The leaves may be transported by human workers or automatically by conveyor belt, for example. The central server may transmit instructions to the packaging device as to how to package the outcome leaves (e.g., how many to put in a single package). The packaging device may bind and/or wrap the outcome leaves, thereby creating a slot book. The slot book may then be transported to a retail area, such as a gift shop of a casino. The slot book may be sold through a sales device 150, such as a point of sale (POS) terminal. The central server may communicate to the sales device a sales price for the slot book, among other things. The sales device may transmit a signal to the central server when the slot book has been sold. A customer who has bought the slot book may later approach the redemption device 160 in order to receive a payment based on the outcomes contained within the slot book. The redemption device may communicate to the central server an identifier associated with the slot book submitted by the consumer. The central server may, in return, communicate to the redemption device an amount that is owed the consumer. The redemption device may then authorize the appropriate payment for the consumer.

Devices

Figure 2:
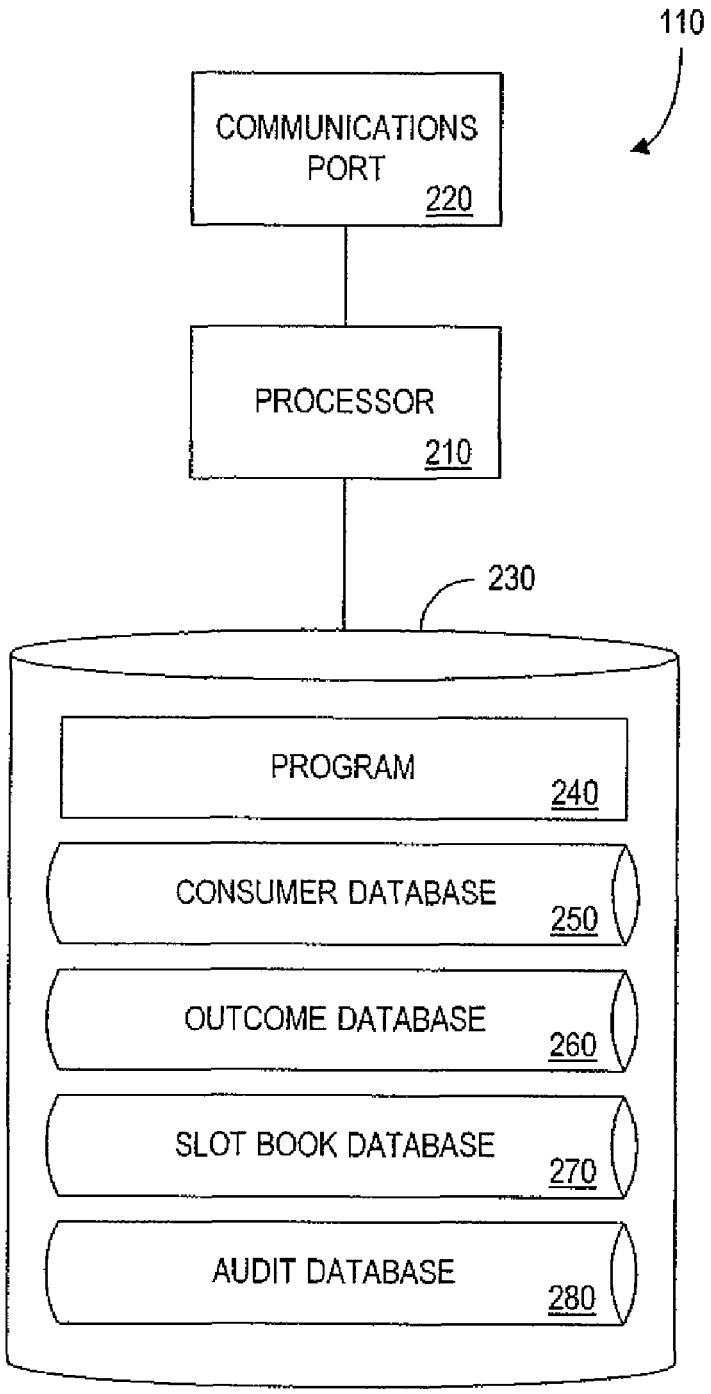
FIG. 2 is a block diagram illustrating an example of the details of a central server 110 as depicted in FIGS. 1A and 1B according to some embodiments of the present invention.

With reference to FIG. 2, the central server 110 will now be described in greater detail. The central server 110 includes a processor 210, a communications port 220 and a storage device 230. The communication port may connect the central server to a network 170 through which it may communicate messages with the gaming device 120, printing device 130, packaging device 140, sales device 150, redemption device 160, or any other devices linked to the network. The storage device 230 may include a memory, such as a Read Only Memory (ROM), Random Access Memory (RAM), or any other suitable memory. Program 240 may be stored in storage device 230, and may include instructions for the processor by which to operate the central server and by which to perform various embodiments of the present invention. Processor 210 may include any suitable processor, such as Pentium IV®, capable of executing computer instructions. Storage device 230 may further include a consumer database 250, outcome database 260, slot book database 270, and audit database 280.

Figure 3:
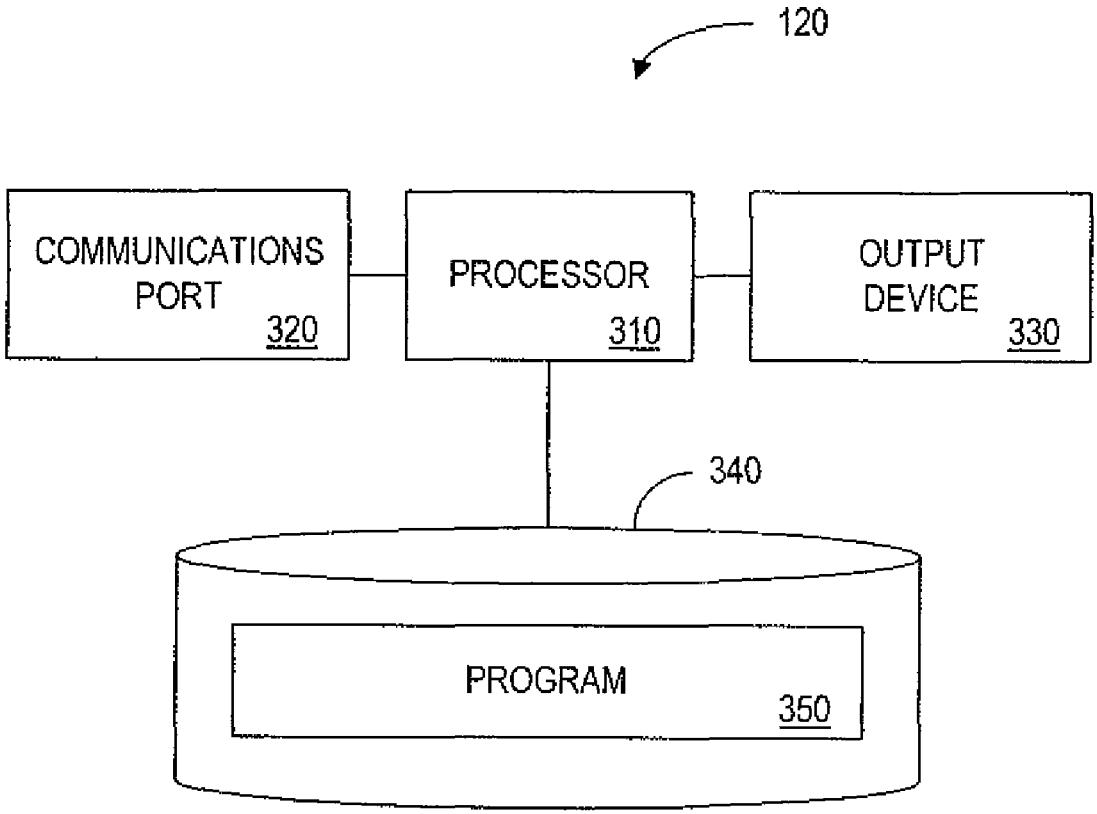
FIG. 3 is a block diagram illustrating an example of the details of a gaming device 120 as depicted in FIGS. 1A and 1B according to some embodiments of the present invention.

With reference to FIG. 3, the gaming device 120 will now be described in greater detail. The gaming device 120 includes a processor 310, a communications port 320, an output device 330 and a storage device 340. The communication port may connect the gaming device to a network 170 through which it may communicate messages with the casino server and/or with other devices linked to the network. The output device 330 may include a display screen, microphone, light bulb, or any other device suitable for conveying information to a player, customer, consumer, or other person. The storage device may include a memory, such as a Read Only Memory (ROM), Random Access Memory (RAM), or any other suitable memory. Program 350 may be stored in storage device 340, and may include instructions for the processor by which to operate the gaming device and by which to perform various embodiments of the present invention. Processor 310 may include any suitable processor, such as Pentium IV®, capable of executing computer instructions.

With respect to gaming operations, the gaming device 120 may operate in a conventional manner. A player may start the device 120 by inserting a coin, or using electronic credit, and pressing a "start" or "spin" button. Under control of a program stored, for example, in a storage device 340, the processor 310 generates a random number.

The processor 310 looks up the generated random number in a stored probability table (not shown) and finds a corresponding outcome. For example, a probability table may include a list of entries, where each entry pairs an outcome with a range of possible random numbers. If the generated random number falls within the range corresponding to a given outcome, then the outcome is selected. Based on the selected outcome, the processor 310 locates the appropriate payout in a stored payout table (not shown). For example, the payout table may include a list of entries, where each entry pairs an outcome with a corresponding payout. The processor 310 also directs a reel controller (not shown) to spin reels (an example of output device, 330) and to stop them at a point when they display a combination of symbols corresponding to the selected payout and/or identified outcome. When the player wins, the machine may store the credits won in storage device 340 and may displays them in a video display area (an example of output device, 330).

In alternative embodiments, the gaming device contains two processors. A first of the processors is dedicated to executing instructions for a program to allow a person physically present at the gaming device to play the gaming device. A second of the processors is dedicated to executing instructions for a program to allow outcomes to be generated for a person not present at the gaming device (e.g., for a future purchaser of a slot book). In these embodiments, a person physically present at a gaming device may receive one set of outcomes generated by a first processor, and a second set of outcomes generated by a second processor may be created for a slot book. Casino regulators may prefer such an arrangement as then there is no question as to whether an outcome generated at a gaming device should benefit a person physically present at the gaming device, or should be for a slot book.

A hopper controller (not shown) may be connected to a hopper (not shown) for dispensing coins. When a player physically present requests to cash out by pushing a button on the gaming device 120, the processor checks the storage device to see if the player has any credit and, if so, signals the hopper controller to release an appropriate number of coins into a payout tray (not shown).

In alternative embodiments, the gaming device 120 does not include the reel controller and reels. Instead, a video display area graphically displays representations of objects contained in the selected game, such as graphical reels or playing cards. These representations are preferably animated to display playing of the selected game.

Also in communication with the processor 210 is a player tracking device (not shown). The tracking device may comprise a card reader (not shown) for reading player identification information stored on, or otherwise indicated by, player tracking card (not shown). As used herein, the term player identifying information denotes any information or compilation of information that uniquely identifies a player. In the present embodiment, the identifying information is a player identification (ID) number and player name. Although not so limited, the player tracking card of the present embodiment stores the player ID and player name on a magnetic strip located thereon. Such a magnetic strip and device to read the information stored on the magnetic strip are well-known.

The player tracking device also includes a display (not shown), having a touch screen, or a keypad (not shown). In operation, as discussed below, the gaming device 120 may display a message prompting the player to enter player parameter selections. In the present embodiment, a player enters the player parameter selections via the display which includes a touch screen. In an alternative embodiment, the player enters the player parameter selections via a keypad, which is part of the tracking device and, therefore, in communication with the processor 310.

In many embodiments, the construction and operation of the gaming device 120 may be simplified. For example, a gaming device dedicated to generated outcomes for a slot book (and not outcomes for a player who is physically present) may be simpler than a counterpart on a casino floor because the former need not necessarily interact directly with a player. A gaming device for generating the outcomes of a slot book may, in some embodiments, be without lights, graphics, and sounds meant to attract players on the casino floor. The gaming device may also lack coin handling abilities, touch screens, display screens, user interfaces such as buttons and handles, and large outer casings. A gaming device dedicated to generating outcomes for slot books may even lack means for displaying outcomes, such means including reels, video displays, bonus areas, etc.

In one embodiment, a simplified gaming device consists of only a processor, a slot network interface, and supporting hardware. Supporting hardware might include power supplies, heat sinks, motherboards, a clock, and a casing for enclosing one or more of the other hardware components.

In some embodiments, multiple gaming devices, or multiple components of separate gaming devices, may be placed within the same outer casing. For example, a single metal enclosure surrounds three sets of reels, three processors, and so on. A particular processor may receive instructions from the slot network server to generate outcomes in accordance with instructions provided by a player. The processor may then generate such outcomes, and communicate the outcomes back to the slot network server (e.g., for transmission to the player communication device). The processor may actually be a dedicated integrated circuit, e.g. an application-specific integrated circuit (ASIC), dedicated only to generating game outcomes. The dedicated integrated circuit may also take the form of a random number generator. The random number generator may communicate random numbers to the slot network server, which may then convert the random numbers to game outcomes using a table (not shown).

A simplified gaming device may additionally include a memory, such as a RAM, for storing instructions received from the central server. The instructions may indicate to the simplified gaming device how to generate outcomes for a slot book. The memory may also be used to track the cumulative number of credits won for a generated series of outcomes.

A simplified gaming device may include a display for displaying outcomes, but in some embodiments the display may be very rudimentary (relative to a display on a typical gaming device). For instance, the display may consist of between three and five regions, each with a ten-by-ten matrix of black and white pixels. Each region of pixels may be suitable for displaying a simple representation of common slot indicia, such as a cherry, lemon, or jack of diamonds. The display may serve several functions. In one capacity, the display may alert a casino attendant as to the outcome generated by the machine. The display may also alert a player (e.g., a player watching a film of the gaming device for auditing purposes) as to the outcome generated by the simplified gaming device.

Of course, many other types of display are also possible. A display may by a liquid crystal display capable of displaying text characters. Each text character may represent a different indicium of automated play at the gaming device. For instance "c" represents cherry, "A" represents ace, and so on.

A display may also be embodied as mechanical reels, paper flaps arranged in a looped configuration with the loop perpendicular to the plane of each paper flap (a display common in bus and train stations), and so on. A display may be of any size. In one embodiment, the display is only several square centimeters, large enough for the display of text or small graphics.

A gaming device, including a simplified gaming device, may include a display of the time and date. Such a display may take the form of an analog or digital clock, as well as a calendar. The clock may be periodically synchronized with a more accurate clock, such as an atomic clock, present at the slot network server or in some other location. The clock may allow any casino attendant or player or auditor viewing a film of the gaming device gaming device to ascertain the time at which an outcome was generated. The clock, whether or not it has a display, may also be used in the creation of the audit information. For instance, when the processor generates an outcome, the processor may refer to the clock to determine the time at which the outcome was generated. The time on the clock may then be recorded next to the outcome.

The gaming device may be associated with a machine identifier that identifies the machine. For example, the machine identifier may be a sequence of alphanumeric characters, such as "FRUITSLOT12345", a bar-code, a picture, a pattern of radio signals, or any other identifier. The color of a machine may also serve as the machine identifier. The machine identifier may be a permanent fixture of the machine. For instance, the machine identifier may be carved into the side of the casino casing of the machine. Alternatively, the machine identifier may be displayed on a display device of the machine.

A gaming device identifier may allow a casino attendant or a player viewing a film of a gaming device to more easily locate a machine of interest. For example, suppose a casino attendant wished to view a video audit tape of a particular machine. The casino attendant would note the machine identifier and would then look for the machine with a like identifier carved on its casing. Furthermore, a player viewing a video feed of the gaming device that generated his slot book can be assured by looking at the machine identifier that his outcomes were being generated consistently by the gaming device indicated on the pages of his slot book.

Various types of gaming devices, including a simplified gaming device, may comprise a camera. For example, the camera may be situated to film the display area of the machine. The camera may then transmit a video feed of the display area to the central server, which may in turn store the video feed so that the feed may later be provided to a purchaser of outcomes from the gaming device, or to an auditor of such outcomes. A video feed may comprise what appears to be full motion video, one or more still images, or any other type of image.

A player viewing the feed from the camera may therefore watch a simplified gaming device as it generated outcomes for his slot book. The player may thereby feel confident that outcome information contained in his slot book does in fact correspond to outcomes generated by his simplified gaming device. Via the camera feed, for example, a player may view the outcomes he sees in his slot book, a number of remaining credits (e.g., a credit balance remaining from an initial balance that is equivalent to the purchase price of the slot book), and his accumulated winnings, as displayed at the gaming device. The player may also view the time and date displayed on the gaming device. A player who sees the time and date displayed on the video feed may feel reasonably confident, for example, that he is seeing outcomes that were fairly recently generated.

In some embodiments, a camera is not part of the gaming device. For example, the camera may not be attached to the gaming device or to the gaming device casing. The camera may instead be attached to the ceiling or to the floor of the building housing the gaming device, or to some other fixture.

A camera may be in communication with a central server. Then, the central server may provide the camera with instructions, for example, to focus on a gaming device that is currently generating outcomes.

If a camera is focused on a large number of gaming devices at once, it may be desirable for a gaming device to indicate when it is active. In this way, a viewer of video footage who sees a number of gaming devices via a camera feed, can discern which gaming device is the one that generated the outcomes of his slot book. In one embodiment, a gaming device may include a light source. The light source may be turned on when the gaming device is, for example, currently in the process of generating outcomes. The light source may be left off when the gaming device is inactive. A gaming device may possess other indicators of activity, such as a flag that is raised or lowered depending on activity, or even a text indicator displaying the words "active" or "inactive." In some embodiments, gaming devices may have the capability of displaying a number of different indicators, e.g., lights of many different colors. A slot book may include a description of the indicator used by the gaming device that generated the slot book. Accordingly, a player may view footage of a large number of gaming devices, and hone in on the gaming device that generated the outcomes of his slot book, by finding the gaming device with the proper indicator.

In some embodiments, multiple cameras may be available for viewing a gaming device. For instance, two cameras can be used to create a three-dimensional visual depiction of the gaming device. This is accomplished by situating the cameras so that one camera mimics the function of a left human eye, and the other camera mimics the function of a right human eye. The feeds from the cameras can then be combined using well-known techniques to produce a three-dimensional depiction. This three-dimensional representation may then be made available for later review by a player who purchased the outcomes of a gaming device.

Figure 4:
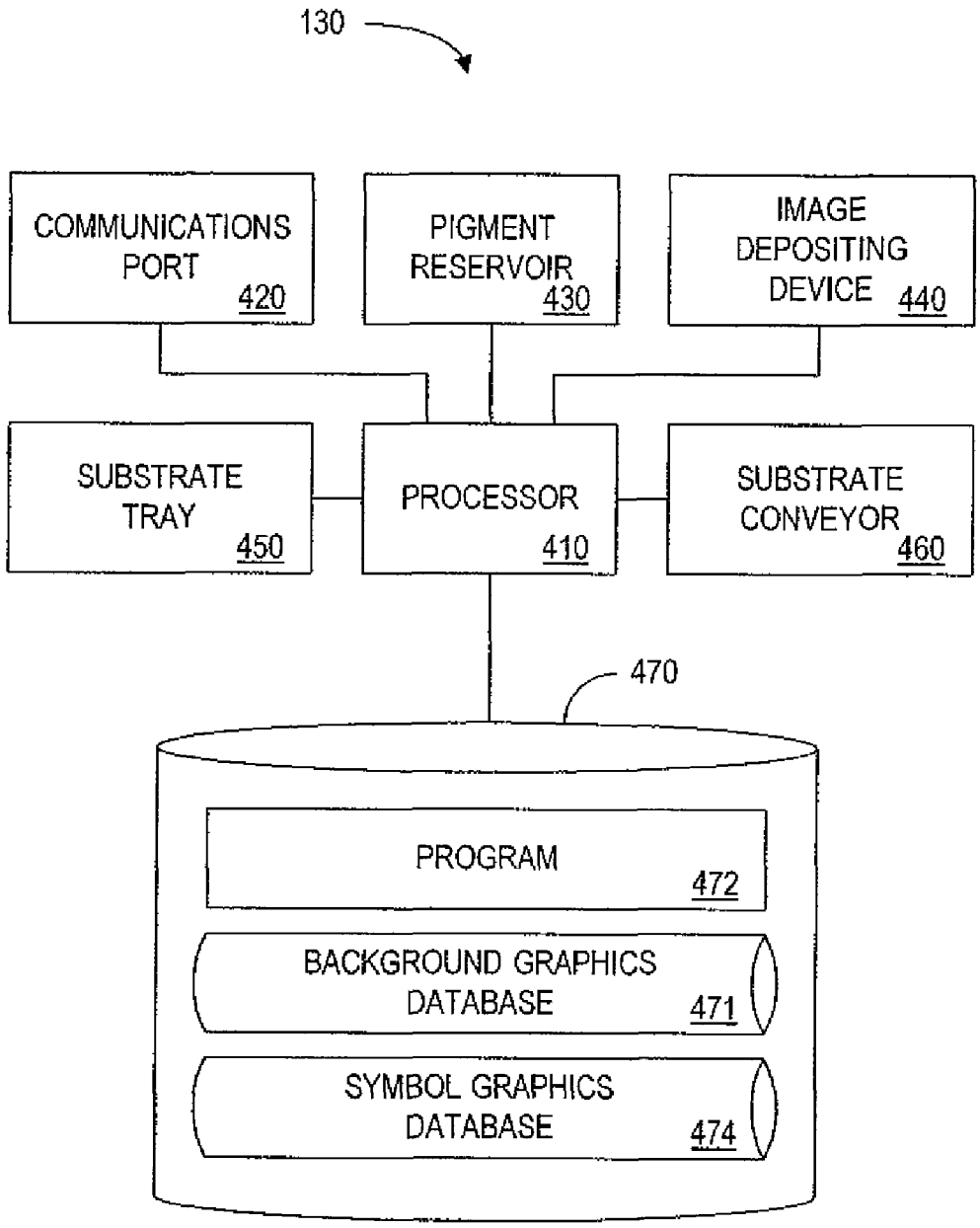
FIG. 4 is a block diagram illustrating an example of the details of a printing device 130 as depicted in FIGS. 1A and 1B according to some embodiments of the present invention.

With reference to FIG. 4, the printing device 130 will now be described in greater detail. The printing device may include a processor 410, such as an Intel Pentium IV®, for carrying out operating instructions and for operating in accordance with various embodiments of the present invention. A communications port may allow the printing device to communicate with the central server via a casino network, and to communicate with any other device on the network. Pigment reservoir 430 may include a storage container for ink, toner, or for any other substance for use in creating images on substrate, such as paper. Image depositing device 440 may include an ink jet, laser, or other device for creating an image, possibly with the use of the pigment. Substrate tray 450 may include a storage area for paper or other substrate. The substrate conveyor may include one or more belts, wheels, or other devices for conveying substrate from the substrate tray 450, to an area where an image is created (e.g., where ink is deposited by the image depositing device 440), and finally to an area where the substrate may be accessed by a worker, or other device. Storage device 470 may store a program 472 for operating the printing device in accordance with various embodiments of the present invention. Storage device may comprise RAM, ROM, or other memory. Storage device may further include a symbol graphics database 474, and a background graphics database 476. In general, printing device 130 may receive information about outcomes from the central server 110. The printing device may then print indications of such outcomes on paper to form outcome leaves, which may ultimately be assembled to form slot books. The symbol graphics database 474 may allow the printing device to determine an appropriate image to print for a given outcome. For example, if an outcome is "cherry-lemon-bar", the printing device may look up images representing a cherry, lemon, and bar, and print such images as part of an outcome leaf. The printing device may also receive information about background graphics to print on an outcome leaf. Background graphics may include pictures of a casino, promotional material, or celebratory graphics, such as fireworks printed in conjunction with a winning outcome.

Figure 5:
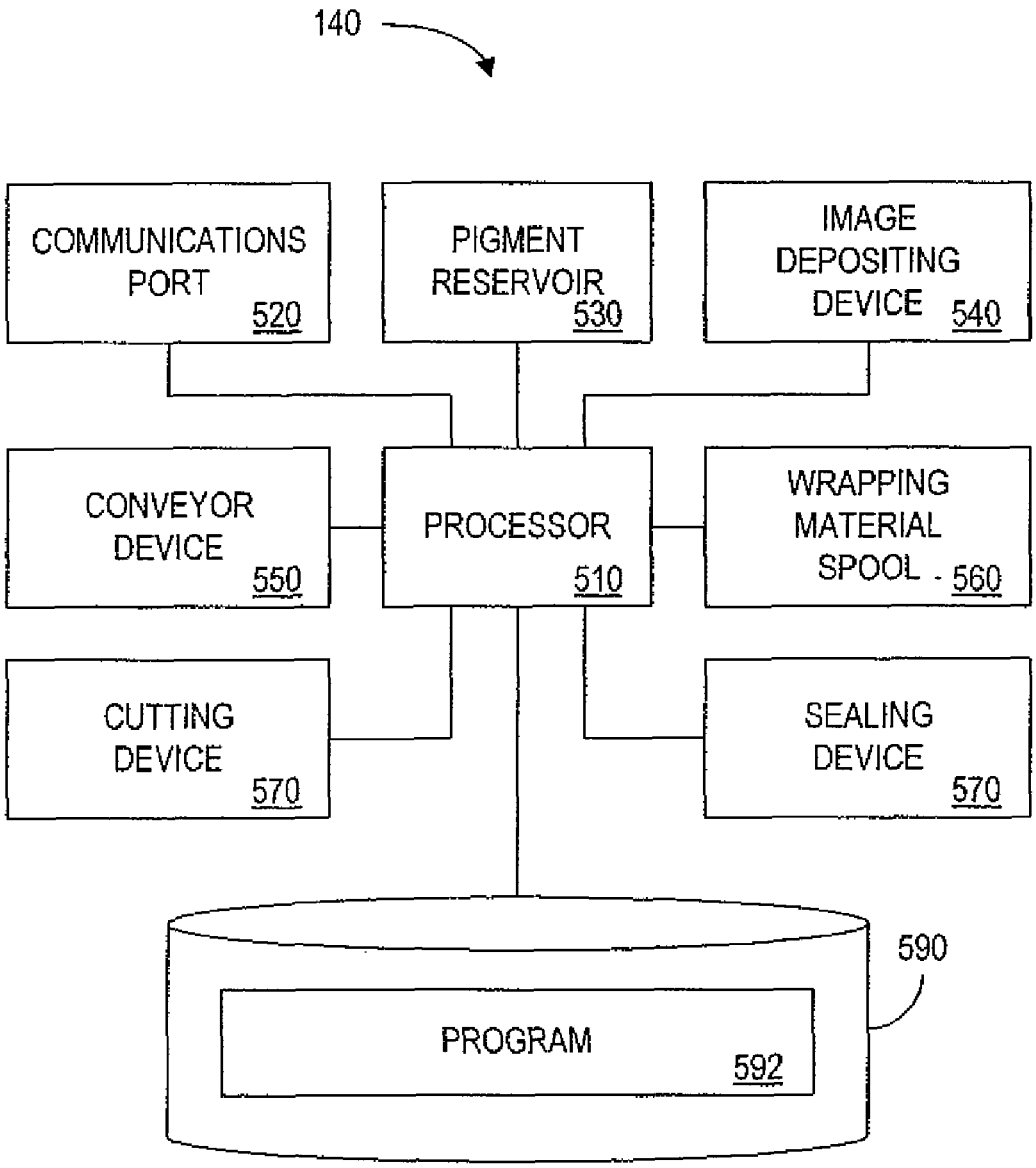
FIG. 5 is a block diagram illustrating an example of the details of a packaging device 140 as depicted in FIGS. 1A and 1B according to some embodiments of the present invention.

With reference to FIG. 5, the packaging device 140 will now be described in greater detail. Processor 510 controls the operation of the packaging device. Communications port 520 allows communication with the central server and other devices attached to the same network. Through the communications port, the packaging device may receive instructions, such as the number of outcomes to package in a single book, the color packaging to use, the graphics to be printed on the packaging, and so on. Pigment reservoir 530 may contain ink or other pigment for creating graphics on packaging. Image depositing device allows for the creating of such images. Conveyor device 550 allows the conveyance of outcomes leaves to the proper position and orientation so that they may be assembled into a complete book. Wrapping material spool 560 contains a supply of wrapping material, such as plastic or foil, for use in wrapping slot books. Cutting device 570 may include a razor or other sharp edge for cutting off the appropriate amount of wrapping material for a single slot book. Sealing device 580 may include a heating filament for bonding one edge of the cut wrapping material to another, allowing a slot book to be sealed within wrapping material. Alternatively, the sealing device may include glue, staples, or other means for sealing a slot book within the wrapping material. Storage device 590 may include a program 592 for directing the processor 510 to operate in accordance with various embodiments of the present invention.

Figure 6:
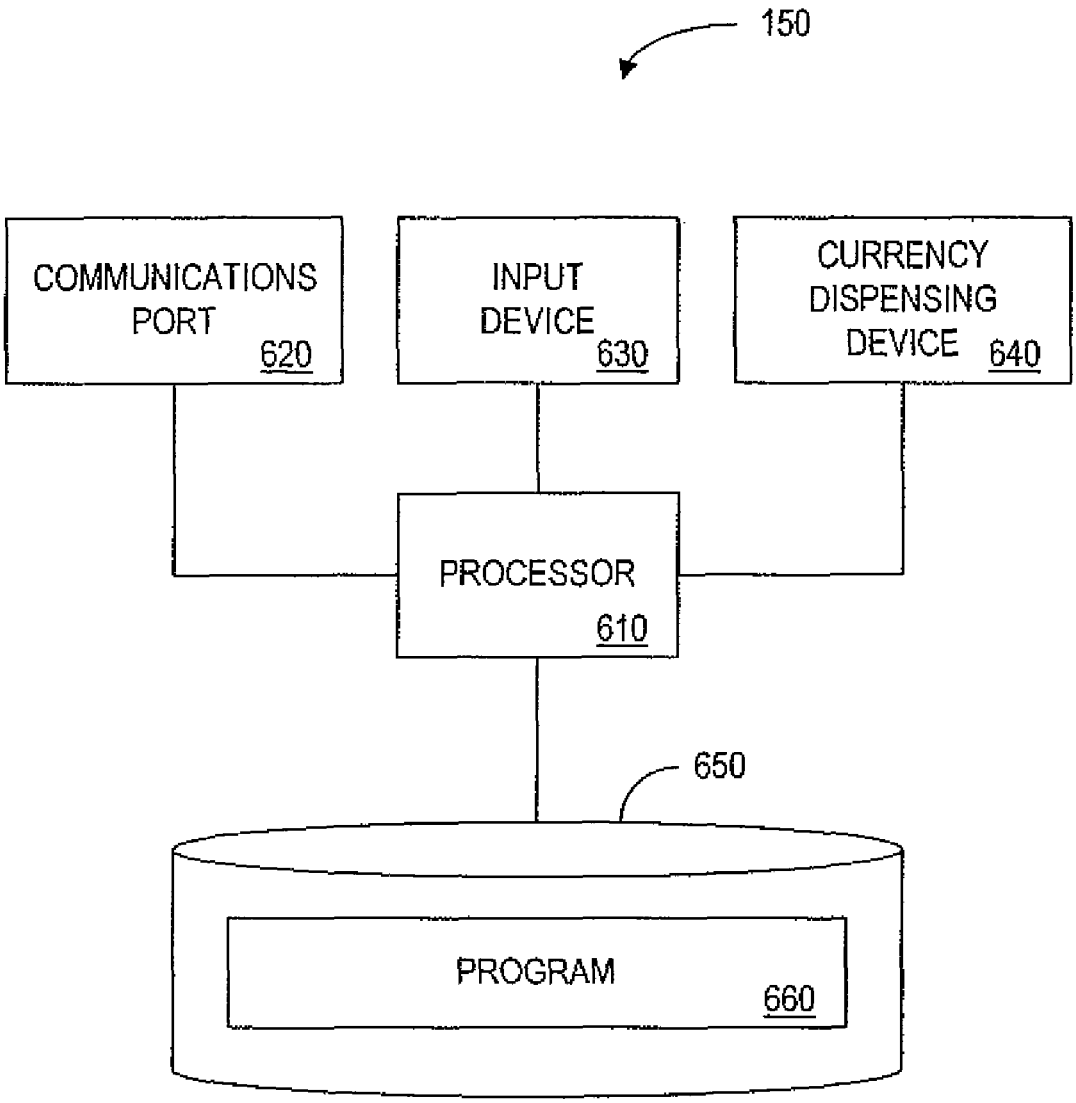
FIG. 6 is a block diagram illustrating an example of the details of a sales device 150 as depicted in FIGS. 1A and 1B according to some embodiments of the present invention.
Figure 7:
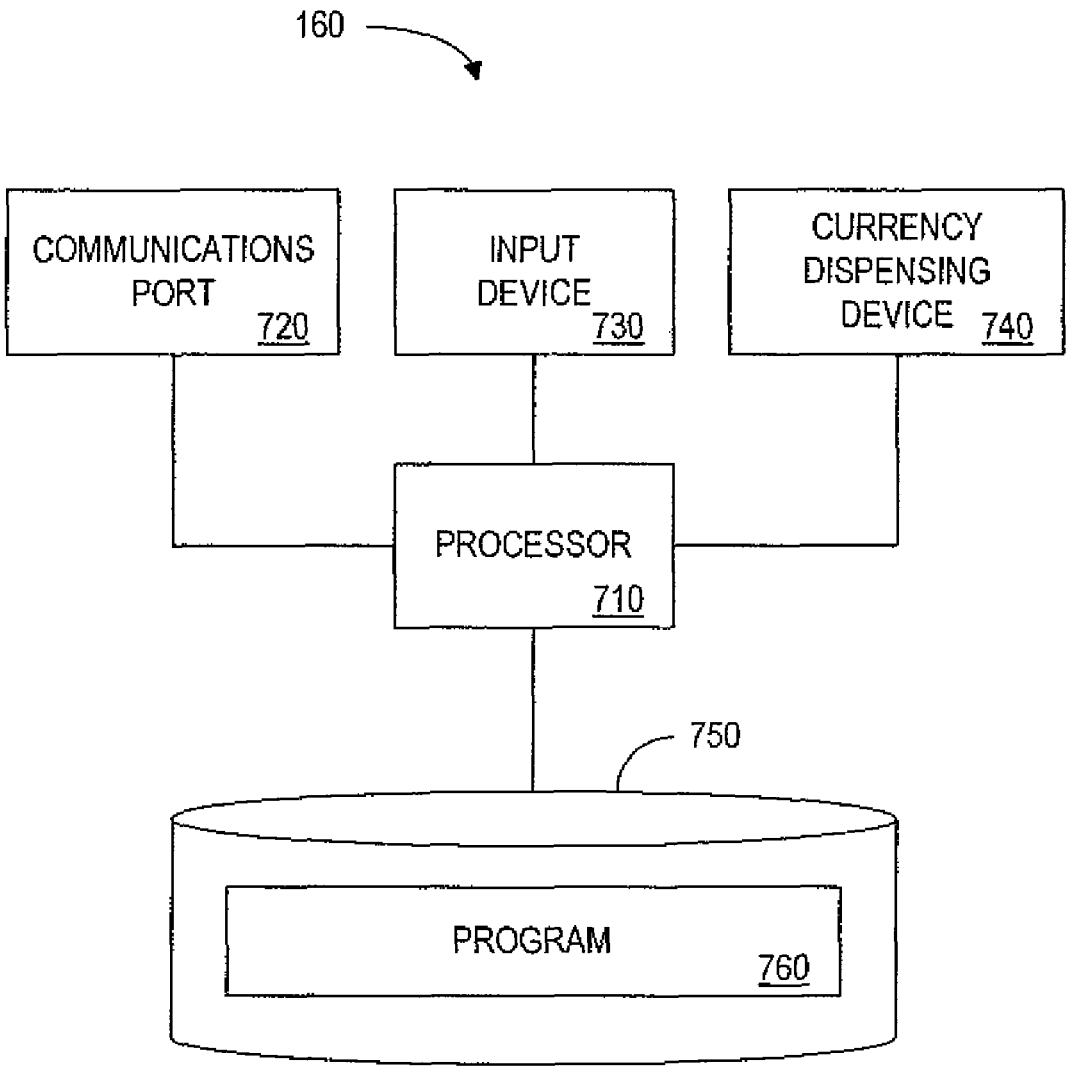
FIG. 7 is a block diagram illustrating an example of the details of a redemption device 160 as depicted in FIGS. 1A and 1B according to some embodiments of the present invention.

With reference to FIG. 6, the sales device 150 will now be described in greater detail. The sales device may be a Point of Sale (POS) terminal, for example. The sales device may be used for processing transactions in which a consumer is given one or more slot books in exchange for monetary consideration, such as cash. Processor 610 may direct the operations of sales device 150. Communications port 620 may allow the sales device to communicate via a network with the central server. The sales device may additionally communicate with other devices connected to the network. The sales device may update the central server when a slot book has been sold. The sales device may, in some embodiments, provide to the central server identifying information for the purchaser of the slot book. Input device may include a keyboard via which a cashier may enter an amount of money tendered by a purchaser. Additionally, input device 630 may include a bar-code scanner for reading a bar code from the packaging of a slot book. Input device 630 may further include a credit card reader for receiving credit card information from a consumer. Input device 630 may further include a player tracking card reader for obtaining information about a slot book purchaser, such as the purchaser's name. Of course, in various embodiments, a cashier may input information about a purchaser using lettered keys. Currency dispensing device 640 may include a drawer filled with cash, operable to open upon receiving instructions from the processor. Storage device 650 may store a program 660 for directing the processor 610 in accordance with various embodiments of the present invention.

With reference to FIG. 7, the redemption device 160 will now be described in greater detail. Storage device 750 includes a program 760 for directing processor 710 to operate redemption device 160 in accordance with various embodiments of the present invention. Communications port 720 allows the redemption device to receive data and instructions from the central server and to provide information to the central server. Input device 730 may include a bar code reader, for example. Consumers who have purchased slot books may bring outcome leaves and/or base leaves to the redemption device. A leaf may be inserted into the input device, after which the redemption device may read a bar code on the leaf. The redemption device may thereby deduce, for example, an identification number associated with the slot book of which the leaf is a part. The redemption device may send this identification number to the central server. The central server may communicate back to the redemption device a payment amount associated with the slot book. Currency dispensing device 740 may then dispense currency in the amount of the payment.

Databases

The consumer database 250 of the present embodiment as shown in FIG. 8, includes multiple records having multiple fields of information. Specifically, the consumer database 250 comprises multiple records, each record being associated with a particular consumer, as identified by a consumer identifier. The fields within each record include: consumer identifier 802, player tracking card number 804, name 806, address 808, and contact information 810. Thus, having information related to one field, such as player tracking card number 804, allows the central server 110 to retrieve or access further information stored in the other fields of that consumer's record.

It is to be understood that not all of these identifying fields, nor the illustrated design of the consumer database 250, are necessary for operation of the present embodiment. Specifically, illustrated fields are merely representative of additional information that may be stored and used for other purposes.

The outcome database 260 of the present embodiment as shown in FIG. 9, includes multiple records having multiple fields of information. Each record is associated with a particular outcome, such as an outcome generated by a gaming device. The fields within each record include an outcome identifier 902, a date generated 904 (e.g., a date that the associated outcome was generated), a time generated 906, a gaming device identifier 908 (e.g., an identifier for the gaming device on which the outcome was generated), a type of gaming device 910, a slot book identifier 912, an outcome 914, and a payout 916. The type of gaming device may indicate the make, model, brand, etc., of the gaming device that generated the outcome. The outcome may have been printed as an outcome leaf, which was then placed in a slot book. Accordingly, slot book identifier 912 may identify the slot book of which the outcome is a part. Outcome field 914 may indicate the actual symbols making up the outcome. Payout field 916 may indicate the payout associated with an outcome. Using database 260, a central server 110 may receive an outcome identifier (e.g., from a redemption device), look up the corresponding payout in field 916, and instruct the redemption device as the amount owed for the outcome.

The slot book database 270 of the present embodiment as shown in FIG. 10 includes multiple records each associated with a slot book. Each record includes multiple fields. The fields include a slot book identifier 1002, a theme 1004, an outcome denomination 1006, a total number of outcomes 1008, a price 1010, a set of outcomes 1012, a book value 1014, a date sold 1016, an expiration date 1018, a buyer 1020, and record of whether or not the slot book has been redeemed 1022. The theme 1004 may represent the theme of the gaming device that generated the outcomes of the slot book. The outcomes field 1012 may include identifiers for all outcomes included in the slot book. Such identifiers may be cross-referenced with another database, such as that depicted in FIG. 9. Other information may thereby be obtained concerning the individual outcomes. The book value 1014 may represent the sum of all payouts corresponding to the outcomes contained within the book. The book value 1014 may represent the payment to be provided to a player when he redeems a slot book. The date sold may represent the date on which the book of the record was sold to a consumer. The expiration date 1018 may represent the date after which a book may no longer be sold and/or after which a book may no longer be redeemed. The buyer field 1020 may contain a name or other identifying information about the purchaser of the slot book. The "Redeemed" field 1022 may contain a "No" if the book has not yet been redeemed by a consumer, and a "Yes" if it has.

The audit database 280 of the present embodiment as shown in FIG. 11 includes multiple records each associated with a particular set of audit data. Each record includes multiple fields. The fields include a gaming device identifier 1102, a date 1104, a time period 1106, a number of outcomes 1108, and a video clip 1110. Gaming device identifier field 1102 contains an identifier for the gaming device on which a particular sequence of one or more outcomes was generated. Audit database 280 may be cross-referenced from outcome database 260, for example, if data audit data for a particular outcome listed in database 260 is desired. For example, for a particular outcome in outcome database 260, the identifier for the gaming device that generated the outcome may be found in gaming device identifier field 908. The date and time at which the outcome was generated may be found in date generated field 904 and time generated field 906. The corresponding audit data may then be found in database 280 by looking up the appropriate gaming device identifier from field 1102, and the corresponding date in field 1104, and time period in field 1106. Note that audit data in the audit database 280 may represent the generation of multiple outcomes over a period of time, which is why time period field 1106 may list a wider range of times than, say time generated field 906 in database 260, which only lists a time for a single outcome. Number of outcomes field 1108 in fact lists the number of outcomes generated in time period 1106 and illustrated with the video clip stored in field 1110. The video data stored in field 1110 may take on a video format, such as may be used in streaming media players (e.g., RealNetworks'® RealPlayer® 10) or other video players that are well known in the art. The video clip may include video of outcomes as they were generated at the gaming device 1102 during date 1104 and time period 1106. Viewing of video clip 1110 by consumers and/or by auditors may provide greater assurance that the outcomes depicted were generated fairly.

The symbol graphics database 474 of the present embodiment as shown in FIG. 12 includes multiple records each associated with a particular symbol. Each record includes multiple fields. The fields include a symbol identifier 1202, a symbol description 1204, and symbol graphic data 1206. The symbol graphics database 474 may be stored by printing device 130. Printing device 130 may receive from central server 110 an indication that a particular outcome contained a symbol SL111. The printing device may use database 474 to look up associated graphic data in field 1206. The printing device may then print the symbol on an outcome leaf using the symbol graphic data. Symbol graphic data may include image files, such as GIF or JPEG files.

The background graphics database 476 of the present embodiment as shown in FIG. 13 includes multiple records each associated with a particular symbol. Each record includes multiple fields. The fields include a background identifier 1302, a background description 1304, and background graphic data 1306. The background graphics database may be similar in nature to the symbol graphics database. However, the background graphics database represents images and/or other graphics to be printed in the background of an outcome leaf. The background graphics may help to convey the theme of the gaming device that generated the outcomes of a slot book.

Slot Book

Figure 14:
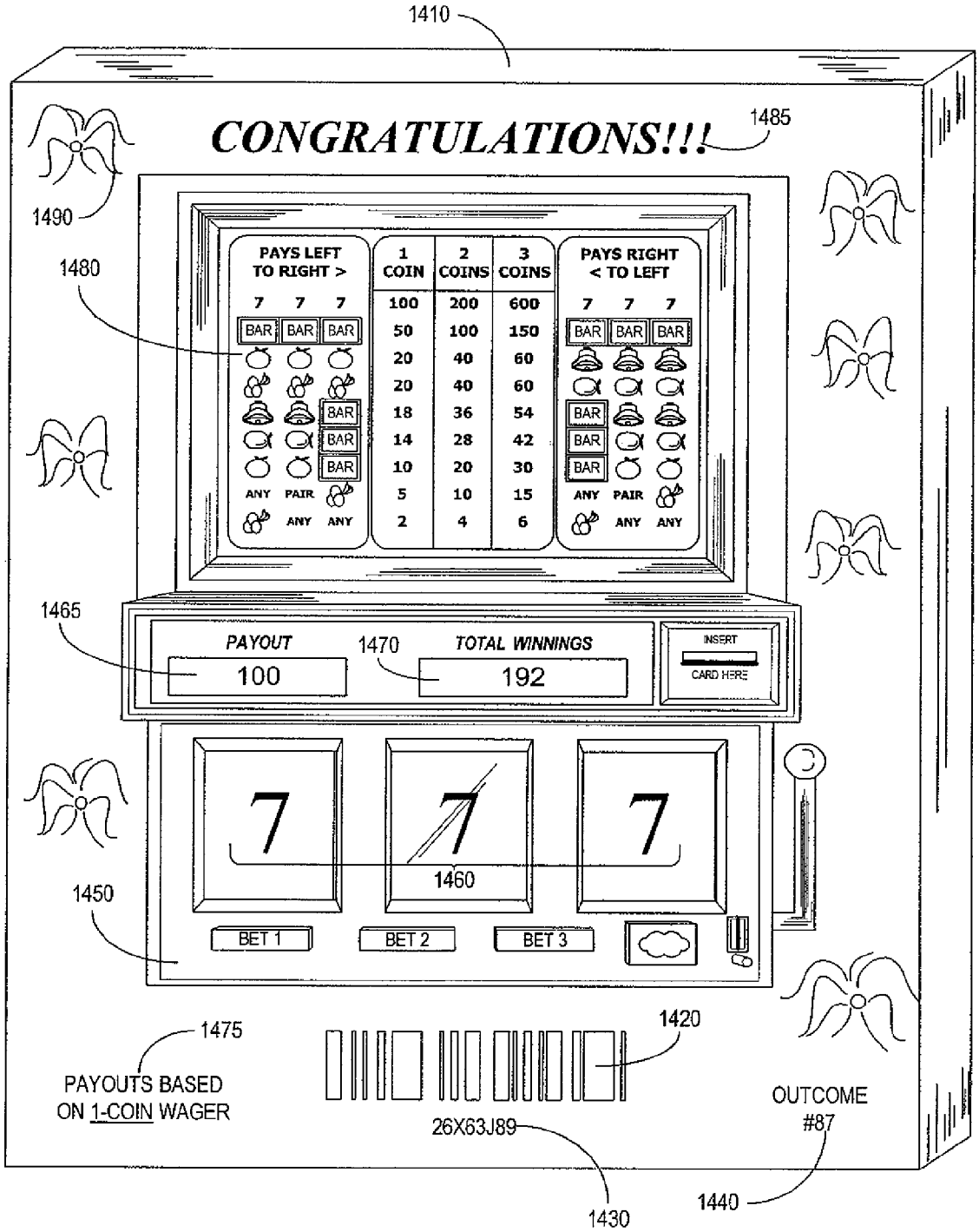
FIG. 14 is a diagram illustrating an example of the appearance of the front side of an outcome leaf according to some embodiments of the present invention.

With reference to FIGS. 14-19, a slot book will now be described in greater detail. FIG. 14 illustrates an example of an outcome leaf. Bar code 1420 provides an easy way for a machine, such as a redemption device, to determine the outcome's identifier, and to thereby allow association of the outcome with other information, such as a payout. Alphanumeric code 1430 may represent the outcome's identifier in text form. The text-based identifier may be keyed by a consumer into a consumer device, such as a personal computer (PC), and transmitted over the Internet to the central server. The central server may thereby identify the outcome and provide the player with an appropriate payment. Codes 1420 and 1430 may represent other information, in various embodiments. For example, the codes may represent a payout. Code 1430 may be an encrypted version of a payout, which would be difficult for a player to create fraudulently, as e.g., turning a payout of ten thousand credits into a code would require knowledge of the encryption scheme. Text 1440 identifies the present outcome as "Outcome 87", indicating that this is the $87^{th}$ outcome in a slot book containing at least eighty-seven outcomes. Graphic 1450 is meant to illustrate only a graphic of a slot machine, and not a slot machine itself. Graphic 1450 may in turn represent the slot machine that generated the outcome featured on the present outcome leaf, and illustrated using symbol graphics 1460. The symbol graphics 1460 together convey to the player that he has achieved the outcome "7-7-7". The outcome leaf 1410 further includes payout information 1465 for the outcome depicted ("7-7-7"). Outcome leaf 1410 further includes a "Total Winnings" area 1470 which conveys to a consumer the total winnings obtained thus far in the slot book. For example, all the payouts occurring in outcomes one to eighty seven add up to one hundred ninety two. Text 1475 indicates that payouts are based on a 1-coin wager. In other words, in the pay table 1480 depicted on the slot machine, the first column is used. Had the second or third columns been used, the slot book may have been priced differently. Text 1485 is a message that may vary from outcome leaf to outcome leaf depending on the outcome obtained. In this case, since the outcome was a winning outcome (with a 100-coin payout), the message is a congratulatory message of "Congratulations!!!" Background graphic 1490 depicts fireworks, adding to the congratulatory message.

FIG. 15 illustrates an example of the backside 1510 of an outcome leaf. The illustration in FIG. 15 may correspond to the backside of the outcome leaf depicted in FIG. 14. The backside contains additional information, instructions for redemption, and restrictions on play.

Figure 16:
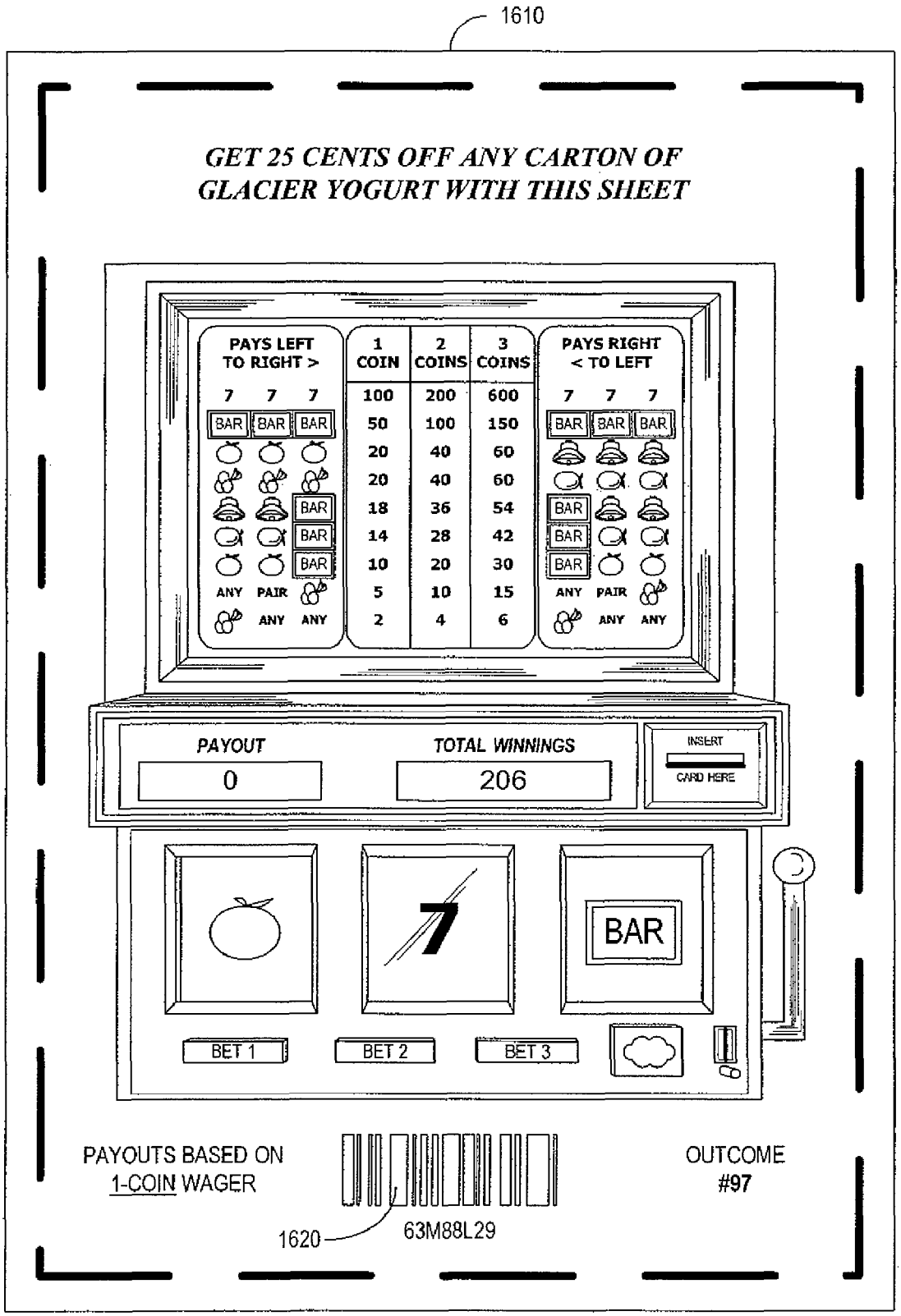
FIG. 16 is a diagram illustrating an example of the appearance of the font side of an outcome leaf that doubles as a coupon according to some embodiments of the present invention.

FIG. 16 illustrates another example of an outcome leaf 1610. The outcome leaf 1610 is also a promotion—a coupon in this case. A player may thus take the outcome leaf to a participating store and use it for a discount on Glacier Yogurt. The barcode 1620 may, in this case, allow the sponsor of the promotion (e.g., the merchant selling Glacier Yogurt), to scan the outcome leaf and automatically identify the associated promotion and discount. Thus, the central server and third party merchants may coordinate the printing of bar codes on outcome leaves so that the third party merchant is able to identify and recognize such bar codes. Of course, the central server and third party merchants may coordinate the printing of other codes as well.

Figure 17:
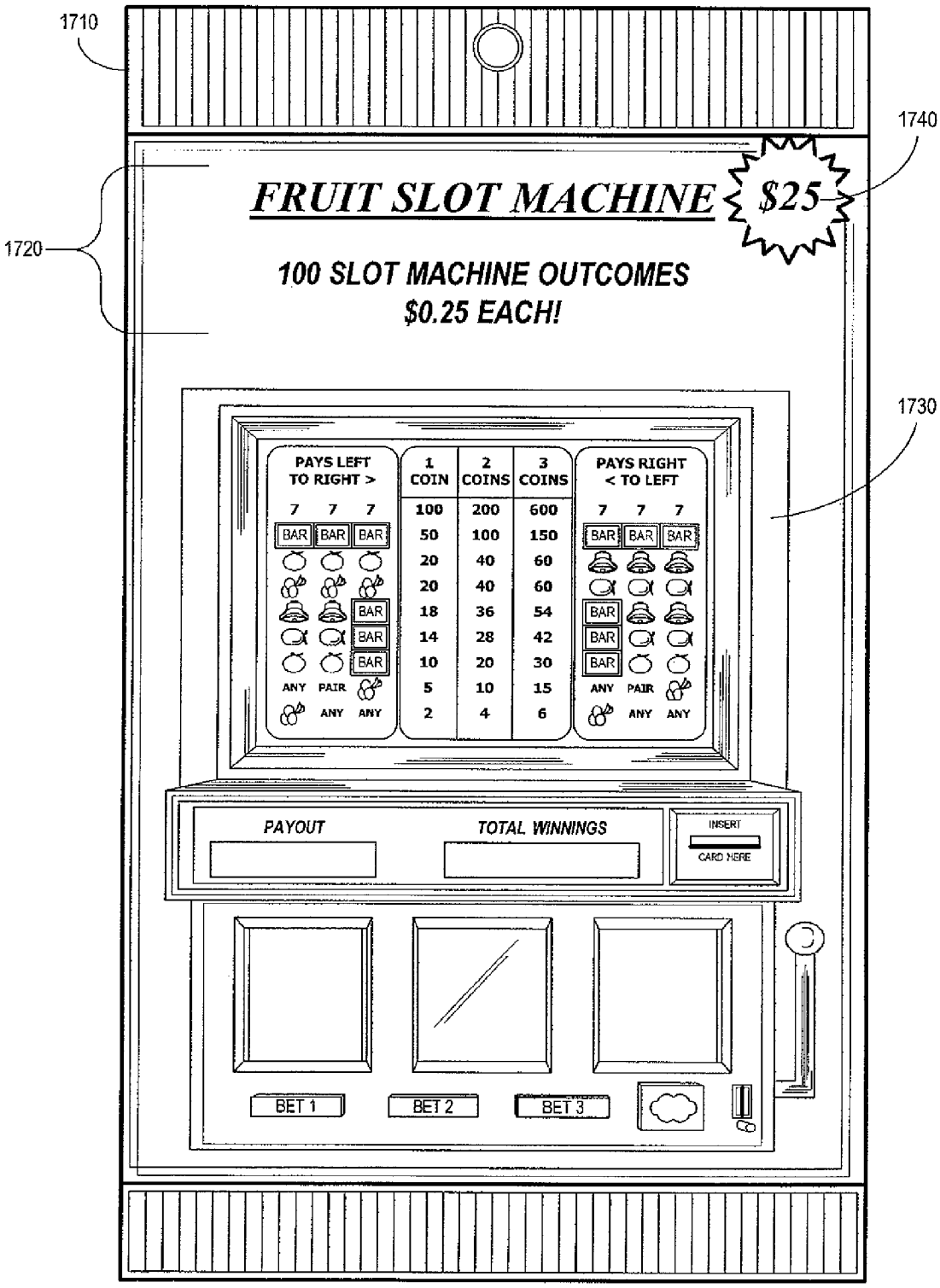
FIG. 17 is a diagram illustrating an example of the appearance of a package containing a slot book according to some embodiments of the present invention.

FIG. 17 illustrates a slot book as it may look when packaged 1710. The package includes a text description 1720, a graphic representing the slot machine that generated the outcomes contained in the book, and a price 1740.

Figure 18:
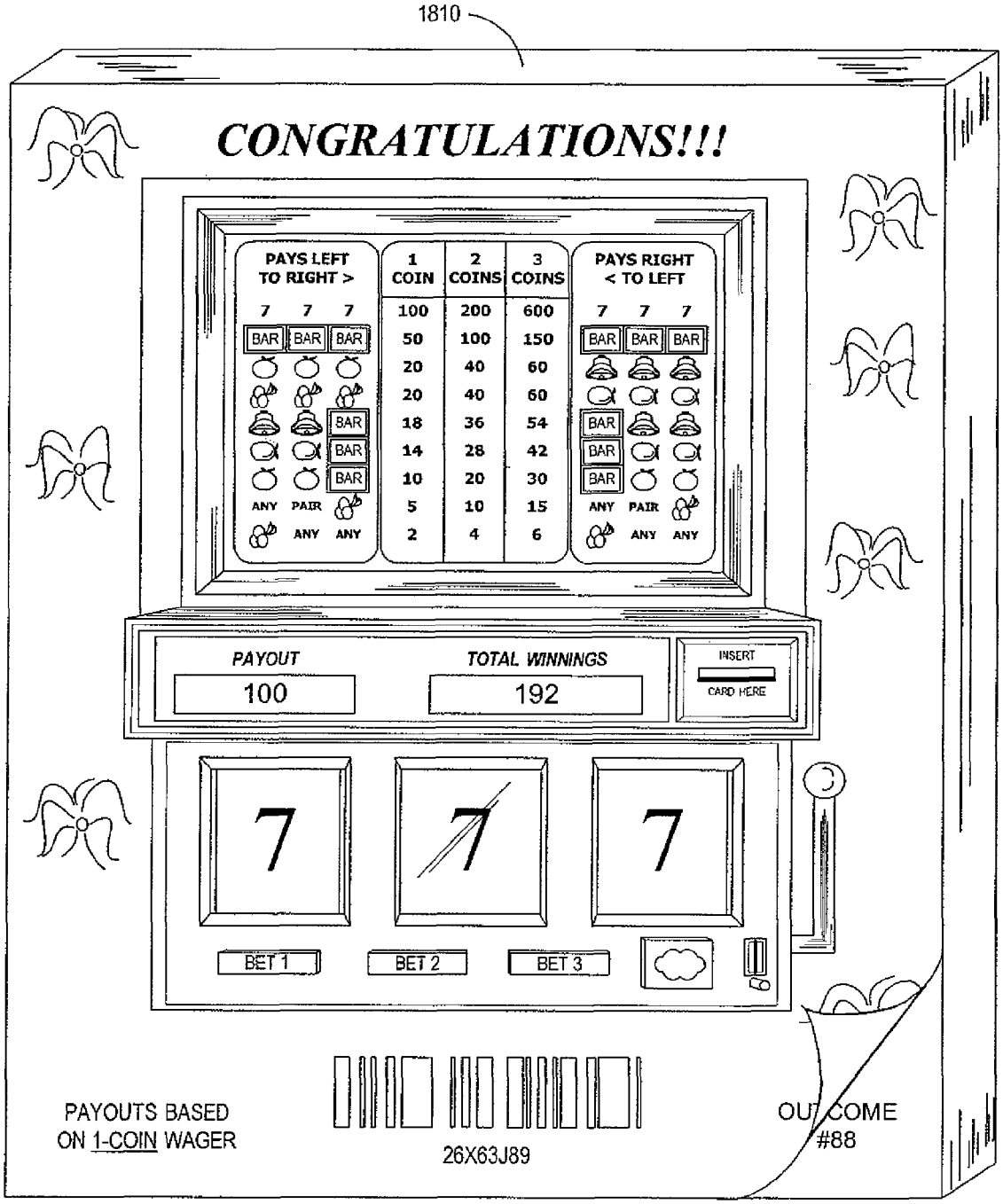
FIG. 18 is a diagram illustrating an example of the appearance of a slot book according to some embodiments of the present invention.

FIG. 18 illustrates an exemplary slot book 1810. Outcome leaf 1410 appears at the front of the slot book. However, it is clear in FIG. 18 that outcome leaf 1410 is part of a larger slot book, with succeeding outcome leaves to come. Presumably, outcome leaves one through eighty-seven have already been viewed and torn away by a consumer.

Figure 19:
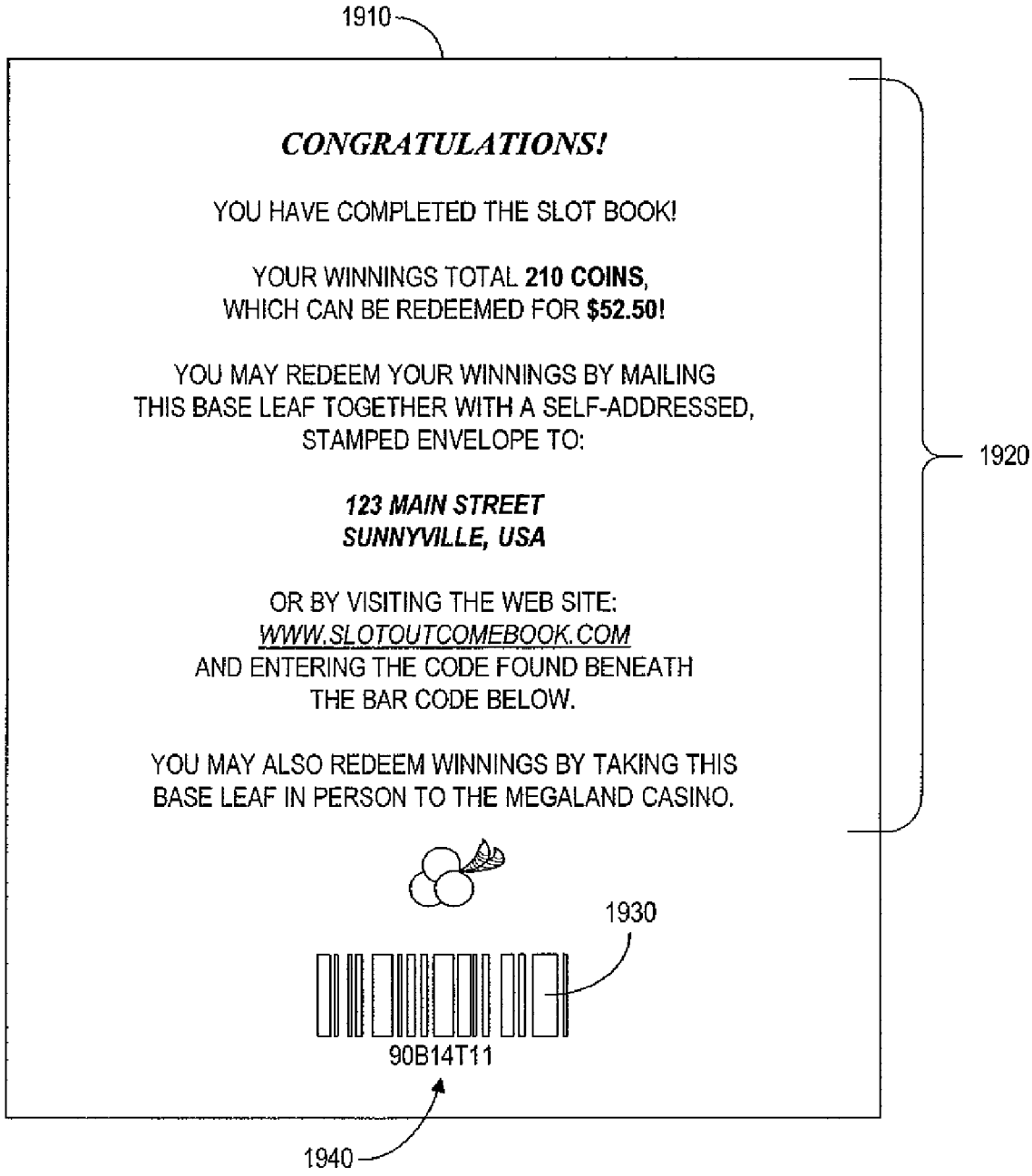
FIG. 19 is a diagram illustrating an example of the appearance of a base leaf of a slot book according to some embodiments of the present invention.

FIG. 19 illustrates an exemplary base leaf. The base leaf includes a message for the consumer 1920, which includes instructions on how to redeem the slot book. Bar code may allow the central server and/or redemption device to automatically identify the slot book and to determine the appropriate payment amount for the consumer. In some embodiments bar code 1930 and/or alphanumeric code 1940 encodes the payment amount itself.

Processes

The exemplary system discussed above, including the hardware components, software components, and the databases, are useful to perform various methods of the invention. However, it should be understood that not all of the above-described components and databases are necessary to perform any of the methods of the present invention. In fact, in some embodiments, none of the above-described system is required to practice the methods of the present invention. The system described above is merely an example of a system that would be useful in practicing some methods of the invention.

Figure 20:
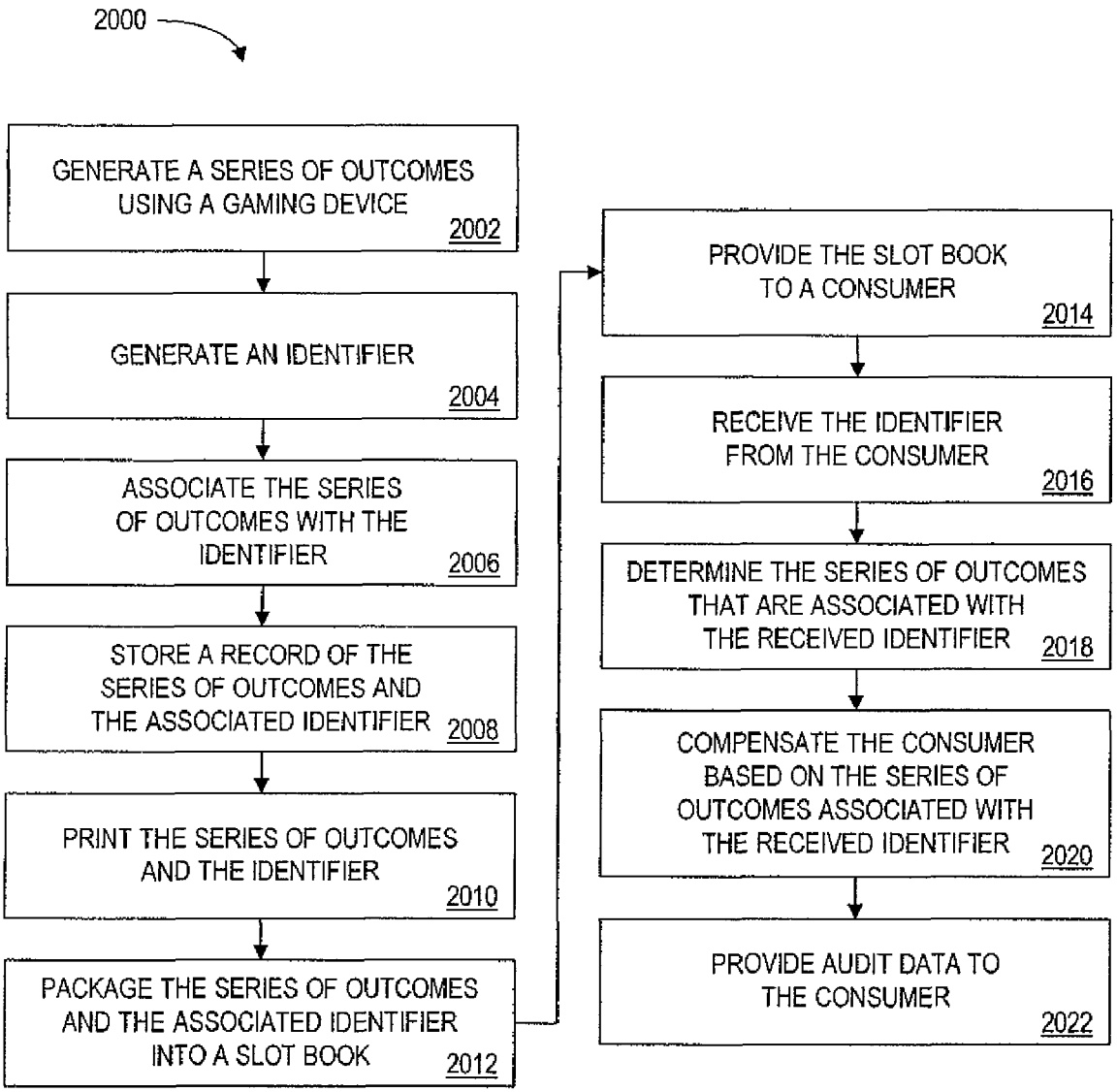
FIG. 20 is a flow diagram illustrating an exemplary process in accordance with some embodiments of the present invention.

Referring to FIG. 20, a flow chart 2000 is depicted that represents some embodiments of the present invention. Although the method 2000 is discussed as being performed by a slot machine, it will be understood in light of the present disclosure that the method may be performed by a controller 102, a gaming device 104, a peripheral device 210, a peripheral device server 216, and/or a casino. It must be understood that the particular arrangement of elements in the flow chart 2000 of FIG. 20, as well as the number and order of example steps of other various methods discussed herein, is not meant to imply a fixed order, sequence, quantity, and/or timing to the steps. Embodiments of the present invention can be practiced in any order, sequence, and/or timing that is practicable. Likewise, the labels used to reference the individual steps of the methods are not meant to imply a fixed order, sequence, quantity, and/or timing to the steps.

In general terms and still referring to FIG. 20, method steps of some embodiments of the present invention may be summarized as follows. In step 2002, a series of outcomes is generated using a gaming device. In step 2004, an identifier is generated. In step 2006, the series of outcomes is associated with the identifier. In step 2008, a record of the series of outcomes and the associated identifier is stored. In step 2010, the series of outcomes and the identifier is printed. In step 2012, the printed series of outcomes and the associated identifier are packaged into a slot book. In step 2014, the slot book is provided to a consumer. In step 2016, the identifier is received from the consumer. In step 2018, the series of outcomes associated with the identifier is determined. In step 2020, the consumer is compensated based on the series of outcomes associated with the received identifier. In step 2022, audit data is provided to the consumer. As indicated above, in some embodiments these steps may be performed in a different order, and more, fewer, and/or alternative steps may be used as well.

In the discussion that follows, each of these exemplary steps will be discussed in greater detail. Note that not all of these steps are required to perform the methods of the present invention and that additional and/or alternative steps are also discussed below. Also note that the above general steps represent features of only some of the embodiments of the present invention. Such steps may be combined and/or subdivided in any number of different ways so that methods of the present invention include more or fewer actual steps. For example, in some embodiments additional steps may be added to update and maintain the databases described above. As indicated, however, it is not necessary to use the above-described databases in all embodiments of the invention. In some embodiments, a described step may be performed by or with respect to any number of devices or entities. For example, a step may be subdivided into sub-steps, some of which are performed by one device, and some of which are performed by or otherwise involve a different device. In other words, the methods of the present invention may contain any number of steps performed by any number of entities that are practicable to implement the various different inventive processes described herein.

Step 2002: Generate a Series of Outcomes Using a Gaming Device

In some embodiments, the central server sends a signal to a gaming device to generate one or more outcomes. The gaming device may then generate outcomes according to any of a variety of well-known procedures for generating outcomes. For example, the gaming device may store in memory a database (not shown) associating various index numbers with outcome descriptors. The processor of the gaming device may execute a program to randomly generate one of the index numbers from the database. The processor may then determine the outcome descriptor corresponding to the randomly generated index number. The outcome descriptor becomes the outcome generated by the gaming device. This process may repeat until the gaming device has generated the required number of outcomes.

The central server may, in some embodiments, send signals to multiple gaming devices, telling each to generate one or more outcomes. The outcomes of each of the multiple gaming devices may subsequently be packaged together into a single slot book.

The series of outcomes generated by the gaming device (or multiple gaming devices) may comprise outcomes of multiple different denominations. For example, one third of the outcomes could have implied wagers of ten cents, one third could have implied wagers of twenty-five cents, and one third could have implied wagers of fifty cents. If there are three hundred outcomes in the series, then the sum of the implied wagers for the entire series would be: 10 cents×100+25 cents×100+50 cents×100=$85.00. Therefore, when the series of outcomes are subsequently packaged and sold, they might sell for $85.00. Even though two outcomes may be of different denominations, the outcomes may still be generated at the same gaming device. For example a gaming device might accept up to three coins wagered on a single pay line. A first outcome may be generated using a one-coin implied wager, while a second outcome might be generated using a two-coin implied wager. In this case, assuming the outcomes turn out to be the same set of indicia, the second outcome would typically pay twice what the first outcome pays.

In some embodiments, a single outcome might comprise multiple pay lines. For example, a single outcome might derive from fifteen indicia arranged in a rectangular grid of five horizontal indicia by three vertical indicia. The payout for the outcome would depend on the particular indicia that lie along each of nine pay lines, with a first pay line consisting of the second row of five horizontal indicia, a second pay line consisting of the first row of five horizontal indicia, a third pay line consisting of the third row of five horizontal indicia, and other pay lines consisting of more complicated arrangements of indicia.

In some embodiments, a single outcome might belong to more than one series. Therefore, the same outcome may appear in more than one slot book that is subsequently printed.

Display of Outcomes

It is common on current gaming devices to display outcomes whenever they are generated. For example, each time a gaming device generates an outcome, the gaming device may spin its reels, and cause the reels to stop so that the symbols corresponding to the generated outcome are visible to a player at the gaming device. Gaming devices of the present invention may likewise display outcomes. However, in many embodiments, there are not necessarily any players present to perceive the display of the outcomes.

One object of a gaming device displaying outcomes is that the display of the outcomes can be filmed. For example, a camera facing a gaming device may film the gaming device as it generates outcomes. The camera may transmit its video feed to the central server. The central server may then store the video feed in a database such as the audit database 280 of FIG. 11. An auditor, a regulator, a purchaser of outcomes, or any other interested party may subsequently consult the audit database to verify the fairness with which the outcomes were generated.

Another object of having the gaming device display the outcomes is for a monitor to verify that the gaming device is functioning properly. If the gaming device is owned by a casino, for example, then an employee of the casino may periodically walk by the gaming device to make sure that it is working properly. The employee can determine whether the gaming device is working by watching as new outcomes are displayed.

In embodiments where a gaming device is on the casino floor, the gaming device may not display outcomes as they are generated for the purposes of the present invention. In this way, no player on the casino floor will claim that he should be paid a prize for an outcome that was not generated on his behalf. In some embodiments, a gaming device on the casino floor does display outcomes even as they are generated for the purposes of this invention. However, the gaming device clearly indicates that the outcomes being generated are not for the benefit of any player physically present at the gaming device. The gaming device may indicate that its outcomes are not for any players physically in various ways.

The gaming device may display a text message on its display screen telling any passing players that these outcomes are not for them, or do not pay out, or are just demonstration outcomes. The gaming device may display a similar text message by, for example, backlighting pre-composed text built into the gaming device.

The gaming device may display a large "X" on the screen of the gaming device. The gaming device could also display a circle with a diagonal line or any other symbol commonly understood to mean "off limits."

The gaming device may change the background color of the display screen of the gaming device. The new background color may be understood by passing players to mean that outcomes generated on the gaming device are not for them.

The gaming device may display the outcomes in a smaller size, using different variants of symbol graphics (e.g. a graphic with three cherries in a bunch rather than two), or in different locations of the screen. Displaying the outcomes in any of these alternate fashions would let passing players know that the outcomes are not meant for them, while still allowing the display of the outcomes to be filmed for audit purposes.

Form of a Gaming Device

As described above, a gaming device may take on a simplified form. A simplified gaming device may include a means for recording audit information. Audit information may include text based records of outcomes generated by the gaming device (e.g. "cherry-bell-bar"), video clips of the gaming device as it generated and displayed outcomes, and a cumulative number of credits won as a result of the outcomes. For example, suppose that the simplified gaming device is generating a series of outcomes. The machine may record, for a particular outcome, that the outcome was generated for slot book SB789012, that the outcome is a 25-cent denomination outcome, that the outcome was generated at 3:39:27.596 pm, Dec. 18, 2004, and that the outcome generated was cherry-cherry-bell.

In some embodiments, the simplified gaming device records audit information on a tangible medium, such as a paper tape. The machine may therefore contain a printer, such as a laser printer or dot matrix printer, through which a paper tape is fed. Then, information about each outcome generated may be printed as a separate line on the tape. In another embodiment, audit information is recorded in a memory device, such as RAM, magnetic memory, or optical memory. In another embodiment, audit information is recorded at the central server. Therefore, the simplified gaming device may transmit any audit information, such as the outcome generated, the time of generation, and so on, to the central server. The central server may then store the audit information in the database of FIG. 11.

The simplified gaming device may further include a camera. The camera may be situated to film the display area of the machine. The camera may then transmit a feed of the display area to the central server, which may in turn store the feed in the audit database of FIG. 11. A player subsequently viewing the feed from the camera may therefore watch the simplified gaming device as it generated the outcomes that appear in his slot book. The player may thereby feel confident that outcomes contained in his slot book do in fact correspond to outcomes generated by the simplified gaming device.

Times When a Gaming Device May Generate Outcomes

In embodiments where the gaming device is on the casino floor, the gaming device may generate outcomes at times during which the gaming device is not in use by players. In one embodiment, the gaming device may generate outcomes at times when usage of the gaming device by players is historically low. For example, the gaming device may generate outcomes between 3:00 AM and 6:00 AM, when few players are expected on a casino floor. In another embodiment, the gaming device may generate outcomes at any time, so long as it is not currently in use. For example, when a player finishes play at a gaming device, the gaming device may wait a predetermined amount of time for another player to begin play. If such time elapses without the appearance of a new player, the gaming device may begin to generate outcomes for the present invention. In some embodiments, a gaming device may generate outcomes during pauses in play. For example, if a player at the gaming device does not initiate a new handle pull within a predetermined time period, the gaming device may begin generating outcomes for the present invention. A gaming device may even generate outcomes for the present invention while a player is playing. Since the processor of the gaming device may be capable of generating outcomes much more rapidly than a player is capable of initiating their generation, or of assimilating them, the processor may generate outcomes both for a player and for the present invention, without the player necessarily even noticing.

As mentioned, a gaming device may be capable of generating outcomes very rapidly, and may do so for the present invention. In one embodiment, a gaming device must generate and display outcomes rapidly, but in such a way that a camera is able to film their display. Thus, for example, it would be undesirable for a gaming device to generate and display outcomes at a rate of one hundred twenty per second when a camera filming the gaming device can only capture images at the rate of sixty frames per second. Therefore, in some embodiments, a gaming device may be synchronized to a camera so that outcomes are displayed at or beneath the frame capture rate. If the gaming device generates outcomes more rapidly than the frame capture rate, then the gaming device may display multiple outcomes to be captured in a single frame. For example, the gaming device generates outcomes at one hundred twenty per second, but displays sixty groups of two outcomes per second, so that each frame captured by the camera will show two outcomes.

Step 2004: Generate an Identifier

The central server or a gaming device may generate an identifier used to track one or more outcomes. The identifier contains information and may be stored, for example, as a sequence of bits in an outcome database such as that of FIG. 9, or a slot book database such as that of FIG. 10. The identifier may later take a printed or physical form, such as a barcode or sequence of alphanumeric characters. The identifier may contain any one or more of the various pieces of information.

The identifier used to track one or more outcomes may include an identifier or a description of the gaming device at which an associated outcome or set of outcomes was generated.

The identifier used to track one or more outcomes may include the time at which an associated outcome was generated, or the time period during which an associated set of outcomes were generated.

The identifier used to track one or more outcomes may include a description of an associated outcome. For example the identifier indicates that the associated outcome is "barbell-plum." If the identifier is associated with a set of outcomes, then the identifier may describe each of the outcomes.

The identifier used to track one or more outcomes may include the payout of an associated outcome, or the total payout of an associated set of outcomes. For example, if an identifier is associated with five outcomes, and the outcomes paid five, two, zero, zero, and six cents, respectively, then the identifier may contain the number "13", indicating a total payout of thirteen for the five outcomes. The identifier may also contain information about a net payout. For example, if an outcome initially deducts one credit from the player's credit balance, as if to charge for making a handle pull, and the outcome pays nine cents, then the net payout for the outcome is eight cents. The net payout for outcomes paying five, two, zero, zero, and six cents might be eight cents, since five cents have been deducted for the five outcomes, and thirteen cents have been added in payouts.

The identifier used to track one or more outcomes may include a running balance of winnings associated with the outcome. For example, if the outcome is to be the $10^{th}$ outcome in a slot book, and the outcome brings the cumulative winnings for the slot book to thirty-five coins, then the identifier may incorporate the number thirty-five.

The identifier used to track one or more outcomes may include an identifier of (e.g., a name of) the consumer to whom the outcome has been provided. For example, a consumer requests to purchase a slot book before the slot book has been generated. The slot book may then be generated to include an identifier containing information about the consumer. For example, the identifier may incorporate the consumer's name or birthday.

The identifier used to track one or more outcomes may include the time at which an outcome or a set of outcomes were packaged into a slot book.

The identifier used to track one or more outcomes may include the time at which an outcome or a set of outcomes were sold.

The identifier used to track one or more outcomes may include the denomination of the outcome.

In some embodiments, the identifier contains no information about a corresponding outcome, or series of outcomes. Rather the identifier is linked to the outcome(s) in a database record such as those in the outcome database 260 of FIG. 9 or slot book database 270 of FIG. 10. Using the outcome database, the central server may receive an identifier and determine any desired information about corresponding outcome(s).

Step 2006: Associate the Series of Outcomes with the Identifier

Once an identifier has been generated, the central server may associate the identifier with one or more outcomes. In one embodiment, an identifier is associated with a group of outcomes that are sold together as part of a slot book. In another embodiment, an identifier is associated with a single outcome. In still another embodiment, an identifier is associated with an intermediate number of outcomes. For example, a slot book might consist of ten groups of 50 outcomes. A single identifier might be associated with a group of 50 outcomes. As mentioned previously, an identifier may or may not contain information about associated outcomes.

Step 2008: Store a Record of the Series of Outcomes and the Associated Identifier In one embodiment, the central server associates an identifier with one or more outcomes by creating a record in the outcome database 260 of FIG. 9, where the record contains both the identifier and the outcome. If the identifier is associated with all of the outcomes in a slot book, then the central server may create a record in the slot book database 270 of FIG. 10, where the record contains both the identifier and information about the corresponding slot book.

Step 2010: Print the Series of Outcomes and the Identifier

Once one or more gaming devices have generated a series of outcomes, and the central server has generated an associated identifier, the central server may direct the printing device (FIG. 4) to print the series of outcomes together with the associated identifier. If there is an identifier associated with each outcome individually, then these identifiers may also be printed. Similarly, if there is an identifier associated with a group of outcomes that is less than all of the outcomes in the slot book, then such an identifier may also be printed.

Each outcome may be printed on a sheet of thin paper, or on some other substrate, such as plastic. The substrate containing the outcome will be termed an "outcome leaf." The outcome leaf may include various features.

The outcome leaf may include graphical depictions of the symbols that make up the outcome. For example, the outcome leaf may contain graphics depicting three cherry symbols.

The outcome leaf may include a picture of the gaming device on which the outcome was generated. The picture may be of the gaming device at the actual time during which the current outcome was displayed. In this case, graphical depictions of the symbols of the outcome need not necessarily be displayed.

The outcome leaf may include an identifier of the gaming device on which the outcome was generated. For example, "gaming device G8415679," or "the fifth slot machine in row 10 of the Crescent Moon Casino."

The outcome leaf may include a cartoon or graphical depiction of the gaming device on which the outcome was generated.

The outcome leaf may include the payout of the outcome. For example, "10 cents," or "$3."

The outcome leaf may include the payout ratio of the outcome.

For example, "10 times the wager."

The outcome leaf may include the casino in which the outcome was generated.

The outcome leaf may include the location where the outcome was generated. For example, "Las Vegas, Nev."

The outcome leaf may include a pay table for the gaming device on which the outcome was generated.

The outcome leaf may include the date and/or time when the outcome was generated.

The outcome leaf may include the cumulative payout for all of the outcomes in the slot book (or other group of outcomes) up until the present outcome. For example, if a consumer is viewing the $10^{th}$ outcome in the slot book, and the payouts for the prior nine outcomes in the slot book have totaled $3, then the $10^{th}$ outcome leaf may show $3. The cumulative payout may or may not include the payout for the current outcome, in this case, the $10^{th}$ outcome. In some embodiments, two cumulative payouts are shown, one including the current outcome, and one not including the current outcome.

The outcome leaf may include other statistics for the present slot book, or for the gaming device that generated the outcomes of the present slot book. Statistics might include: the number of outcomes that have occurred in the slot book since the last outcome with a payout of twenty or more coins; the number of outcomes generated by the gaming device since it generated a jackpot-winning outcome; the current number of consecutive outcomes in which there were initially four cards to a flush, but no flush was achieved; the payback percentage for the last twenty outcomes; and so on. For example, suppose an outcome leaf shows a hand of video poker where a flush was attempted but not achieved. The outcome leaf might contain printed text saying, "This is the third consecutive time you have drawn to a flush but missed. Don't lose heart, things are bound to turn around."

The outcome leaf may include the strategy used to generate the present outcome. For example, the outcome may be from a video poker device. The outcome leaf may therefore show the original hand dealt, the cards that were held, and then the final hand that was dealt. Alternatively, the strategy may be described in text. For example, "optimal strategy" was used, or "a strategy that maximizes the likelihood of hitting a royal flush" was used.

The outcome leaf may include a film or coating that obscures one or more features of the outcome leaf. The consumer may be required to scrape off or peel off the coating in order to see, for example, the outcome, the payout, or the cumulative payout for all the outcomes thus far. The act of scratching off or peeling off the coating to reveal the outcome may create a sense of excitement for the player.

The outcome leaf may include background graphics. For example, the outcome leaf may show fireworks, an ocean scene, a scene from ancient Egypt, etc. The scene may be in keeping with the theme of the slot machine on which the outcome was generated. For example, if the theme of the slot machine is lost treasure, then the scene may depict a sunken pirate ship.

The outcome leaf may include the name of the consumer who purchased the outcome or the slot book that contained the outcome. In this case, the outcome may have been printed after the consumer had broadcast his intention to purchase the outcome.

The outcome leaf may include a page number.

The outcome leaf may include an outcome number. For example, each of one hundred outcomes in a slot book is numbered sequentially from one to one hundred. A consumer who is viewing the outcomes of the slot book will thereby always be aware of how many outcomes he has seen, or how many are remaining. The consumer may wish to go through the outcomes more slowly as he nears the end of the book, so as to draw out the experience.

The outcome leaf may include instructions for redeeming the outcome. For example, instructions might tell a consumer where to mail an outcome leaf (or a base leaf), or where to bring the leaf to redeem it in person.

Information about a bonus outcome or bonus round. For example, an outcome leaf might say, "Congratulations, you have made it into a bonus round." The following outcome leaf or leaves may then display one or more bonus outcomes. An outcome leaf might also describe how a bonus round works. For example, the outcome leaf might describe how the consumer must scratch three obscured regions of the outcome leaf in order to reveal his bonus outcome.

The outcome leaf may include information explaining an outcome. For example, "outcomes pay left to right" or "you need at least two like symbols for a payout" or "you needed just one more diamond and you would have won one thousand coins."

Note that a single outcome leaf may contain multiple outcomes. For example, a first outcome may be printed on one side of the leaf, and a second outcome might be printed on the backside of the leaf. In fact, any of the above information may be printed on either or both sides of an outcome leaf.

In some embodiments, a single outcome leaf may not reveal a final outcome, i.e. an outcome that determines a payout. Rather, the outcome leaf may reveal a partial outcome. For example, a first outcome leaf shows the first reel of a slot machine stopped at the symbol "orange," while the other two reels are shown blurred, as if they are still spinning. The next outcome leaf shows the first and second reels of the slot machine stopped at the symbols "orange" and "orange," while the third reel is still blurred. Finally, the third outcome leaf shows all three reels stopped, revealing the outcome of "orange-orange-orange." The third outcome leaf may show a payout associated with the outcome, whereas the first and second outcome leaves may show no payout. When each outcome leaf only reveals one new reel, the player can build anticipation towards a potentially high-paying outcome by slowly viewing only one outcome leaf, and therefore one reel, at a time. The experience may be akin to the experience a consumer would have at an actual slot machine, watching one reel stop at a time.

In another example, an initial hand of video poker is revealed on a first outcome leaf. A second outcome leaf shows the final outcome of the video poker game, after cards have been discarded from the initial hand and replaced with new cards. The first outcome leaf may indicate which cards from the initial hand will be discarded, so that the player knows what to expect for the second outcome leaf. In a video poker embodiment, more than two leaves might be used to reveal a final outcome. For example, one leaf may be used for each new card that is dealt to a player. Thus, a first leaf shows only the first card dealt to a player, a second leaf shows the first two cards dealt to a player, and a fifth leaf shows a player's initial hand. Subsequent leaves may show, one by one, replacement cards that are dealt to the player.

In another example, a first leaf may show a first view of a Battleship grid, and a second leaf may show the same grid with a few missile hits revealed. In yet another example, a first outcome leaf shows a hand of blackjack, and a second leaf shows the hand of blackjack after one or more additional "hit" cards have been dealt.

The outcome leaf may also include an identifier. The identifier may take various forms.

The identifier may take the form of a printed bar code.

The identifier may take the form of a series of alphanumeric characters, such as "XQ9356F2".

The identifier may take the form of any series of characters.

The identifier may take the form of a magnetic strip. For example, the printing device may deposit a layer of magnetic material on the substrate of the outcome leaf. Alternatively, the substrate may be manufactured with a magnetic strip that can be altered by the printing device to magnetically encode the identifier.

The identifier may take the form of a series of perforations in the outcome leaf. The series of perforations may constitute, for example, Braille characters, or any machine-readable codes, such as those contained in punch cards.

The identifier may take the form of a radio tag affixed to, or embedded within the outcome leaf material. The radio tag may, when scanned, emit a sequence of electromagnetic pulses corresponding to an identifier.

There are many other possible forms that the identifier may take, as will be understood by one of skill in the art.

In printing the outcomes, the printing device may access stored databases such as the symbol graphics database of FIG. 12, and the background graphics database of FIG. 13. For example, when the printing device must print an orange symbol on an outcome leaf, the printing device may look up the orange symbol in the symbol graphic database, and retrieve a file with graphic data describing an orange symbol. The printing device may then print the orange symbol as dictated by the graphic file. Similarly, when the printing device must print background graphics on an outcome leaf, the printing device might retrieve and refer to a background graphic data file from the background graphic database of FIG. 13.

Marketing Promotions

In some embodiments, an outcome leaf may contain marketing promotions. Marketing promotions may originate with the casino that provided the outcomes, or with third-party merchants. Marketing promotions may be designed to make a sale to the consumer, or to acquire the consumer's business at a later time. Where a third-party merchant is the originator of a marketing promotion, the third-party merchant may pay the casino to incorporate its promotions. For example, a detergent manufacturer may pay the casino one cent for every ten outcome leaves on which a picture of its detergent is printed.

One type of marketing promotion is, as mentioned above, an advertisement. An advertisement may comprise a printed picture of a product, a company logo or trademark, a company representative or celebrity spokesperson, a problematic situation that would be solved using a company's product or service, company colors, etc. In some embodiments, an advertisement may span more than one outcome leaf. For example, a first outcome leaf shows an expensive shirt with a tomato stain in it. A second outcome leaf shows a second picture of a detergent bottle. A third outcome leaf then shows the same expensive shirt, but with the stain removed. In some embodiments, an advertisement may span multiple outcome leaves, where each outcome leaf contains a still frame of an animation for the advertisement. By leafing through the outcome leaves rapidly, a player gets to see the advertisement as if it is an animated sequence of frames. An advertisement may also contain text. For example, the text may describe the company's product, its price, where it can be bought, and so on.

In some embodiments, a third-party merchant may arrange for its advertisements to be placed only on outcome leaves depicting outcomes meeting predetermined criteria. For example, a company's advertisements will only appear on outcome leaves where the outcome is a winning outcome. In this way, a player may come to associate a particular company with good fortune, and may be more inclined to do business with that company. In some embodiments, a company with expensive products, or with non-essential products may have its advertisements placed only on relatively high paying outcomes. For example, a producer of fine chocolates may only advertise on outcomes paying $10 or more. The company hopes that, having achieved a high paying outcome, the consumer will be more likely to indulge himself in the company's products. In other exemplary embodiments, companies tie their advertisements in with the outcome in some way. For example, if an outcome pays $7.11, then the company 7-11 may place an advertisement on the same outcome leaf. If an outcome consists of three cherries, then Coca-Cola may advertise its Cherry Coke drink.

Another type of marketing promotion may take the form of a coupon or other promise of a discount. An outcome leaf may contain various markings indicative of a coupon, including the name of a merchant, an amount of any discount offered, and any terms and conditions, such as, "one per customer." A consumer may then be able to use the outcome leaf as if it were an actual paper coupon. In some embodiments, coupon promotions are printed on all outcome leaves with payouts of less than a predetermined threshold. In this way, each outcome leaf provides at least some reward to a player, whether the reward comes in the form of a payout, or whether the reward comes in the form of a discount. By guaranteeing that all low-paying outcome leaves can also be used as coupons, the casino would be able to guarantee, in some embodiments, that a player receives a value from a slot book that is greater than the amount he pays for the slot book. Of course, not every losing outcome leaf need contain a coupon for a player to realize more value from his slot book than the amount he paid for it. Conceivably, even one coupon could provide a discount of a magnitude larger than the price of the slot book.

Another type of marketing promotion seeks to bind the consumer into a forward commitment, in return for which the consumer may receive an immediate benefit. A forward commitment may be defined as an agreement to one or more of the following: purchase, use, lend, borrow, sell, lease, and/or license a product or service; perform work; provide an opinion; make a donation or contribution; answer a question. A forward commitment does not include paying off a debt. Thus, for example, making a purchase with a credit card does not enter someone into paying off the forward commitment in the future. A forward commitment exists in the abstract even when no one has agreed to be bound by the commitment. A person may subsequently enter into the forward commitment. After satisfying the terms of a forward commitment, a person has fulfilled the commitment. There are many variations of forward commitments.

A forward commitment might commit a single person to perform a task, a single person to perform multiple tasks, multiple people to perform individual tasks, multiple people to perform a single cooperative task, or a subset of a group of people to perform individual or group tasks.

A forward commitment might commit a person to perform a task on a periodic basis, within a certain time period, or conditionally based upon a random or non-random event or outcome.

A forward commitment might be defined by the person fulfilling the forward commitment, by a merchant or other party benefiting from the fulfillment of the forward commitment, or by a third party.

A forward commitment might commit one or more people to fulfilling a subset of a group of tasks, with the particular tasks identified only after the person has entered into the forward commitment.

A forward commitment might require the fulfillment of various milestones. If a person fails to meet a milestone, then the forward commitment has not been fulfilled. However, meeting a milestone does not necessarily mean the commitment has been fulfilled.

A forward commitment might have transfer or buyout provisions in the event that the person or group bound by the forward commitment is unable or unwilling to fulfill it.

Examples of forward commitments include commitments to: (i) gamble a certain amount of money; (ii) go to a casino show; (iii) stay overnight at a casino; (iv) visit a casino in the future; (v) bring a friend to a casino; (vi) gamble at a particular machine; (vii) gamble at a chosen plurality of machines (e.g. so as to become acquainted with them); (viii) eat at Joe's Pasta House on Oct. 6, 2003, and to spend at least $25; (ix) fly from JFK airport in New York to O'Hare airport in Chicago using United Airlines, the flight occurring in the next 60 days; (x) buy 10 gallons of gasoline weekly from a Mobil station for the next 12 weeks; (xi) open a checking account with Fleet bank within the next 15 days; (xii) play at a slot machine for another hour; (xiii) have a consultation with a life-insurance agent; (xiv) test drive a new car; (xv) limit cereal purchases to Quaker cereals for the next six months; and (xvi) sign up for a Chase credit card and to transfer $1000 in existing balances to the new card.

In some embodiments, a consumer may enter into a forward commitment by signing his name on a special line on an outcome leaf, and turning the outcome leaf into a casino desk, or by mailing the outcome leaf to the casino or to a merchant, such as the merchant to whom the commitment binds the consumer. In another embodiment, the consumer may enter into the forward commitment by calling a telephone number provided on the outcome leaf and providing his agreement either verbally or by entering a designated number into the key pad of his telephone. The designated number may be the identifier of the outcome leaf that offered the forward commitment, or it may be some other number provided on the outcome leaf. The merchant may recognize the outcome identifier as corresponding to a forward commitment agreement. The merchant may also check with the casino to determine the identity of the consumer to whom the outcome was sold, so as to determine the consumer who is now bound into the forward commitment. Alternatively, the consumer may speak or key his name into the phone he uses to dial the merchant, so that the merchant knows the identity of the consumer when the consumer enters into the forward commitment.

In some embodiments, there may be a limit to the number of promotions that are included within a particular slot book, or within any series of outcomes. This limit may apply to the promotions of a particular company, to the promotions of companies falling within a particular category, to promotions falling within a particular category, or to promotions in general. For example, a particular company might wish for only one of its promotions to occur within any given slot book. In this way, the company does not need to pay for multiple promotions, all of which are to be viewed by the same consumer. If a promotion is a discount, then the company may avoid providing multiple discounts to the same consumer by limiting the number of its promotions that are contained within a particular slot book. In another example, there is a limit of one car-related promotion per slot book. In this way, a first car manufacturer need not worry that it is competing with a second car manufacturer for the consumer's attention. In yet another example, there is a limit on the number of promotions involving forward commitments made by the consumer. In this way, a consumer who does not wish to be bound by too many forward commitments will not have to dismiss too many of the promotions. In still another example, there is a limit of five promotions per slot book so that, for example, a consumer does not feel bombarded by advertisements.

Size and Shape

The paper or substrate on which an outcome is printed may come in a number of sizes and shapes. In one embodiment, an outcome leaf is flat, rectangular in shape, and designed to fit in the palm of a typical person's hand. Thus, an outcome leaf may measure, for example, from two to four inches on a side. In one embodiment, the lengths of adjacent sides of an outcome leaf are in the proportion approximating that of the golden ratio, i.e. about 1.6:1. Thus, an outcome leaf might measure 4 inches on one side and 2.5 inches on an adjacent side. Rectangles whose side lengths are in the golden ratio have been found to be visually pleasing.

In the third dimension, outcome leaves are, in many embodiments, very thin. Outcome leaves may have the thickness of a typical sheet of paper. For example, an outcome leaf may be approximately four thousandths of an inch thick. However, outcome leaves may also be much thinner, e.g. one thousandth of an inch. In this way, five hundred outcomes leaves could fit in a slot book ½ inch thick.

An outcome leaf may comprise one or more transparent or partially transparent layers. The layers may be attached together only over a fraction of the surface area of the layers. For example, layers are only attached to one another at their top edges. In this way, one layer of an outcome leaf may be flipped back to reveal the layer underneath. In one embodiment, partially transparent layers allow a player to view the indicia of an outcome one at a time. In an example of this embodiment, a first non-transparent layer displays all three indicia of an outcome. A second partially transparent layer is situated above the first layer. The second layer obscures one of the indicia of the first layer, but allows the other two indicia to shine through. The second layer may obscure an indicium of the first layer with an opaque picture of a blurred spinning reel. A third partially transparent layer is situated above the second layer. The third layer obscures a second one of the indicia from the first layer, so that now only one indicium of the outcome is visible through the second and third layers. The third layer may similarly obscure an indicium from the first layer with a picture of a blurred spinning reel. A consumer perusing the outcome of this example would first see a single indicium from the first layer, together with a picture of a blurred spinning reel from the second layer, and a picture of a blurred spinning reel from the third layer. After flipping back the third layer, the consumer would now see two indicia from the first layer, together with a picture of a blurred spinning reel from the second layer. After flipping back the second layer, the consumer would finally see all of the indicia of the outcome contained on the first layer. By examining outcome leaves in this manner, a consumer may experience an outcome as he would at an actual slot machine, watching one spinning reel resolve at a time until all indicia of the final outcome were visible.

FIG. 14 illustrates an exemplary front side of an outcome leaf 1410. The illustration depicts an outcome leaf with a bar code identifier 1420 and a corresponding alpha-numerical identifier 1430 beneath the bar code, the gaming device 1450 on which the outcome of the outcome leaf was generated, the outcome 1460 itself as it is displayed by the gaming device, the payout 1465 associated with the outcome, the total winnings 1490 for the slot book thus far, and an outcome number 1440 representing the outcome's place within the slot book. The outcome leaf also has the word "Congratulations!!!" 1485 in the background, together with fireworks 1490 in the background, as the outcome happens to be a winning outcome.

FIG. 15 illustrates an exemplary backside of an outcome leaf 1510. The depiction of the back side includes text instructions for redeeming the outcome, various rules applying to redemption, the time and date during which the outcome displayed on the front side was generated, and the machine identifier for the gaming device on which the outcome was generated.

FIG. 16 illustrates an exemplary outcome leaf 1610 that doubles as a coupon for Glacier Yogurt. Although the illustrated outcome is a losing outcome (the payout meter reads "0"), the consumer is somewhat compensated by the ability to receive twenty-five cents off a carton of Glacier Yogurt using the outcome leaf.

The printing device may be a high volume printer. The printing device may employ, for example, printing plates containing standard background text and images for outcome leaves. Once the printing device prints a standard background for an outcome leaf, the printing device may overlay text or images particular to the outcome leaf. For example, a standard background might be an image of a slot machine, while images particular to an individual outcome leaf might include images of the indicia comprising an outcome.

The printing device and the gaming device may be combined. For example, the processor of the printing device may generate outcomes such as the outcomes of a reel slot game, or the outcomes of a video poker game. The printing device may then print the outcomes generated by the processor. The printing device and the packaging device may also be combined.

Step 2012: Package the Series of Outcomes and the Associated Identifier into a Slot Book Once printed, outcome leaves may be grouped together to form a slot book. A slot book may contain any number of outcome leaves. A typical slot book might consist of fifty, one hundred, two hundred, two hundred fifty, five hundred, or one thousand outcome leaves. A typical slot book might also consist of fifty, one hundred, two hundred, two hundred fifty, five hundred, or one thousand outcomes, even in cases where there is not a one-to-one correspondence between outcomes and outcome leaves.

In one embodiment, outcome leaves in a slot book each have an outcome displayed on one side, and all of the outcomes are facing in the same direction.

In one embodiment, outcome leaves are stuck to one another via a sticky substance. For example, a band of glue running across the front of a first outcome leaf attaches the first outcome leaf to the back of a second outcome leaf. In one embodiment, one face of an outcome leaf may be only partially covered with a sticky substance. The remaining portion of the outcome leaf may be allowed to swing or hang freely. A consumer would be able to grasp the free portion of the outcome leaf, pull, and thereby separate the outcome leaf from another outcome leaf to which it is attached.

In another embodiment, outcome leaves are bound together. A consumer might view outcome leaves by flipping from one outcome leaf to another, much like turning the pages of a book, or flipping the months of a calendar. In some embodiments, an outcome leaf contains a perforated line across its face. The perforated line might separate the major portion of the outcome leaf from the edge that is bound to the other outcomes. A player might be able to separate the major portion of an outcome leaf from the other outcome leaves by breaking the outcome leaf along the perforated line.

Outcome leaves may also be stapled, held together with binder clips, paper clips, rubber bands, or held together with rings, such as those in a loose-leaf notebook. Outcomes leaves may also be attached end-to-end, much as raffle tickets are held together in large rolls.

In one embodiment, the outcome leaves are not attached to one another at all.

The Base Leaf

In some embodiments, a slot book contains an extra leaf that does not contain an outcome (although it may). This extra leaf will be termed the "base leaf." The base leaf may be attached to the hindmost outcome leaf. The base leaf may have a number of distinguishing characteristics when compared to an outcome leaf.

The base leaf may be made from cardboard, plastic, thick paper, or any material of a sturdier nature than the material of which the other outcome leaves are composed. The base leaf, being made of a sturdier material, may anchor the slot book so that the book as a whole is not as flimsy as it otherwise would be. In addition, the base leaf may be resistant to elements of heat, rain, bright light, pressure, and so on. The base leaf may be especially durable since it may be required of a consumer who wishes to receive the payout associated with his slot book. In some embodiments, a base leaf is the only thing that is required of a consumer to receive a payout associated with his slot book.

The base leaf may contain printed summary statistics for the entire slot book. For example, the base leaf may contain the number of outcomes, the cumulative winnings of the slot book, the total number of winning outcomes, and the highest paying outcome.

The base leaf may contain encoded or encrypted summary statistics. For example, the base leaf may contain an encrypted statistic of the cumulative winnings for the slot book. It would likely be more difficult for a dishonest consumer to forge both encrypted and plaintext versions of summary statistics than it would be for such a consumer to forge plaintext summary statistics alone. Encoded or encrypted summary statistics may take the form of a bar code or other machine-readable code. The redemption device might thereby be able to easily read the summary statistics from the base leaf.

The base leaf may contain a printed list of all the outcomes in the slot book. The outcomes may be printed in text form, e.g. "cherry-lemon-bell," or even abbreviated as "clb".

The base leaf may contain redemption instructions. For example the base leaf may contain a printed mailing address, together with instructions to mail the base leaf to the given address in order to receive a payout associated with the slot book.

The base leaf may contain a computer memory chip, a radio transmitter, a magnetic strip, or any other communication or storage medium. The storage medium may contain any of the information described above, including summary statistics. The redemption device may later interface with the communication or storage media contained on the base leaf in order to retrieve information contained in the base leaf.

The base leaf may contain a link to a Web site where a consumer might view electronic renditions of the outcomes contained in the slot book from which the base leaf came. Viewing an electronic rendition of outcomes might allow the consumer to experience the outcomes in a more dynamic and exciting fashion, in that the consumer can watch animations of spinning reels followed by the resolution of an outcome, versus seeing a static image of the outcome on paper.

A base leaf may, in addition, include any of the information or features that an outcome leaf would. In some embodiments, a base leaf contains a bonus outcome. For example, the outcome contained on the base leaf may be a higher denomination outcome than those on the outcome leaves. The outcomes on outcome leaves may pay in multiples of an implied five-cent wager, while a base leaf might pay in multiples of an implied 25-cent wager. A base leaf might contain a multiplier. For example, if the cumulative winnings for all the outcome leaves is $4, and the base leaf contains a "2×" multiplier, then the slot book as a whole may pay $8. A base leaf may contain a simulated bonus round. For example, a base leaf may contain an illustration of a hermit crab choosing one of a possible three shells to inhabit. Each shell may have an associated bonus payout, and the player therefore receives the payout associated with the shell chosen by the hermit crab.

In some embodiments, a base leaf occurs in front of all the outcome leaves. In this case, some information contained on the base leaf may only be displayed in encrypted or encoded form. In this way, for example, the cumulative winnings for the entire slot book are not revealed to the player before the player has had the enjoyment of viewing all of the outcomes on his own. In some embodiments, a slot book contains two base leaves, one in front, and one in back. In some embodiments, a slot book may contain multiple base leaves. Some of these leaves may, for example, separate different groups of outcomes, such as groups of 20 outcomes. All base leaves need not be identical. For example, base leaves falling between outcomes may serve only as separators or supporting structures, and may contain no printed information.

FIG. 19 illustrates an exemplary base leaf 1910. In addition to some of the aforementioned information, the illustrated base leaf contains an indicium (e.g., a cherry symbol) for aesthetic purposes.

The Wrapper

The outcomes of a slot book may be wrapped with a paper material, metallic material, or other material or combination of materials. The method of wrapping may be similar to that used for baseball cards or other collectible cards well known in the art. The wrapper may contain a number of types of printed information.

Printed information may include the number of outcomes in the enclosed slot book.

Printed information may include the number of outcome leaves in the enclosed slot book.

Printed information may include the denomination of the outcomes in the enclosed slot book.

Printed information may include the type of gaming device or devices at which the enclosed outcomes were generated. For example, "9/6 Jacks or Better Video Poker," or "Diamond Mine" machines.

Printed information may include the particular gaming device at which the enclosed outcomes were generated. For example, device number 9703.

Printed information may include the casino at which the enclosed outcomes were generated.

Printed information may include the city, state, country, or other location where the enclosed outcomes were generated.

Printed information may include the time or date, or the range of times or dates over which the enclosed outcomes were generated.

Printed information may include the pay table or pay tables for the enclosed outcomes.

Printed information may include the number of bonus outcomes contained within the enclosed slot book.

Printed information may include the payback percentage of the gaming devices at which the enclosed outcomes were generated.

Printed information may include the top jackpot, or maximum prize for the gaming device at which the enclosed outcomes were generated.

Printed information may include an auditor's stamp or seal of approval. The auditor may be, for example, a large accounting firm, such as PriceWaterhouse Coopers, Deloitte & Touche, Ernst & Young or KPMG. The auditor's seal may certify that the outcomes have been generated fairly, that the outcomes have been distributed fairly, that no human has seen the outcomes, etc.

Printed information may include instructions for how to claim any winnings associated with the enclosed outcomes. For example, the wrapper may contain a mailing address to which to send the base leaf, or a Web site where a code from the base leaf may be entered.

Printed information may include the expiration date, prior to which any payouts from the enclosed slot book must be redeemed.

Printed information may include a picture of the gaming device or gaming devices that generated the enclosed outcomes.

Printed information may include a picture of what one of the enclosed outcomes might look like. For example the wrapper might show three jackpot symbols lined up.

Printed information may include a picture of what one of the enclosed outcome leaves might look like. For example, the wrapper shows a smaller version of a sample outcome leaf, including outcome symbols, a payout amount, and background graphics.

Printed information may include the price of the slot book.

Printed information may include a marketing promotion, such as an advertisement, coupon, or offer to bind the consumer into a forward commitment. Marketing promotions may be similar to those that may be printed on outcome leaves, described above.

Printed information may include an identifier for the slot book, or for any one or more of the outcome leaves or base leaves enclosed in the slot book. The identifier may take the form of an alphanumeric sequence of characters, a bar code, or any other human or machine-readable code. When the slot book is provided to the consumer, the sales device may scan the identifier to record which slot book is being provided. The sale of the slot book may then be recorded in the slot book database 270 of FIG. 10.

Printed information may include background graphics, such as graphics depicting bank vaults, diamond mines, happy people, the casino at which the enclosed outcomes were generated, etc.

In addition to the auditor's seal described above, a number of other types of seals may indicate the origins or authenticity of slot books. One type of seal may certify that a slot book was generated in a particular city, such as Las Vegas. The seal may read "Certified Las Vegas," or something similar. Similarly, a seal may certify that an outcome was generated at a particular casino, or by a particular gaming device. Another seal may indicate that a slot book was generated by any of a particular brand of gaming devices, or by any of the gaming devices made by a particular manufacturer. For example, a seal may read "Certified ABC Slot Manufacturing Corp." or "Certified Fruit Slot Machine." Stamps or seals may comprise special designs, colors, shapes, patterns of depression and elevation in a substrate material, and so on, as is well known in the art.

Note that in some embodiments, the wrapper serves the important purpose of ensuring that outcomes cannot be seen by casino employees or any other humans prior to the sale of the outcomes. If, for example, casino employees could see outcomes prior to their sale, then the casino employees might be inclined to buy slot books with primarily winning outcomes themselves, and to sell slot books with primarily losing outcomes to consumers. Such a practice would, of course, be dishonest.

The wrapper might be sealed shut in a number of ways. For example, a special holographic tape might seal one part of the wrapper to another, much as such a tape is used to seal the case of a compact disc. If the tape is ever broken, then a consumer knows the package has been tampered with. The wrapper may also be vacuum-sealed or weld sealed around the enclosed slot book.

In some embodiments, the wrapper is color coded according to the denomination of the enclosed outcomes, the number of the enclosed outcomes, the price of the slot book, or the type of gaming device at which the slot book was generated. For example, a red wrapper might indicate that the enclosed outcomes pay based on a 5-cent implied wager, while a green wrapper might indicate that the enclosed outcomes pay based on a 25-cent implied wager.

In some embodiments, slot books can be packaged to appear as gifts. The wrapper may, for example, contain ornamental designs, and may resemble the wrapping paper commonly used for gifts. A consumer may request that a message be printed on the wrapper. The message may begin, "Dear Joe, Happy Birthday . . . " In some embodiments a consumer may even request that a message be enclosed within the wrapping paper. In this embodiment, the consumer may be required to request the inclusion of the message prior to the generation, printing, or packaging of the outcomes. Outcomes packaged as gifts may make good presents, as slot books may be entertaining, valuable, and non-intrusive. Slot books are non-intrusive because, in many embodiments, they take up very little space, and may be discarded once redeemed for a payout. Thus, unlike many presents, slot books need not take up excessive space and gather dust in a recipient's home. Furthermore, slot books may be generated with a highly variable number of outcomes of a highly variable denomination. Therefore, for example, it is easy to make expensive slot books or inexpensive slot books, depending on what the gift occasion warrants. Outcome leaves may also serve as cards. For example, a thank you card may contain an outcome for redemption by the recipient.

In some embodiments, only a base leaf has an identifier, while the outcome leaves do not.

In some embodiments, outcome leaves may not be packaged into slot books. Instead outcomes might be concealed with an opaque coating material, such as is commonly used in lottery scratch tickets.

Step 2014: Provide the Slot Book to a Consumer

Once a slot book has been printed and packaged, the packaged slot book may be provided to a consumer. In one embodiment, the consumer purchases the slot book. The slot book may sell for an amount equal to the number of outcomes contained in the slot book multiplied by the denomination of the outcomes. For example, if there are one hundred outcomes of $1 denomination, then the slot book may sell for $100. The consumer may purchase the slot book, for example, from a stand at a casino. The stand may be staffed by a casino employee, and may include a sales device (FIG. 6), such as a point of sale (POS) terminal.

When a consumer purchases a slot book, the consumer may pay using cash, a credit card, traveler's checks, or any other consideration. The consumer may also provide personal information, including his name, address, and telephone number. The casino employee may enter the personal information about the consumer into the sales device. The sales device may transmit the information to the central server to be stored in a slot book database 270 such as that of FIG. 10. In one embodiment, the consumer may provide personal information by providing a player-tracking card. The casino employee may interface the player tracking card with an input device of the sales device in order to input consumer information into the sales device. The casino employee may also use a scanner or other input device associated with the sale device to input information about the slot book being sold to the consumer. For example, the casino employee may situate a slot book such that the bar code on the wrapper of the slot book may be scanned in by a scanner of the sales device. From the bar code, the sales device may receive such information as the slot book identifier, the price of the slot book, the number of outcomes contained in the slot book, and so on. In addition, the sales device may record the time and the date at which the slot book is sold. The sales device may likewise transmit information about the slot book, its time and date of sale, and its location of sale, to the central server for storage in a slot book database 270 such as that of FIG. 10.

A consumer may purchase a slot book either alone or in combination with other goods or services. For example, a consumer may purchase a hotel package that includes two nights stay and a $1 denomination slot book. A consumer may make a purchase and receive an offer to purchase an outcome or a slot book in addition to the other items he has purchased. For example, a consumer may receive an offer from a cashier to purchase an outcome leaf for change due to the consumer after the consumer tenders a bill for a purchase in which the face value of the bill is greater than the purchase price.

In one embodiment, a consumer purchases a slot book, but provides an address of a friend, relative, or other person to whom the slot book should be sent. The casino or other seller of the slot book may then send the slot book directly to the person's friend.

In one embodiment, a casino or other party may give out slot books for free, e.g. as promotional gifts. For example, a casino might hand out slot books on the street in Las Vegas. A person who received a slot book might be required to visit the casino in order to claim the payout associated with the slot book. The casino thereby encourages potential customers to visit the casino. It should be noted that, in the above embodiments, single outcomes, or pluralities of unrelated outcomes may be used in place of slot books. For example, single outcome leaves may be handed out on the street as promotional gifts. Similarly, single outcome leaves may be sent as gifts to relatives.

Step 2016: Receive the Identifier from the Consumer

Once the consumer has received the slot book, the consumer may peruse the outcomes at his leisure. As the consumer views an outcome on a first outcome leaf, he may peel back the outcome leaf to reveal the next outcome leaf behind it. As mentioned, each outcome leaf may show the symbols of an outcome, a payout associated with the outcome, and an amount of cumulative winnings for the slot book. The player's experience viewing the slot book is therefore analogous in many ways to playing at a physical gaming device. Peeling back an outcome leaf to reveal another outcome is comparable to spinning the reels of a gaming device. The payout on the outcome leaf is comparable to a payout meter on a gaming device. The cumulative winnings displayed on an outcome leaf are comparable to a credit meter on a gaming device. In fact, the layout of an outcome leaf may be designed to mimic the view of the front of a gaming device.

In embodiments where outcome leaves are not required for receiving payouts associated with a slot book, the consumer may dispose of the outcome leaves as he views them. For example, if outcome leaves are stuck together using a sticky substance, the consumer may pull on an outcome leaf until the binding effect of the sticky substance is overcome, and may then throw the leaf into a garbage can. Alternatively, the consumer may fold outcome leaves back behind the slot book, or may mark his place in the slot book, e.g. using a bookmark or similar device, which may come attached to the slot book. In some embodiments, a consumer may wish to save certain outcome leaves. Perhaps they are high-paying outcomes the consumer wishes to remember or show to friends. The consumer may be able to purchase frames or albums tailored to the size and shape of the outcome leaves so as to provide for their convenient display. The casino that sold the slot book may also sell the frames or albums.

The slot book may be formed so that there are certain logical stopping points for a consumer in viewing outcomes. As mentioned there may be base leaves spaced periodically within the slot book, e.g. every one hundred outcomes. The base leaves may contain summary statistics about the prior outcomes group of outcomes (i.e. those outcomes having occurred since the last base leaf), or about all prior outcomes. The base leaves may contain other kinds of information as well, including identifiers, and bonus outcomes. Each base leaf may be used to redeem winnings for the group of prior outcomes. In an alternative embodiment, groups of outcomes may be delimited with separators, with the separators containing no particular information. These separators may be of a different substrate material, thickness, color, size, shape, etc., than typical outcome leaves. When a consumer reaches a separator, the consumer may wish to temporarily cease going through the outcome leaves so as to save some for future sessions. In one embodiment, separators may be placed so that it would take an average person a predetermined amount of time to peruse the outcomes placed between separators. Perhaps a casino has determined, through observations of consumers in a focus group, that, on average, a consumer spends five seconds on each outcome leaf. The casino may then cause slot books to be printed with separators after every sixty outcomes. In this way, a person may be expected to reach a separator after five minutes of perusing outcome leaves.

In a related embodiment, groups of outcomes or outcome leaves within a slot book may be packaged separately. For example, every fifty outcome leaves may be wrapped in a separate wrapper. A consumer would reach a logical stopping point when he had viewed all of the outcome leaves within a particular wrapper. Although there may be individual groupings of outcomes or outcome leaves in separate wrappers, a single wrapper may still surround all of the outcome leaves, much as a chewing gum wrapper encloses multiple sticks of gum, which are themselves individually wrapped.

In yet another embodiment, outcome leaves are formed into logical groupings according to substrate material, thickness, color, size, shape, denomination, gaming device at which they were generated, and so on. For example, the first eighty outcome leaves in a slot book may have green backgrounds, the second group of eighty outcome leaves may have red backgrounds, the third set of outcome leaves have orange backgrounds, etc. A consumer may be inclined to take a break when he reaches a group of outcomes that are of a new color.

In some embodiments, when a consumer peels back the last outcome leaf, he will have reached the base leaf. The base leaf may indicate the cumulative winnings for all the outcomes of the slot book. The cumulative winnings are the payout associated with the entire slot book. The base leaf may also contain an identifier, as described, which may identify the slot book, the payout associated with the slot book, or any other relevant information. If the consumer decides to collect the payout for the slot book, the consumer may submit the identifier to the central server. The consumer may submit the identifier in a number of ways.

In some embodiments, the consumer takes the base leaf containing the identifier to a redemption device, such as redemption device 160 of FIG. 7. The redemption device may contain an input device, such as a scanner, for inputting the identifier from the base leaf. The redemption device may also contain input devices for manual input. For example, a casino employee may key the slot book identifier into the redemption device. The redemption device may then transmit the identifier to the central server.

In some embodiments, the consumer may mail in the base leaf containing the slot book identifier. The consumer may mail the base leaf, for example to an address printed on the base leaf, on the wrapper of the slot book, or on one or more outcome leaves. The consumer might also mail the base leaf to the casino from which he purchased the slot book. The consumer may include personal information, such as a name, address, or player tracking card number, so that the central server or casino knows where to send the payout associated with the slot book.

In some embodiments, the consumer may bring the base leaf to a gaming device. The gaming device may be one identified on the base leaf. For example, the base leaf might contain a printed text message, "Bring this to any Inca Gold slot machine at the River Palace Casino in order to collect your winnings." A text message might even promote certain gaming devices or casinos with messages such as, "Bring this to any Wheel Of Fortune® slot machine and double your winnings." The consumer may insert the base leaf into an input device of the gaming device. For example, if the base leaf contains a magnetic stripe, then the consumer may insert the base leaf into a player tracking card reader or a credit card reader associated with the gaming device. In another example, the base leaf has the form of a cashless gaming receipt (e.g. it is composed of the same material and contains similar markings), and may be inserted into a gaming device as if it were cash. Alternatively, the consumer may key in an identifier from the base leaf into the gaming device, using, for example, a keypad on the gaming device. The gaming device may then transmit the identifier to the central server. If the central server confirms that the identifier is valid, then the central server may transmit to the gaming device an authorization to immediately pay the consumer the payout associated with the slot book. Payment may take the form, for example, of credits added to the credit balance on the gaming device, or coins dropped into the tray of the gaming device.

In some embodiments, the consumer may visit a Web site of the central server. The uniform resource locator (URL) for the Web site may be printed, for example, on the base leaf. At the Web site, the consumer may enter the slot book identifier. The consumer may also enter personal information, such as his name, address, or player tracking card number into the Web site. In some cases, the consumer must enter two data sequences into the Web site. The first data sequence may include plain-text set of data, such as the payout for the slot book, and/or the slot book identifier. The second data sequence may include an encoded or encrypted set of data. The encrypted data sequence may be the encrypted version of the plain text data. For example, the encrypted data sequence may be an encrypted version of the payout for the slot book together with the date on which the outcomes of the slot book were generated. The central server may possess a key or an algorithm for decrypting the encrypted data sequence. The central server may therefore be able to verify, through decryption, that the encrypted and decrypted data sequences match. The central server could also verify that the data sequences match by encrypting the plain text data and comparing it to the encrypted version supplied by the consumer. The use of encoded or encrypted data sequences may make it more difficult for a dishonest consumer to attempt to redeem a slot book for more than his actual winnings. For example, suppose an encrypted data sequence contains the total winnings for a slot book, together with the time and date at which the last outcome was generated. A consumer might make up an amount of winnings, say $325, and might even use the true time and date at which his last outcome was generated. However, the consumer would not know the proper key or algorithm for encrypting the winnings, date, and time, and would therefore not be able to create the proper encrypted data sequence. Therefore, when the consumer enters "$325" into a Web site of the central server (together with the date and time information), he will almost certainly enter an improper encrypted data sequence, and will be caught trying to cheat by the central server. Note that even with the use of encryption, certain other precautions may be necessary. For example, the central server may track which slot books have been redeemed. Otherwise, a consumer might redeem a winning slot book by typing in to the central server's Web site an encrypted and unencrypted data sequence, and then try to redeem the same slot book again by typing in the same two sequences. One advantage of using encrypted data sequences is that the central server need not store payouts associated with slot books or individual outcome leaves. Rather, the central server can just verify that data about slot books that it receives from the consumer is valid.

Note that slot book identifiers may be non-sequential, and may in fact be sparse over any range of possible identifiers. In this way, a consumer would not easily be able to deduce a second slot book identifier from looking at a first identifier (e.g. by adding one to the first identifier). This might make it harder for a consumer to attempt to fraudulently redeem a slot book.

In some embodiments, the consumer may submit the identifier for an individual outcome leaf. For example, the consumer enters a ten-digit identifier printed on an outcome leaf into a text box on the Web site of the central server. When the consumer submits the identifier for an outcome leaf, the consumer may receive the payout associated with that outcome leaf. The consumer may also receive the payout for an outcome leaf by mailing the outcome leaf to a specified address, or by bringing the outcome leaf to the central server. In some embodiments, the consumer must submit an outcome leaf in order to receive the associated payout. Submitting only the base leaf or only information about the cumulative payout of a slot book may not be sufficient. In one embodiment, if the payout associated with an individual outcome leaf exceeds a predetermined threshold, such as $100, then the consumer must submit the outcome leaf in order to receive the predetermined payout. There may be less of a chance of fraud when a consumer must submit an outcome leaf, versus when he must submit only a base leaf, or only summary statistics.

In one embodiment, a consumer may submit any outcome leaf from a slot book to the central server in order to receive a payout associated with the entire slot book. In this embodiment, the central server may be capable of associating information from a single outcome leaf with information about the entire slot book from which the outcome leaf came. For example, the slot book database 270 of FIG. 10 contains a field that stores the outcome identifiers for all the outcomes in a single slot book. The outcome database 260 of FIG. 9 stores information about outcomes that have been generated. The central server may receive information about an outcome leaf from a consumer, look up the information in the outcome database of FIG. 9, determine the outcome identifier associated with the outcome, look up the outcome identifier in the slot book database of FIG. 10, determine the associated slot book identifier, and then determine the payout associated with the slot book. In this way, the central server may determine the payout associated with a slot book after receiving only a single outcome leaf from the slot book.

In some embodiments, the consumer may submit information about himself in order to receive the payout associated with a slot book. For example, the consumer submits his name or player tracking card number. The consumer may also submit a password he had created when purchasing the slot book. The central server may look up the consumer's name in the slot book database of FIG. 10 to determine the slot books that have been sold to the consumer. If the slot books have not yet been redeemed, as indicated by field 1022 in the slot book database, then the central server may pay the consumer the payout associated with the slot book.

In some cases, a consumer may purchase or receive a slot book, but neglect to redeem the slot book. If the central server has a record of the identity of the purchaser of the slot book (e.g. stored in the slot book database 270 of FIG. 10), and the central server has an address for the purchaser (e.g. stored in the consumer database 250 of FIG. 8), then the central server may send reminders to the consumer to redeem the slot book. The reminders may further give the central server the opportunity to market to the consumer. For example, included with the reminder to redeem the slot book, the central server may place messages encouraging the consumer to return to the casino of the central server, promising the consumer discounts on casino related products or services, and telling the consumer of new events taking place at the casino. The central server may also include promotions from third-party merchants, and may receive compensation from such merchants for allowing them to advertise to the consumer.

Step 2018: Determine the Series of Outcomes that are Associated with the Received Identifier After receiving an identifier from the consumer, the central server may consult a database, such as the slot book database 270 of FIG. 10, or the outcome database 260 of FIG. 9, to determine an associated series of outcomes, or an associated single outcome. If, for example, the identifier is a slot book identifier, then the central server may look up the identifier in the slot book database of FIG. 10. The central server may determine from the slot book database the payout associated with the slot book, and may transmit a signal to the redemption device that the consumer is due the indicated payout. A casino employee attending the redemption device may then pay the consumer the payout associated with the slot book. Meanwhile, the central server may update the slot book database to indicate that the slot book in question has been redeemed.

In some embodiments, the identifier contains an encoded or encrypted version of the payout for the slot book. The redemption device may store a key or an algorithm capable of decoding the identifier so as to reveal the payout for the slot book. Alternatively, the redemption device may transmit the encrypted data to the central server for decryption. After decrypting the data, the central server may then transmit the payout for the slot book back to the redemption device.

In some embodiments, the identifier contains undisguised information about the payout of the slot book, and there is no need to look up the identifier in a database in order to determine a payout associated with the slot book.

In some embodiments, the central server must receive a consumer identifier as well as an identifier associated with a series of outcomes. For example, the central server may only allow the consumer who purchased the slot book to redeem the slot book. Therefore, the central server must verify that the consumer identifier submitted with the slot book identifier corresponds to the consumer who purchased the slot book.

Step 2020: Compensate the Consumer Based on the Series of Outcomes Associated with the Received Identifier The payout associated with a slot book, a single outcome, or a series of outcomes, may include any form of benefit. Benefits may include: cash, equity, gambling tokens, stamps, tickets, consumable products, toys, other products, special prices or special opportunities to buy products, services, insurance policies, honorary titles, and donations to charity on a recipient's behalf. Products may be digital, such as music and video recordings, information on driving directions, etc. Entertainment, such as music videos, may be displayed directly on the redemption device, or transferred in bit form, to a person. Benefits may include product add-ons, such as warranties. Services may include: clothes washing, car washing, etc.

Exemplary benefits may include: (i) cash, credits, or gambling tokens; (ii) reward points; (iii) free or discounted rooms (iv) free or discounted show tickets; (v) free or discounted meals; (vi) free or discounted merchandise from a casino's shops or affiliated merchants; (vii) having gambling balances or winnings rounded to a higher level (e.g. $85 rounded to $100); (vii) increased odds of attaining particular outcomes, increased pay for particular outcomes, extra winning outcomes, free spins, extra pay lines, increased credit lines; (viii) the ability to play dollar machines for a quarter; (ix) insurance against losses; (x) priority on the use of particular gaming devices; (xi) priority on getting tables at casino restaurants, priority on getting tickets to shows, and priority on sitting down at table games; and (xii) recognition. As an example of recognition as a benefit, a consumer may be recognized by having his name and/or image displayed publicly. For example a consumer's name may be displayed on a board overlooking a bank of slot machines, or on the screens of multiple other slot machines. The consumer's name may also be announced publicly.

A consumer may have a number of options for receiving the benefit associated with a slot book. A consumer may choose between receiving a benefit immediately or receiving a greater benefit after performing a specified activity. For example, a consumer may enter an identifier from the base leaf into the Web site of the central server in order to receive a $20 payout associated with a slot book. The Web site of the central server may thereupon offer to send the consumer a check for $20 right away, or to give the consumer $40 for the slot book if the consumer appears in person at the redemption device. The owner of the central server, e.g. a casino, may benefit from having the consumer appear in person, as then the consumer may be more likely to do further business with the casino. A consumer may choose between receiving a benefit immediately, or receiving a greater benefit spread out over time. For example, the consumer may receive $50 immediately, or $60 in 6 separate payments of $20 over a period of 12 months. The casino benefits from extending the period of the payments because the casino can earn interest on any unpaid balance due the consumer, and the casino can maintain a relationship with the consumer over a longer period of time via letters, notices, and other promotions included with the payments.

A consumer may choose between receiving a first benefit and an alternate benefit. In many embodiments, the first benefit is cash or a cash equivalent, and the alternate benefit is a product. Products may include, for example, clothes, jewelry, casino chips, free or discounted nights stays in a casino hotel, free or discounted meals at a casino restaurant, free or discounted massages, or free or discounted tickets to a casino show.

A consumer may be presented with options for receiving his payout on the base leaf of the slot book. For example, the base leaf might say, "Congratulations. With this book, you have won a total payout of $42. You now have a choice of receiving a check for $42, or of receiving one of three fabulous prizes, each valued at over $80. Just check one of the boxes below, and mail this base leaf to 123 Main St, Somewhere, USA.

$42 check
14-carat gold necklace
High-fidelity radio/alarm clock
One night's stay at the Gold Palace Casino."

In some embodiments, the consumer must sign one of several lines on a slot book to indicate his choice of a prize or payment. Each signature line may be associated with a different prize or payout.

In some embodiments, a consumer may submit an additional payment with his base leaf, or with an identifier from his slot book, in order to receive a larger prize. For example, a consumer might mail in his base leaf, which indicates a payout of $20, together with a check for $10, in order to receive a clock radio valued at $50.

In some embodiments, a consumer may have arranged to receive a new slot book as a "trade-in" for his old slot book. For example, when a consumer purchases a first slot book, he may agree to receive a second slot book valued at the payout of the first slot book. When the consumer sends in the base leaf of the first slot book, indicating a payout of $10, for example, he may receive a second slot book valued at $10. For instance, the second slot book may contain two hundred outcomes of 5-cent denomination. In some embodiments, the consumer may have an arrangement where he continually trades in old slot books for new ones until the payout for his current slot book falls within a predetermined set of ranges (e.g. below $3 or above $100). Once the payout for the current slot book falls within the predetermined ranges, the consumer may receive a check for the payout. Alternatively, once the consumer reaches the tenth, or nth slot book, he may receive a check for the associated payout.

In some embodiments, a consumer need not submit an identifier. Rather, the central server may store a record of all the outcomes and payouts associated with a slot book (see the outcome database 260 of FIG. 9 and the slot book database 270 of FIG. 10), and of the payout associated with the slot book as a whole (see the "Book Value" field 1014 in the slot book database 270 of FIG. 10). A predetermined amount of time after the consumer has purchased the slot book, the central server may send to the consumer the payout associated with the slot book. Payment may take any form, including cash, check, direct deposit to a financial account, a product, or a service. The payment may be sent to the consumer's address, stored in the consumer database of FIG. 8. When the central server allows a predetermined amount of time to elapse before providing the payout to the consumer, the central server allows the consumer time to enjoy the outcomes without giving away the cumulative payout for the book. However, in some embodiments, the central server, via e.g., a casino employee, may provide the payout immediately after the consumer has purchased the slot book.

Step 2022: Provide Audit Data to the Consumer

In some embodiments, the consumer may have the opportunity to view audit data relating to outcomes in a slot book. The consumer may, for example, be suspicious of whether or not the outcomes in his slot book were actually generated at a real gaming device. The consumer may also be happy with his outcomes and wish to experience having them displayed on a real gaming device, or at least on a video monitor shows or simulates a gaming device. Audit data may comprise; video clips of a gaming device as it generates the outcomes incorporated in a slot book; paper or other printed documentation indicating the outcomes; and/or machine readable records of outcomes, such as descriptions of outcomes stored on a hard disk, compact disk, floppy disk, etc.

In some embodiments, the consumer may view audit data by visiting a Web site of the central server and entering an identifier for an individual outcome or for an entire slot book. The central server may then cause the Web site to display stored video clips of a gaming device as it generated the outcomes from the consumer's slot book. The central server may retrieve such video clips from the audit database of FIG. 11. In another embodiment, the Web site may display a printed list of all the outcomes contained in the consumer's slot book, perhaps including detailed information about the times the outcomes were generated, the gaming device on which they were generated, and the identity of casino employees who witnessed the outcomes' generation.

In some embodiments, a consumer may bring a base leaf of a slot book to an actual gaming device, insert the base leaf into the gaming device, and thereby cause the gaming device to display the outcomes of the slot book. The gaming device may first read an identifier from the base leaf, transmit the identifier to the central server, and receive from the central server an indication of the outcomes corresponding to the slot book from which the base leaf came.

In some embodiments, a consumer might bring a base leaf to a desk at a casino. The casino attendant may then retrieve a video cassette tape of the gaming device that generated the outcomes. The casino attendant may then allow the consumer to view the cassette tape of the gaming device as the gaming device generated the outcomes of the consumer's slot book. There are many other possible ways of providing audit data to a consumer.

Various embodiments of the present invention include a medium with printed matter that includes one or more indicia. The medium may be paper, cardboard, or other substrate. Among the included indicia may be indicia of at least one outcome generated at a gaming device. For example, graphic depictions of cherry symbols may serve as indicia representing outcomes at the gaming device that include cherry symbols. Indicia may also take the form of text or any printed information. The medium may further include indicia of a payout associated with that at least one outcome. For example, the medium may include a text or numerical description of the payout. The medium may further include an identifier. The identifier may be machine-readable. For example, the identifier may be a bar code. The identifier may be uniquely associated with the outcome generated at the gaming device. The identifier may be uniquely associated with the at least one outcome in a database. For example, the central server may include a database that stores representations of outcomes in association with identifiers. The medium may further include indicia of a pay table of the gaming device. For example, the medium may include a graphical representation of the pay table with graphical representations of outcomes and corresponding numerical depictions of payouts. The medium may further include indicia of a seal indicating unbiased generation of the at least one outcome generated at the gaming device. For instance, the medium may include a seal from an auditing firm, where the seal indicates that the auditing firm has verified the unbiased generated of the at least one outcome. The medium may further include indicia of redemption instructions for receiving the payout. For example, the medium may further include instructions for how a player might go on-line, provided an identifier to a Web site of the central server, and thereby receive a check in the mail from the central server in the amount of the payout.

Note that in various embodiments, the identifier may be associated with information other than the at least one outcome. For example, the identifier may be associated with the payout. The payout may be associated with the at least one outcome. In this way, the identifier may be indirectly associated with the at least one outcome, via the payout. However, identifier need not be associated with the outcome at all. For example, the identifier may only be associated with the payout. In various embodiments, the identifier is directly or indirectly associated with the payout. In this way, the central server may receive the identifier and, through a chain of associations, deduce the payout. The central server may then provide the payout to a customer who has submitted the identifier.

Note that in various embodiments, the medium need not include a pay table. Note that in various embodiments, the medium need not include redemption instructions.

In various embodiments, an article of manufacture includes a plurality of a first type of media with printed matter. For example, the article may be a booklet with a plurality of pages. Each first type of medium may include indicia of an outcome generated at a gaming device; indicia of a payout associated with the outcome; indicia of a position relative to the other type of media, such as a page number; and indicia of a pay table of the gaming device. Each first type of medium may further include indicia of a statistic describing winnings associated with a subset of the outcomes indicated on the plurality of the first type of media, wherein the subset of outcomes are those outcomes indicated on the first type of media situated prior to the present medium. For example, if a particular medium of the first type of medium corresponds to a particular outcome, then the particular medium may include a printed number describing a cumulative amount of winnings associated with the outcomes that were generated prior to the particular outcome. Such outcomes may correspond to pages in a booklet that are before (e.g., have lower page numbers) the page corresponding to the particular outcome.

The article may further comprise a second type of medium with printed matter. For example, the article may comprise a cardboard substrate with printed text, graphics and/or other information. The second type of medium with printed matter may include indicia of an identifier, wherein the identifier is machine-readable, and wherein the identifier is uniquely associated with the article in a database. For example, the central server may include a database that uniquely associates slot books with identifiers. For instance, each slot book may have a different identifier than any other slot book. The second type of medium with printed matter may further include indicia of a statistic describing winnings associated with the outcomes indicated on the plurality of first type of media. For example, the indicia may be a number describing the net winning associated with the outcomes. The second type of media with printed matter may further include indicia of redemption instructions for receiving winnings associated with the outcomes indicated on the plurality of first type of media.

In various embodiments, a method, such as a method for generating a slot book, may include the following steps. It is determined whether a gaming device is available for generating outcomes. For example, it is determined whether the gaming device is being played or not. A series of outcomes is generated at the gaming device. An audit record is created of the generation of the series of outcomes. For example a record describing each of the outcomes generated is created. The record may include a time of generation, associated payout, and so on. An identifier is generated. The identifier may be a number, alphanumeric string, or any other identifier. The series of outcomes is associated with the identifier. The series of outcomes and the associated identifier are printed. For example, each outcome in the series is printed on a separate piece of paper, and each piece of paper also includes the identifier. The series of outcomes and associated identifier is packaged. For example, the sheets of paper containing the printed outcomes are wrapped in a wrapping paper. A consumer is provided with the packaged series of outcomes and associated identifier. The identifier is received from the consumer. The series of outcomes that are associated with the received identifier is determined. For example, the identifier may be matched in a database to a stored record of a series of outcomes. The consumer is compensated based on the series of outcomes determined to be associated with the received identifier. For example, if the series of outcomes determined to be associated with the identifier have a net payout of $30, then the consumer may be provided with $30. The audit record is made available for the consumer's review. For example, the consumer is allowed to verify various aspects of the outcomes' generation to become assured that the outcomes were generated fairly.

Various embodiments of the present invention include the following steps. An outcome at a gaming device is generated. For example, a random number of chosen, matched to an outcome, and the outcome is displayed on the reels of the gaming device. A payout is associated with the outcome, e.g., by matching the outcome to a payout using a pay table. It is determined whether the payout associated with the outcome falls below a predetermined threshold. If the payout does fall below the predetermined threshold (e.g., if the payout falls below a threshold of one credit) then an offer for a product discount is generated; an indication of the outcome together with the offer for a product discount is printed on a medium, and the medium is provided to a consumer. For example, if the payout does fall below a predetermined threshold, then an indication of the outcome plus an offer for a fifty-cent discount on a bottle of water is printed on a piece of paper which is provided to the consumer.

Various embodiments of the present invention include the following steps. An outcome is generated at a gaming device. A promotion is determined. The promotion may be a coupon or advertisement, for example. An indication of the outcome together with the promotion is printed on a medium. The medium is provided to a consumer.

Various embodiments of the present invention include the following steps. A statistic is determined and periodically updated. While the statistic continues to meet at least one criterion, the following additional steps are performed: (i) an outcome is generated (e.g., at a gaming device); (ii) an indication of the outcome (such as symbols or text) is printed on a medium; (iii) a payout associated with the outcome is determined (e.g., using a pay table of the gaming device); and (iv) the statistic is modified based on the payout. Once the statistic has been modified, the statistic may be evaluated to determine whether it continues to meet the criterion. The statistic may be representative of winnings associated with each outcome so far generated. The statistic may represent a credit balance, for example, and may increase with positive payouts and decrease by one when there is no positive payout. The at least one criterion may provide that the statistic must be above a first threshold (such as zero) and below a second threshold (such as one hundred).

Various embodiments may include generating a first outcome (e.g., on a slot machine); printing an indication of the outcome on a medium (such as a piece of paper); determining a payout associated with the outcome; modifying a statistic based on the payout (e.g., modifying a simulated credit balance based on the payout); determining whether the statistic is above a first threshold and below a second threshold (e.g., above zero and below one hundred); and if so generating a second outcome. In this way, a gaming device may simulate a session in which a player will quit if his credit balance reaches zero or exceeds some threshold, but will continue playing otherwise.

Various embodiments include a method comprising generating an outcome (e.g., on a slot machine); printing on a medium (e.g., on paper) an indication of the outcome; after printing the indication of the outcome, selling the medium; and adding a portion of the sale price of the medium to a progressive prize fund. Thus, for example, sales of printed outcomes may contribute to a progressive jackpot. The jackpot may eventually be won and claimed by a buyer of a winning printed outcome.

Various embodiments include a method comprising: generating an outcome; printing on a medium an indication of the outcome; providing the medium to a consumer; and establishing a reference time associated with the outcome. The reference time may be the time at which the outcome was generated, the time at which the outcome was printed, the time at which the medium was sold, or the end of the day on which the medium was sold. Various embodiments may further include determining the size of a progressive prize fund at the reference time, determining whether the outcome meets criteria for winning the progressive prize fund; and if so, providing the consumer with compensation related to the size of the progressive prize fund at the reference time. For example, suppose the reference time is the time at which the medium (a printed outcome, in this example) was sold, and the consumer bought a winning printed outcome at 4:00 pm. The progressive prize fund may be determined to be $325,932 at 4:00 pm. Thus, the consumer may be provided with compensation in the amount of $325,932.

Various embodiments include a method comprising: generating at a gaming device an outcome with two stages; printing on a first medium an indication of the first stage of the outcome; printing on a second medium an indication of the second stage of the outcome; and placing the first medium and the second medium adjacent to one another. For example, the first stage is a first hand of video poker, and the second stage is the same hand after some cards have been discarded and replaced. The two stages may be printed on successive pages in a slot book.

Various embodiments include a method comprising: generating an outcome at a gaming device; printing on a medium an indication of the outcome; and, after the outcome has been generated, receiving from a consumer a parameter of the outcome. The parameter may be the denomination of the outcome, a pay table associated with the outcome, or the price for which the outcome will be sold. For example, the consumer may select a denomination of twenty-five cents, or the customer may select a particular pay table in which the maximum payout is three hundred credits. Various embodiments may further include providing the medium to the consumer; receiving from the consumer an indication of the outcome; and compensating the consumer based on the outcome and the parameter chosen by the consumer. For example, if the consumer has chosen a first pay table, then the consumer may receive greater compensation than if he had chosen a second pay table.

Various embodiments include a method comprising: determining a parameter for sequentially generating two or more outcomes of a gaming device; and generating the outcomes, without a request for each outcome, in accordance with the parameter. The outcomes may be generated at a gaming device. The gaming device may generate the outcomes automatically. For example, the gaming device may generate the second outcome following the first outcome, without an intervening input from a human. The gaming device may generate the outcomes using e.g., a computer program guided by the parameter. Determining the parameter may include determining at least one of: (i) a number of outcomes; (ii) a denomination; (iii) a termination condition; (iv) a type of game; and (v) a strategy for generating outcomes. Thus, the parameter may guide the gaming device as it automatically generates outcomes. For example, if the parameter describes a number of outcomes of one hundred, then the gaming device may continue generating outcomes until it has generated one hundred outcomes. As described above, determining a parameter may further include determining a denomination, wherein determining a denomination includes determining a monetary amount on which a payout for one of the two or more outcomes will be based. For example, a "normalized payout" may correspond to each outcome. That is, a reference payout may correspond to each outcome. However, the reference, or "normalized" payout may be multiplied by the denomination of the outcome. For example, suppose the denomination of an outcome is twenty-five cents, and the reference payout is ten. Then the payout for the outcome may be the produce of the denomination and the reference payout, here equal to $2.50. Thus, the payout is based on the denomination. A denomination may, in various embodiments, represent the price of an outcome.

The aforementioned termination condition may be a level that must be exceeded by the aggregate of the payouts corresponding to the two or more outcomes. For example, the gaming device may stop generating outcomes once the aggregate payout for the outcomes generated so far exceeds $40 (the termination condition). In various embodiments, the aforementioned termination condition may be a level that must be exceeded by the aggregate of the respective payouts corresponding to each of the two or more outcomes less the aggregate of the respective denominations corresponding to each of the two or more outcomes. For example, a statistic may be determined as the sum of the payouts for all outcomes generated so far, minus the sum of the denominations of each outcome. Thus, if the payouts have summed to $76, the denominations have all been $0.25, and there have been one hundred outcomes generated thus far, then the statistic may have the value of $76-$0.25×100=$51. Thus, if the termination condition specifies a level of $50 for the statistic above which the gaming device will cease generating outcomes, then the gaming device may cease since the statistic has the value of $51. Similarly, the termination condition may be a level below which must fall the aggregate of the respective payouts corresponding to each of the two or more outcomes less the aggregate of the respective denominations corresponding to each of the two or more outcomes. In various embodiments, a termination condition is the occurrence of a particular outcome. For example, the gaming device ceases generating outcomes if "bar-bell-orange" occurs.

As described above, a parameter may be a type of game. The type of game may include (i) reel slots; (ii) video poker; (iii) video keno; (iv) video blackjack; and (v) video roulette.

As described above, the type of parameter may be a type of strategy. A strategy may include a set of rules by which to select cards to discard in a game of video poker.

Various embodiments include a method comprising: determining a first type of outcome to be sold; determining a second type of outcome to be sold in conjunction with the first type of outcome; determining a first gaming device capable of generating the first type of outcome; determining a second gaming device capable of generating the second type of outcome; directing the first gaming device to generate the first type of outcome; and directing the second gaming device to generate the second type of outcome. For example, the central server may instruct a video poker machine to generate a first type of outcome (a video-poker outcome). The central server may also instruct a reeled slot machine to generate a second type of outcome, consisting of three fruit-themed symbols. The two types of outcomes may both be printed and sold together as part of the same slot book. Evidently, the first type of outcome may come from a first game, while the second type of outcome comes from a second game.

Various embodiments include a method comprising: receiving a request to purchase a printed outcome; transmitting instructions to generate the printed outcome; receiving the printed outcome; receiving payment for the printed outcome; and providing the printed outcome. For example, a consumer may approach a cashier and request a printed outcome. The cashier may key in the consumer's request to a point of sale (POS) terminal. The POS terminal may relay the request to the central server, which may then relay the request to a gaming device. The gaming device may generate the outcome. The gaming device may relay information about the outcome to a printing device, which may then print the outcome, creating a printed outcome. The printing device may even be part of the POS terminal. The consumer may then pay for the printed outcome, and the cashier may take the printed outcome from the printing device (e.g., from the POS) and hand it to the consumer. In various embodiments, the consumer may further provide a parameter for generating the printed outcome, such as denomination. The parameter may be transmitted, such as to the gaming device. As before, the printed outcome may be received and then sold to the consumer.

Various embodiments include a method comprising: receiving from a player a request to generate two or more outcomes; receiving from the player a parameter for generating the outcomes; generating the outcomes without revealing the outcomes to the player; and transmitting the information about the outcomes to a printing device. For example, a gaming device may receive a request from a player to generate one hundred outcomes. The player may indicate a parameter, such as that the outcomes should be dollar-denomination outcomes. The gaming device may generate the outcomes, but may avoid displaying symbols representing the outcomes. In this way, the player is not able to decide whether he wants to purchase the outcomes after having seen them. The gaming device may then transmit information about the outcomes to a printing device, which may print and wrap them before the player can view them. The player may then purchase the wrapped outcomes.

Various embodiments include a method comprising determining a parameter for generating two or more outcomes, wherein the parameter describes a format in which the two or more outcomes will be printed; and generating the two or more outcomes. For example, a gaming device may receive from a player a request to generate outcomes along with a parameter that says that winning outcomes are to be printed along with fireworks graphics. Various embodiments further include receiving payment for the generation of the two or more outcomes. For example, the player may pay with cash, credit card, or casino tokens. Various embodiments further include generating the two or more outcomes without displaying the two or more outcomes on the screen of a gaming device. In this way, the outcomes may be generated at a gaming device without a passerby seeing a display of the two outcomes and thinking the two outcomes are for him.

Various embodiments include determining a parameter for generating two or more outcomes, wherein the parameter describes a strategy for generating the two or more outcomes, and automatically, generating the two or more outcomes using the parameter. For example, the player may provide a strategy for a game of video poker in which the strategy details what cards the gaming device should discard in various situations while generating the outcomes.

Various embodiments include determining data about an outcome at a gaming device; and determining, based on the data, a format for printing the data. Determining the format may include a graphic for printing in association with the data. For example a first graphic is printed with winning outcomes (e.g., a fireworks display) and a second graphic is printed with losing outcomes (e.g., neutral scene, such as a scene from nature). Thus, in various embodiments, determining data may include determining a payout of an outcome at a gaming device. In various embodiments, the differentiator between one type of graphic and another need not be strictly winning outcomes versus strictly losing outcomes. Rather, determining a format may include determining a first graphic if the payout exceeds a predetermined threshold, and determining a second graphic if the payout does not exceed the predetermined threshold. The threshold could be zero, one, ten, fifty, or any other number of credits or other representation of winnings. Of course, the predetermined threshold may be zero. In various embodiments, determining data may include determining a symbol that comprises an outcome at a gaming device. A symbol or symbols may provide other information about an outcome. For example, the symbols of an outcome can be matched to a pay table to deduce a payout corresponding to the outcome. In various embodiments, determining the format for printing the data about the outcome may include determining a graphic that depicts the symbol. Thus, for example, if an outcome includes a cherry symbol, printed data about the outcome may include a graphical depiction of a cherry. In various embodiments, determining a format includes determining text for printing in association with the data. Exemplary text may include "Congratulations," or "Almost got that!" Determining text may include determining a text description of the data for printing in association with the data. The data may be payout data, and the text may include a text description of the payout data for printing in association with the data. For example, the text may read, "+4 coins." The text may also include messages, such that the message is a first text message if the payout exceeds a predetermined threshold, and a second text message if the payout does not exceed a predetermined threshold. Exemplary text may include "Congratulations," (e.g., if the payout exceeds zero coins) or "Almost got that!" (e.g., if the payout does not exceed zero coins).

In various embodiments, determining data about an outcome may include determining a type of the gaming device; an image of the gaming device (e.g., the gaming device at which the outcome was generated); an identifier of the gaming device; a payout of the outcome; a payout ratio of the outcome; a casino in which the outcome was generated; a location where the outcome was generated; a pay table for the gaming device; a date when the outcome was generated; a time when the outcome was generated; and/or a strategy used to generate the outcome.

For such data, determining a format for printing the data may include determining a text description of the data. The text description may then be printed on a tangible substrate, such as on paper or cardboard. Determining a format for printing may also include determining a graphical depiction of the data (e.g., symbols making up outcomes). The graphical description may then be printed on a tangible substrate, such as on paper or cardboard. Determining a format for printing may also include determining, based on the data, a code that encodes the data. This code may be a bar code, for example. The bar code may allow the central server to input information about a printed outcome when it is later submitted to the central server by a player seeking redemption.

In various embodiments, aggregate information is determined for a sequence of outcomes, such as the outcomes that will make up a slot book. Various embodiments include determining first data about a first outcome at a gaming device, determining second data about a second outcome at a gaming device; determining third data based on the first data and second data; and determining, based on second and third data, a format for printing the third data. The first data may be a first payout associated with the first outcome. The second data may be a second payout associated with the second outcome. The third data may be a sum of the first payout and the second payout. Thus, the third data may be determined by adding the first data and the second data. However, the third data may be any statistic based on the first data and the second data. The statistic may describe at least one of: a number of consecutive winning outcomes; a number of consecutive losing outcomes; a net win; a net loss; a gross win; and a number of consecutive outcomes in which a strategy failed. Of course, such a statistic may include additional outcomes beyond the first and second outcomes. For example, the statistic may describe a span of ten consecutive wins which involved the first outcome, the second outcomes, and eight other outcomes. The third data may be an outcome number. The outcome number may be a designation of the place of the outcome in a sequence of outcomes (e.g., a sequence of outcomes forming a slot book).

Various embodiments include a method comprising determining data about an outcome at a gaming device, determining customization data, and determining a message, based on the data about the outcome and the customization data. Customization information may be information that is specific e.g., to the purchaser of a slot book containing the outcome. Determining customization data may include determining a name. Determining a message may include determining a message containing the name. For example, the message may be a greeting for the person with the name. Determining a message may include determining a first message containing the name if the data about the outcome meets predetermined criteria, and determining a second message containing the name if the data about the outcome does not meet first predetermined criteria. For example, if the outcome is a winning outcome, the message may say "Nice job, Bill." However, if the outcome is a losing outcome, the message may say, "Tough luck, Bill."

Various embodiments include receiving data about an outcome at a gaming device, receiving a format for printing the data, and printing the data based on the format. Such embodiments may be performed, for example, by a printing device, such as a printer. Receiving the data may include receiving at least one of: a payout of the outcome; a symbol comprising the outcome; an image of a gaming device; an image of a gaming device depicting the outcome; a time; a date; a casino; and a location. For example, the image may be an image of the gaming device that generated the outcome. The time and date may be the time and date the outcome was generated. The casino and the location may be where the outcome was generated. In various embodiments, printed the data based on the format may include at least one of: printing a text representation of the data; printing a graphical representation of the data; printing the data in the form of a bar code; printing an image of the gaming device; printing an image of the gaming device with the outcome shown on its reels; and printing a graphical representation of the outcome.

Various embodiments include printing multiple outcomes (e.g., on outcome leaves) and binding them together (e.g., to form slot books). Thus, various embodiments include receiving first data about a first outcome of a gaming device; receiving second data about a second outcome of a gaming device; printing a first page containing a representation of the first data; printing a second page containing a representation of the second data; and binding the first and second pages. Printing the second page may include printing the second page containing a representation of the second data and a representation of the first data. For example, the second page may include a recap of what happened on the first page, such as by reprinting small symbol graphics depicting an outcome on the first page. In various embodiments, third data may be determined based on first and second data, in which printing the second page includes printing the second page containing a representation of the second data and a representation of the third data. Receiving first data may include receiving an indication of a first payout of a first outcome of a gaming device, and receiving second data may include receiving an indication of a second payout of a second outcome of a gaming device. Further, determining third data may include determining a sum of the first payout and the second payout.

Various embodiments include a method comprising: determining first data indicative of a first outcome of a first gaming device; determining second data indicative of a second outcome of a second gaming device; determining third data based on the first data and the second data; printing a representation of first data on a first substrate (e.g., on a first page of paper); printing a representation of second data on a second substrate (e.g., on a second page of paper); printing a representation of third data on the second substrate; and binding together the first and second substrates. The bound substrates may form part of a slot book. The first and second gaming devices may be one and the same. The first and second substrates may be different substrates (e.g., different pages). However, they may also be the same. The first data may be the payout of the first outcome. The second data may be the payout of the second outcome. Determining the third data may include determining a sum of the first payout and the second payout.

Binding may be performed with various techniques. Binding may include binding the first and second substrates using a perfect binding technique. Binding may include binding the first and second substrates using thermal tape. Binding may also be performed using at least one of a staple, a plastic comb, a wire spiral, a plastic post, a leather binding technique; and a cloth binding technique. Various techniques for binding books are described in U.S. Pat. No. 6,652,210, the contents of which are incorporated by reference herein.

In various embodiments described above printing a representation of third data may include: printing a machine-readable representation of third data, such as a bar code. The bound first and second substrates may be packaged. Packaging may consist of a plastic wrapper, or vacuum-sealed pack, for example.

Various embodiments include determining first data indicative of a first outcome of a first gaming device; determining second data indicative of a second outcome of a second gaming device; determining third data based on the first data and the second data; printing a representation of first data on a first substrate; printing a representation of second data on a second substrate; printing a representation of third data on a third substrate; and binding together the first, second, and third substrates.

Various embodiments include determining first data indicative of a first outcome of a first gaming device; determining second data indicative of a second outcome of a second gaming device; printing a representation of first data on a first substrate; printing a representation of second data on a second substrate; and packaging the first substrate and the second substrate in a single package. Packaging may include surrounding the first substrate and the second substrate with a wrapper. The wrapper may be sealed. The first data may include a denomination of the first outcome; and such denomination may be printed on the wrapper. For example, the wrapper might have "25-cent" printed for outcomes originally generated at a quarter-denomination gaming device. A price may be determined based on the denomination, and the price may be printed on the wrapper. In various embodiments, a color may be determined based on the denomination; and a wrapper of the determined color may be used. For example, a green wrapper is used for 5-cent denomination outcomes, and a red wrapper is used for 25-cent denomination outcomes. These may thus be readily distinguished by customers.

Various embodiments include determining a promotion; and determining a criterion for associating the promotion with an outcome of a gaming device. Determining a promotion may include receiving a promotion from a third-party, such as an advertiser, marketer, or merchant. Further, a payment may be received from the third party. Various embodiments may further include: determining an outcome of the gaming device; and determining whether the outcome of the gaming device meets the criterion. If the outcome does meet the criterion, various embodiments further include associating the promotion with the outcome; and receiving a payment from the third party. The promotion may be an advertisement, a discount, a coupon, an offer, an offer of a benefit in return for a commitment to a future action; and an offer of payment for a first product in return for a commitment to purchase a second product.

Determining the criterion may include determining at least one of: a minimum payout of an outcome of a gaming device, the minimum payout or greater required for the promotion to be associated with the outcome; a maximum payout of an outcome of a gaming device, the maximum payout or less required for the promotion to be associated with the outcome; a symbol, the symbol required to appear in an outcome of a gaming device in order for the promotion to be associated with the outcome; and a payout for an outcome of a gaming device, the payout required for the promotion to be associated with the outcome. Various embodiments may further include determining an outcome of the gaming device; and associating the promotion with the outcome based on the outcome meeting the criterion. For example, a promotion may only be associated with an outcome if the payout of the outcome is more than five dollars.

An indication of the outcome and an indication of the promotion may be printed on a single substrate. For instance, if the promotion is an advertisement, then the advertisement and the outcome (e.g., "cherry-cherry-bell") may be printed on the same outcome leaf.

Various embodiments may include determining a promotion; determining a criterion for associating the promotion with an outcome of a gaming device; transmitting an indication of the promotion and the criterion. For example, a third party merchant may determine a promotion, determine that the promotion is only to be associated with losing outcomes, and transmit a text description of the promotion to the central server, for inclusion in a slot book. Various embodiments may further include providing a payment in exchange for an agreement to associate the promotion with an outcome of a gaming device. However, in some embodiments, a third party may pay only upon having received an indication that the promotion has been associated with an outcome. Thus, various embodiments may include receiving an indication that the promotion has been associated with an outcome of a gaming device; and providing, based on the indication, a payment.

In various embodiments, a third party, or other initiator of a promotion, may take steps to carry out the promotion. Thus, if a merchant has issued a coupon, then the third party may later receive the coupon and provide value in exchange (e.g., value in the form of a discount). Thus, various embodiments described above may include receiving a printed indication of the promotion and an outcome of a gaming device; and providing, based on the promotion, a product at a discounted price. The promotion may be a discount, such as a coupon. The step of receiving may include receiving a coupon indicating the promotion and the outcome of the gaming device.

Various embodiments may be performed by printing devices, and may include printing an outcome in association with a promotion. Various embodiments include receiving an indication of an outcome of a gaming device; receiving an indication of a promotion associated with the outcome; and printing, on the same substrate, an indication of the outcome and an indication of the promotion. Thus, an indication of a promotion, such a text description of an upcoming sale at a merchant, may be printed on the same page as an outcome. Receiving an indication of a promotion may include receiving an indication of at least one of: an advertisement; a discount; a coupon; an offer; an offer of a benefit in return for a commitment to a future action; and an offer of payment for a first product in return for a commitment to purchase a second product.

Various embodiments include determining a promotion; determining an outcome of a gaming device; and associating the promotion with the outcome. An indication of the promotion, the outcome, and the association between the promotion and the outcome may be transmitted to a printer. The printer may then print the promotion and outcome e.g., on the same page.

In various embodiments, the central server may generate outcomes. Various embodiments include determining a promotion; determining a criterion for associating the promotion with a random outcome; generating a random outcome; and associating, based on the criterion and the generated random outcome, the promotion with the generated random outcome. Various embodiments further include transmitting (e.g., to a printing device) an indication of the promotion, the outcome, and the association between the promotion and the outcome.

Various embodiments include determining a criterion for associating promotions and outcomes of a gaming device; determining a promotion; determining an outcome of a gaming device; determining, based on the criterion and the outcome, an association between the promotion and the outcome; and printing, on the same substrate, the promotion and the outcome based on the determined association. Such embodiments may be performed, for example, by a printing device.

Various embodiments include receiving from a consumer an indication of a desired promotion; receiving an indication from a consumer of a denomination of a printed outcome of a gaming device to be associated with the promotion; and transmitting an indication of the promotion and the denomination to a central server. Such embodiments may be performed, for example, by a point of sale (POS) terminal, by a cashier, or by a cashier working in conjunction with a POS terminal.

Various embodiments include determining a promotion; determining a criterion for associating the promotion with a random outcome; generating an outcome; and associating, based on the criterion and the generated outcome, the promotion with the generated outcome. Such embodiments may be performed, for example, by a gaming device. Various embodiments may further include displaying an indication of the promotion on a display screen. Various embodiments may further include displaying an indication of the outcome (e.g., displaying symbols of the outcome). Various embodiments further include simultaneously displaying an indication of the promotion and an indication of the outcome.

In various embodiments, promotions are associated with outcomes in a slot book. However, there may be a limit to the number of times a particular promotion will be in a slot book (e.g., associated with an outcome in the slot book). For example, a marketer may only wish to include one advertisement in a slot book, as multiple advertisements would be redundant. Various embodiments include determining a promotion; determining a criterion for associating the promotion with an outcome of a gaming device; determining a limit to the number of times a promotion may be associated with an outcome of a gaming device within a designated series of outcomes; determining a series of outcomes; determining a first outcome of the series of outcomes, the first outcome meeting the criterion; associating the promotion with the first outcome; determining a second outcome of the series of outcomes, the second outcome meeting the criterion; and associating, based on the limit having been met, the promotion with the second outcome. Thus, for example, if a promotion may be associated with only two outcomes, and associating the promotion with the first outcome brings the total number of associations to two (e.g., because of a previous association of the promotion with another outcome), then the promotion may not be associated with the second outcome.

In various embodiments, a promotion may span several pages in a slot book. The promotion may be associated with several successive outcomes. Various embodiments include determining a promotion, the promotion including a first portion and a second portion; determining a series of outcomes, the series including a first and second outcome of a gaming device; associating the first portion with the first outcome; and associating the second portion with the second outcome. Note that the series of outcomes may include a first outcome of a gaming device and a second outcome of a gaming device occurring immediately after the first outcome. Thus, the outcomes may be outcomes that were sequentially generated at a gaming device. The promotion may include a first graphic and a second graphic. Various embodiments further include printing on the same first substrate an indication of the first outcome and the first graphic; and printing on the same second substrate an indication of the second outcome and the second graphic. Thus, a first page in a slot book may contain the first outcome and first graphic, and a second page may include the second outcome and second graphic. Various embodiments further include binding the first substrate and the second substrate; and packaging the first substrate and the second substrate.

In various embodiments, a promotion is determined based on a series of outcomes in a slot book. For example, a person may be given a special promotion, such as a large discount offer, as consolation after a series of losing outcomes. Various embodiments include determining a promotion; determining a criterion for associating the promotion with an arbitrary series of outcomes; determining a particular series of outcomes; and associating, based on the criterion and the particular series of outcomes, the promotion with the particular series of outcomes. The particular series of outcomes may be determined by a gaming device, for example. Various embodiments further include determining an outcome of the particular series of outcomes; and printing, on the same substrate, a representation of the outcome and a representation of the promotion. A promotion associated with a series of outcomes may be printed on the same page as the last outcome in the series. Thus, various embodiments include determining a last outcome of the series of outcomes. The promotion may be printed with the last outcome. In various embodiments described above, the criterion is a number such that the promotion will be associated with an arbitrary series of outcomes if the arbitrary series of outcomes contains the number of consecutive losing outcomes. For example, the criterion may be that there must be eight losing outcomes in order for the promotion to be associated with a series of outcomes. On the other hand, a criterion may be a number such that the promotion will be associated with an arbitrary series of outcomes if the arbitrary series of outcomes contains the number of consecutive winning outcomes.

In various embodiments, the central server or other entity may sell advertising space in slot books. Advertising space may include space in which promotions are printed. Advertising space may be defined by a number of outcomes. For example, each outcome may be printed on a single page of a slot book, where each page has room for a certain number of promotions. Advertising space may be priced based on a number of factors. Various embodiments include determining a number of outcomes, each outcome corresponding to a unit of available space; determining a total amount of available space based on the number of outcomes; determining a demand for a unit of available space; and determining, based on the total amount of available space and the demand, a price for a unit of available space. The price may increase as a function of demand, and decrease as a function of available space. Determining a demand may include determining a number of advertisers who wish to purchase space, or a number of spaces that advertisers in general wish to purchase, for example. Determining demand may include determining a dollar figure, and determining a number of units that could be sold at the dollar figure. Various embodiments further include determining an outcome, the outcome corresponding to one unit of available space; selling the unit of available space at the determined price; determining a promotion; and printing on a substrate a representation of the outcome and a representation of the promotion. The promotion may be determined, for example, by receiving a promotion from an advertiser to which the unit of available space was sold. In various embodiments, determining a number of outcomes may include determining a number of outcomes scheduled to be generated, each outcome corresponding to a unit of available space. Thus, available space may include space that will become available once outcomes are generated and printed on pages that have space available. Also, in various embodiments, determining a number of outcomes includes determining a number of outcomes that have been generated but not yet printed, each outcome corresponding to a unit of available space. In various embodiments, demand for space may be based on the historical demand. Thus, in various embodiments, determining a demand includes determining a current demand based on a historical demand. Historical demand may be represented by historical sales of available space.

In various embodiments, a number of outcomes to generate may be based on demand for advertising or promotional space. For example, if there is much demand, then relatively more outcomes may be generated. Conversely, if there is little demand, relatively fewer outcomes may be generated. Various embodiments include determine a demand for a unit of available space; and determine, based on the demand, a number of outcomes to generate, each outcome corresponding to a unit of available space.

In various embodiments, a third-party merchant, makes a determination as to how much promotional space in slot books they wish to buy. Various embodiments include determining a promotion; determining a desired number of instances of the promotion; determining a number of units of space desired based on the desired number of instances; determining a price per unit of space; and offering to purchase the determined number of units at the determined price per unit. Various embodiments further include purchasing the determined number of units at the determined price per unit space; determining a representation of the promotion (e.g., a graphic and/or text); and transmitting a representation of the promotion for inclusion in each of the determined units of space. A third-party merchant may purchase space in a slot book for a coupon, for example. A purchaser of the slot book may later wish to use the coupon, and bring the coupon to the third-party merchant. Thus, the third-party merchant may receive its own promotion and be responsible for redeeming it. Various embodiments include receiving a substrate, the substrate including a printed representation of an outcome of a gaming device and the printed representation of the promotion; and providing a benefit in exchange for the substrate. If the substrate is a printed coupon, then the benefit may include a discount. Thus, in various embodiments, providing a benefit includes providing a discount on a purchase of a product.

Advertising space may have different value depending on nearby or associated outcomes. For example, an advertisement printed on a page with a winning outcome may be more effective than an advertisement printed on a page with a losing outcome. The winning outcome may put the customer in a better frame of mind and make him more receptive to the advertisement. The customer may simply stare at the page longer, and therefore have more time to stare at the advertisement. Thus, for example, the central server may price advertising space differently depending on nearby or associated outcomes.

Various embodiments include determining a first outcome, the first outcome associated with a first payout; determining a second outcome, the second outcome associated with a second payout, in which the second payout is greater than the first payout; determining a first price for first space associated with the first outcome; and determining a second price for second space associated with the second outcome. Further, the second price may be greater than the first price. This may assume, for example, that advertising space near greater payouts is more valuable than advertising space near lesser payouts. Various embodiments further include receiving a first promotion for placement in first space; receiving a payment equal to the first price; receiving a second promotion for placement in second space; receiving a payment equal to the second price; printing on a first substrate an indication of the first promotion and the first outcome; and printing on a second substrate an indication of the second promotion and the second outcome.

One component of demand may include a demand by customers to purchase slot books. Thus, even if there is high demand for advertising space, there may be relatively few slot books printed if there is little demand by customers to buy them. Demand for slot books may be determined by historical demand, which may be recorded in various ways. Various embodiments include selling a plurality of slot books in a given unit of time; and reporting the quantity of slot books sold in the unit of time. The report of the quantity of books sold may be used as a gauge for historical demand (e.g., during the given unit of time).

In various embodiments, a central server may schedule the generation of outcomes for use in slot books. For example, gaming devices on the casino floor may be utilized only during off-peak times, such as when they are unlikely to be played by casino patrons who are actually present at the gaming devices. Various embodiments include determining a need for outcomes to be generated; determining a condition that must be met in order for the outcomes to be generated, the condition requiring the absence of any player from a proximate vicinity; determining whether the condition has been met; and generating, based on the condition being met, an outcome. Thus, if no players are in the vicinity of a gaming device, the gaming device may generate outcomes for a slot book. It is then unlikely that a player would believe such outcomes to be his own.

Various embodiments include determining a need for outcomes to be generated; determining a condition that must be met in order for the outcomes to be generated, the condition requiring the current time to fall within a predetermined time of day; determining whether the condition has been met; and generating, based on the condition being met, an outcome. The condition requiring the current time to fall within a time of day with traditionally low consumer traffic. The condition may require the current time to fall between 3:00 am and 6:00 am (a time which traditionally does have low customer traffic on a casino floor).

Various embodiments include determining whether any player is actively playing; generating, if no player is actively playing, an outcome; and transmitting an indication of the outcome to a controller.

Various embodiments further include receiving an instruction from the controller to generate an outcome. For instance, a gaming device may require an instruction from the controller before it will start generating outcomes for a slot book. Various embodiments may further include generating the outcome without displaying an indication of the outcome. An indication of the outcome may not be necessary if no player is around to see it. Further, if a player sees an indication of an outcome (e.g., reels spinning followed by a final outcome being displayed), then the player may incorrectly interpret the outcome as his own. Thus, various embodiments include; receiving an instruction to generate a plurality of outcomes; generating a first outcome; determining whether the plurality of outcomes have been generated; and generating, if the plurality of outcomes have not been generated, a second outcome of the plurality of outcomes.

When a gaming device has received instructions to generate a number of outcomes, the gaming device may continue generating outcomes until it has generated the requisite number of them. Various embodiments include receiving an indication of a demand for a given number of outcomes; generating a first outcome; determining whether the given number of outcomes have been generated; and generating, if the given number of outcomes have not been generated, a second outcome. A POS terminal may receive a request for a number of outcomes (e.g., from a customer), and relay the request, such as to the central server or a gaming device. Various embodiments include receiving a request for a plurality of outcomes; and transmitting an instruction to generate the plurality of outcomes. Various embodiments further include receiving an indication of an amount of time required for generating the plurality of outcomes; and providing an indication of the amount of time. For example, a POS terminal may receive an indication that a requested number of outcomes will require five minutes to generate. The POS terminal may then relay this number to a customer, e.g., via a display or via the cashier.

If outcomes must be generated for a slot book, and a first gaming device is not available, a second gaming device may generate the outcomes. Various embodiments include polling a first gaming device for an indication of whether the first gaming device is available to generate outcomes; receiving an indication that the first gaming device is not available to generate outcomes; and transmitting an instruction to generate an outcome to a second gaming device. Various embodiments further include receiving an indication of an outcome from the second gaming device; and transmitting the indication of the outcome to a printing device. The printing device may then print the outcome, e.g., for inclusion in a slot book.

It may be convenient or desirable that outcomes to be included in the same slot book be generated at the same time. For instance, this would allow a slot book to be quickly assembled, and would not require a long wait for the last outcome to be generated. Various embodiments include determining a time when a first gaming device is available for generating outcomes; determining a time when a second gaming device is available for generating outcomes; determining whether the first time is the same as the second time; and instructing, based on the first time being the same as the second time, each of the first gaming device and the second gaming device to generate an outcome. So, for example, if both the first and second gaming devices are available at 5:24 pm, then the central server may instruct the gaming devices to each generate a series of outcomes. Once outcomes have been generated, indications of the outcomes may be received from the gaming devices (e.g., by the central server) and transmitted to the printing device. Various embodiments include transmitting to a printing device instructions to: print the first outcome on a first substrate; print the second outcome on a second substrate; and bind together the first and second substrates.

After a customer has purchased a slot book, the customer may later wish to receive his winnings. For example, the customer may submit a portion of a slot book, such as a base leaf, and expect to receive his winnings for the entire slot book. Various embodiments include receiving an indication of an aggregate of a plurality of payouts, each payout of the plurality of payouts corresponding to an outcome of a gaming device; receiving an indication of a person; and providing a payment to the person, the payment based on the aggregate of the plurality of payouts. The aggregate of the plurality of payouts may include a character sequence that encodes a plurality of payouts, each payout of the plurality of payouts corresponding to an outcome of a gaming device. The character sequence may be a sequence of numbers, each number indicating a payout. The character sequence may be a single number equal to the sum of all the payouts. There are, of course, many other possibilities. The character sequence may be any of the aforementioned that is encrypted or encoded, e.g., to prevent forging by a customer. The character sequence may be received over an electronic communication system, such as the Internet or a telephone network. Thus, the player may submit the code electronically by e.g., reading the code from an outcome leaf or base leaf in his slot book and sending it over the Internet (or telephone). In various embodiments, the indication of the aggregate of the plurality of payouts may be a machine-readable code that encodes the plurality of payouts, each payout of the plurality of payouts corresponding to an outcome of the gaming device. The machine-readable code may be a bar code. In various embodiments, receiving an indication of an aggregate of a plurality of payouts includes receiving a substrate containing a printed indication of the aggregate of the plurality of payouts. The printed indication may be a machine-readable code. Thus, the customer may submit a base leaf that contains a bar code indicating his aggregate payout.

In various embodiments, receiving an indication of a person includes receiving at least one of: a name, a home address, an email address, a financial account identifier, an image, and a driver's license. A payment may be provided to the person in the form of at least one of: a check, cash, electronic cash, a wire transfer, a money order, a gift certificate, and a voucher.

In various embodiments, the central server need not receive an indication of an aggregate payout for a slot book, for example, if the central server already has that information on file. Rather, the central server may only receive a unique identifier for the slot book (e.g., a serial number) and associate the identifier with the payout that is already on file. Various embodiments include receiving an identifier for a slot book; determining, based on the identifier, an aggregate payout for the slot book; receiving an indication of a person; and providing a payment to the person, the payment based on the aggregate of the plurality of payouts. Determining the aggregate payout may include accessing, in a database, an aggregate payout associated with the identifier.

A personal computer, or other device belonging to the customer may be involved be used for the transmission of information allowing the user to receive a payout for the slot book. Various embodiments include receiving an indication of an aggregate of a plurality of payouts, each payout of the plurality of payouts corresponding to an outcome of a gaming device; receiving an indication of a person; transmitting to a central server the indication of the aggregate of the plurality of payouts; and transmitting to the central server an indication of the person. The indication of the aggregate of the plurality of payouts may be received via keyboard input of the customer.

In various embodiments, a redemption device, such as a POS terminal, may allow a customer to receive a payout immediately upon purchasing a slot book. Various embodiments include receiving an indication of a first slot book; determining a payout amount corresponding to the first slot book based on the indication; and authorizing immediate payment to a purchaser of the first slot book based on the payout amount. Receiving an indication may include scanning a machine-readable code, the code encoding an identifier of the first slot book. Determining a payout amount may include accessing a database with entries indexed by slot book identifiers, each entry including a separate slot book identifier and a corresponding payment amount.

Various embodiments include receiving an indication of a first slot book; determining a payout amount corresponding to the first slot book; authorizing a payment based on the payout amount. In such embodiments, the payout amount may be deduced from the indication of the slot book. E.g., the indication may be a payout amount. Receiving an indication may include receiving a substrate, the substrate containing a machine-readable code encoding an identifier of the first slot book. Determining a payout amount may include receiving a substrate, the substrate containing a machine-readable code encoding the payout amount. Authorizing a payment may include unlocking a cash drawer. Unlocking the cash drawer would allow a cashier to reach in and obtain the payment for a customer. The payout amount may be displayed (e.g., so the cashier knows how much to pay the customer). In various embodiments, the payout amount is determined from the central server (e.g., rather than directly from an identifier of the first slot book). Various embodiments include transmitting the indication of the slot book to a central server; and receiving an indication of the payout amount from the central server. Various embodiments further include providing the payment. The payment may be provided in the form of at least one of cash, casino chips, casino tokens, coins, vouchers for cash; and vouchers for casino tokens.

In various embodiments, a customer may submit individual outcome leaves for redemption, in addition to or in lieu of slot books. Of course, the customer need not actually submit an outcome leaf, in various embodiments, but may instead submit an identifier of the outcome leaf.

Various embodiments include receiving an indication of an outcome; receiving an indication of a user; determining a payout amount associated with the outcome; and authorizing a user to be provided with a payment based on the payout amount. The indication of the outcome may be a sequence of characters indicating the outcome. The indication may be via an electronic communications medium, such as via electronic mail or via a telephone network. Receiving an indication of a user may include receiving an indication of at least one of: a user name, a user home address, a user email address, a user financial account identifier; and a user player tracking card number. Determining a payout amount may include receiving from the user an indication of the payout amount. Determining a payout amount may include receiving from the user a code, the code associated with the outcome and encoding the payout amount. In various embodiments, a central server may have on file (e.g., in a database) payouts associated with outcomes. A central server may receive an identifier and look up the corresponding payout in a database. In various embodiments, where an indication of a first outcome is received, determining a payout amount may include: determining based on the indication of the first outcome, a first outcome identifier; accessing a database with entries indexed by outcome identifiers, the entries including identifiers associated with payout amounts; finding in the database an entry corresponding to the first outcome identifier; and retrieving a payout corresponding to the first outcome identifier. Various embodiments further include providing the payment to the user.

In various embodiments, a customer may receive payment for a single outcome of a slot book. However such payment may be deducted from any future amount the customer is to receive based on the slot book. Various embodiments include receiving an indication of an outcome; receiving an indication of a user; determining a payout amount associated with the outcome; authorizing the user to be provided with a payment based on the payout amount; and updating a database record to reflect the authorization of payment. The authorization of payment may serve as a record for the central server not to provide the payment for the same outcome a second time. Various embodiments further include providing the user with the payment. Various embodiments further include determining a first identifier of a slot book based on the indication of the outcome. In various embodiments, updating the database record may include accessing a database, the database containing multiple records, each record including an identifier of a slot book and an indication of a corresponding total payout amount; determining a record in the database based on the first identifier of the slot book; determining a first payout amount associated with the first identifier of the slot book; and reducing the first payout amount by the payment. Thus, for example, if the total payout amount associated with a slot book is $50, and a customer is paid $5 for a single outcome, then the total payout amount associated with the slot book may be reduced by $5 to $45.

In various embodiments, a slot book may become invalid once any outcome from the slot book is redeemed. In this way, a customer may be prevented from being paid twice for the same outcome. Various embodiments include receiving an indication of an outcome; receiving an indication of a user; determining a payout amount associated with the outcome; authorizing the user to be provided with a payment based on the payout amount; determining a slot book associated with the outcome; and updating a database record to indicate that no further payments are to be provided based on any outcomes from the slot book. Note that the payout amount associated with the outcome may be an aggregate of all the payouts in the slot book, so that the user is still receiving the payout he is rightfully due for the entire book. Updating the database record may include accessing a database, the database containing multiple records, each record including a first field containing an identifier of a slot book and second field containing an indication of a corresponding total payout amount; determining a record in the database based on the first identifier of the slot book; determining a first payout amount associated with the first identifier of the slot book; determining a field containing the payout amount; and updating the first field to contain a payout amount of zero.

As with an entire slot book, a payment may be provided to a user immediately (or soon after) her purchases an outcome. Payment may be provided by a POS terminal (or a cashier using a POS terminal). Various embodiments include receiving an indication that a slot book has been provided to a user; receiving an indication that the user has tendered funds in exchange for the slot book; determining an outcome associated with the slot book; determining a payout amount associated with the outcome; and authorizing, substantially immediately after the user has tendered funds, a payment of the payout amount to be made to the user.

In various embodiments, a user may redeem an outcome leaf at a redemption device. The user may bring the outcome leaf in person, for example. Various embodiments include receiving an indication of an outcome; determining a payout amount associated with the outcome; and providing a payment amount based on the payout. Providing a payment amount may include providing cash; coins; casino tokens; casino credits; vouchers for cash; and vouchers for casino tokens. When a consumer redeems an outcome at redemption device, for example, the redemption device may communicate this to the central server. The central server may then prevent, for example, the consumer from redeeming the outcome at another redemption device. Various embodiments further include transmitting a signal to a central server, the signal including at least one of: an indication of the outcome; an indication of the payout amount; and an indication of the payment amount.

In various embodiments, a central server may track payments provided for the redemption of slot books, e.g., so as not to provide such payments a second time. Various embodiments include receiving an indication of a slot book; receiving an indication of a payment provided based on an outcome of the slot book; and updating a database record corresponding to the slot book to reflect the payment amount. For example, a database record may be updated to reflect a payment of $28.50 made to a user redeeming a slot book. In various embodiments, updating a database record includes: determining a first identifier of the slot book based on the indication of the slot book; accessing a database, the database containing multiple records, each record including an identifier of a slot book and an indication of a corresponding total payout amount; determining a record in the database based on the first identifier of the slot book; determining a first payout amount associated with the first identifier of the slot book; and reducing the first payout amount by the payment. Thus, a database record may be adjusted from $35 to $28 representing an adjustment from an initial amount of $35 due a user down to an amount of $28 due the user after the user has been paid $7 (e.g., the payout of a single outcome submitted by the user).

In various embodiments, a user may redeem an outcome using a communications network. The user may employ a user device, such as a personal computer, to transmit information about an outcome to the central server. Various embodiments include receiving an indication of an outcome (e.g., at a personal computer); and transmitting the indication to a central server. The indication may be a sequence of characters. Various embodiments further include receiving an indication of a user (e.g., the user's name); and transmitting the indication of the user to the central server. Various embodiments further include receiving an indication of a user financial account identifier (e.g., a credit card number); and transmitting the indication to the central server. The central server may later credit any payouts due to the user.

In various embodiments, a user views a sequence of outcomes only after they have been generated. For example, the user views the sequence as printed outcomes. However, the user may desire to see the outcomes as they are generated. Accordingly, a gaming device may be filmed or photographed as it generates outcomes. A purchaser of the printed versions of the outcomes may later view the film of the gaming device generating the outcomes. Various embodiments include directing a gaming device to generate an outcome; and directing a camera to film the gaming device as it generates the outcome. The camera may be a security camera with a field of view including the gaming device, for example. Various embodiments include directing a gaming device to sequentially generate a plurality of outcomes; and directing a camera to film the gaming device as it generates the plurality of outcomes, thereby creating a film clip. Various embodiments further include receiving data representative of the film clip; and storing the film clip. Various embodiments further include receiving a request to access the film clip; and providing access to the film clip. Receiving the request may include receiving an identifier, the identifier corresponding to a slot book comprising the plurality of outcomes; and receiving an address. Then, providing access to the film clip may include transmitting data representative of the film clip to the address. For instance, a user may provide a serial number for a slot book and an email address. The central server may then transmit a data file containing the film clip to the email address, for viewing by the user.

Various embodiments include directing a gaming device to generate an outcome; and filming the gaming device as it generates an outcome, thereby generating a film clip. Various embodiments further include receiving a request access to the film clip; and providing access to the film clip.

A user may use his personal computer or other user device to request a film clip. Various embodiments include receiving an identifier for a slot book; transmitting the identifier to a central server; transmitting to the central server a request for a film clip corresponding to the slot book; receiving data representative of the film clip; and displaying the film clip based on the data.

In various embodiments, a user PC may include software for generating a simulated film clip based on indications of outcomes. For example, if there is an indication of a "cherry-lemon-bar" film clip, then a user PC may execute software that causes the display of a virtual slot machine. The virtual slot machine may show spinning reels and stop with "cherry-lemon-bar" displayed. Various embodiments include receiving an indication of an outcome; generating a simulated video of a slot machine generating the outcome; and displaying the video.

Various embodiments include receiving an indication of a slot book; transmitting the indication to a central server; receiving from the central server an indication of an outcome in the slot book; generating a simulated video of a slot machine generating the outcome; and displaying the video.

In various embodiments audit information is generated related to the generation of outcomes. The audit information may be stored locally on a gaming device. Various embodiments include generating an outcome; storing an indication of the outcome; storing an indication of the payout of the outcome; and storing additional data about the outcome. Such embodiments may be performed by a gaming device for example. Storing additional data may include storing additional data in a memory of a gaming device. Storing additional data may include storing at least one of: an indication of a time when the outcome was generated; an indication of a gaming device on which the outcome was generated; an indication of a casino in which the outcome was generated; an indication of a city in which the outcome was generated; an indication of a location in which the outcome was generated; an indication of a type of gaming device on which the outcome was generated; and an indication of a denomination of the outcome. Various embodiments further include transmitting the additional data to a central server. Various embodiments further including printing a representation of the additional data. For example, "3:2 pm" may be printed to indicate the time of day during which an outcome was generated.

In various embodiments, audit information is transmitted to a central server. Various embodiments include generating an outcome; transmitting an indication of the outcome to a central server; transmitting an indication of the outcome to the central server; and transmitting additional data about the outcome to the central server. Transmitting additional data may include transmitting to the central server at least one of: an indication of a time when the outcome was generated; an indication of a gaming device on which the outcome was generated; an indication of a casino in which the outcome was generated; an indication of a city in which the outcome was generated; an indication of a location in which the outcome was generated; an indication of a type of gaming device on which the outcome was generated; and an indication of a denomination of the outcome.

In various embodiments, audit information may be transmitted to an auditor. Various embodiments include generating an outcome; transmitting an indication of the outcome to an auditor; transmitting an indication of the outcome to the auditor; and transmitting additional data about the outcome to the auditor. Transmitting additional data may include transmitting to the auditor at least one of: an indication of a time when the outcome was generated; an indication of a gaming device on which the outcome was generated; an indication of a casino in which the outcome was generated; an indication of a city in which the outcome was generated; an indication of a location in which the outcome was generated; an indication of a type of gaming device on which the outcome was generated; and an indication of a denomination of the outcome.

In various embodiments, it may be desirable to print audit information. For example, the player may wish to view the printed information, or an auditor may wish to view the printed information. Various embodiments include receiving data indicative of an outcome of a gaming device; receiving audit data related to the outcome; and printing on a substrate an indication of the outcome and a representation of the audit data. Receiving audit data may include receiving at least one of: an indication of a time when the outcome was generated; an indication of a gaming device on which the outcome was generated; an indication of a casino in which the outcome was generated; an indication of a city in which the outcome was generated; an indication of a location in which the outcome was generated; an indication of a type of gaming device on which the outcome was generated; and an indication of a denomination of the outcome.

In various embodiments, it may be desirable to print an auditor's name in association with an outcome. The auditor's name may provide a player with assurance that the outcome was generated fairly. Various embodiments include receiving data indicative of an outcome of a gaming device; receiving an indication of an auditor; and printing on a substrate a representation of the outcome and the indication of the auditor. Receiving an indication of an auditor may include receiving the name of the auditor. Receiving an indication of an auditor may include receiving the signature of the auditor. Receiving an indication of an auditor may include receiving the seal of the auditor. Various embodiments further include receiving a certification by the auditor that the outcome is authentic.

In various embodiments, an auditor may approve of multiple outcomes, such as the outcomes of a slot book. Various embodiments include receiving data indicative of a first outcome of a gaming device; receiving data indicative of a second outcome of a gaming device; printing on a first substrate a representation of the first outcome; printing on a second substrate a representation of the second outcome; receiving an indication that that an auditor has approved of the authenticity of the first and second outcomes; printing an indication of the auditor's approval on a third substrate; and packaging the first, second and third substrates. Receiving an indication that an auditor has approved of the authenticity of the first and second outcomes may include receiving a statement from the auditor. Printing an indication of the auditor's approval may include printing the auditor's seal of approval.

An indication of an auditor's approval may be printed on the packaging material of a slot book. Various embodiments include receiving data indicative of a first outcome of a gaming device; receiving data indicative of a second outcome of a gaming device; printing on a first substrate a representation of the first outcome; printing on a second substrate a representation of the second outcome; receiving an indication that that an auditor has approved of the authenticity of the first and second outcomes; enclosing the first and second substrates in a packaging material; and printing on the packaging material the indication of approval.

A printing device belonging to an auditor may print the auditor's seal on packaging for slot books that have been audited. Various embodiments include receiving an indication of a slot book; receiving the packaged slot book; determining whether the slot book has been audited based on the indication; and printing, based on the slot book's having been audited, an auditor's seal on the packaging.

Various embodiments, such as embodiments performed by an auditor, may include observing as an outcome of a gaming device is generated; determining a question pertaining to the outcome; and based on the observation, certifying that the answer to the question is yes. The question may be at least one of: was the outcome generated fairly?; was the outcome generated at a designated time?; was the outcome generated by the gaming device?; and was the outcome generated in a designated casino?

Various embodiments include determining first data related to an outcome; observing second data related to the outcome; determining based on the second data, whether the first data is true; and providing, based on the determination of truth, a certification that the first data is true. Determining first data may include determining that the outcome was generated by a particular gaming device. Determining first data may include determining that the outcome was generated at a particular time. Determining first data may include determining that the outcome was generated fairly. Observing second data may include observing a gaming device on which the outcome was generated. Observing second data may further include observing a gaming device on which the outcome was generated as it generates a different outcome. An auditor may assume that if a gaming device is fair when generating the different outcome, it was fair in generating the original. Observing second data may include observing a gaming device that generates the outcome as it generates the outcome. Observing second data may include observing whether there are people around a gaming device as it generates the outcome. If there are people around, then it is possible the people would watch for favorable outcomes, and purchase the printed versions of the favorable outcomes for themselves. Therefore, an auditor may determine an outcome to be "fair" only if there are no people around a gaming device as it generates the outcome. Observing second data may include observing a printing device as it prints the outcome. The auditor may verify that the printing device prints the proper outcome. Observing a printing device includes observing whether there are people around the printing device as it prints the outcome. If there are people around, it may be possible that the people will take the good outcomes for themselves. Thus, any remaining printed outcomes would be unfavorably biased. Observing second data may include observing a process through which the outcome is generated, printed, and packaged. In particular, an auditor may verify that the outcome is not seen by humans during this process. Observing a process may include observing whether there are any people who have knowledge of the outcome during the process by which it is generated, printed, and packaged. Observing second data may include determining a gaming device that generated the outcome; and testing a processor of the gaming device for fairness. The processor may be tested to verify that it generates outcomes according to a predetermined probability distribution.

Various embodiments include determining first data related to an outcome; observing second data related to the outcome; determining based on the second data, whether the first data is true; and providing, based on the determination of truth, a certification that the first data is true. The certification may include at least one of: a signature; a seal; and a written statement. The written statement may say, for example, "We, the auditors certify that this outcome has not been seen by human eyes."

In various embodiments, the central server may receive and/or store audit date. Various embodiments include receiving an indication of a series of outcomes; receiving audit data corresponding to the series of outcome; and storing the indication of the series of outcomes in association with the audit data. Audit data may include at least one of: a time during which a first outcome of the series of outcomes was generated; a gaming device on which a second outcome of the series of outcomes was generated; a manner in which a third outcome of the series of outcomes was generated; and a casino in which a fourth outcome of the series of outcomes was generated. Audit data may include a time during which the last generated outcome of the series of outcomes was generated. Audit data may include a time during which the earliest generated outcome of the series of outcomes was generated. In various embodiments, a user may wish to peruse the audit data, e.g., related to outcomes the user has purchased. Thus, various embodiments further include receiving a request to access the audit data; and providing access to the audit data. Receiving a request may include receiving from a user the indication of the series of outcomes; and receiving from the user a request to access the audit data corresponding to the series of outcomes. Providing access to the audit data may include transmitting the audit data to a user device.

In various embodiments, audit data may be transmitted to an auditor. Various embodiments include receiving an indication of a series of outcomes; receiving audit data corresponding to the series of outcome; and transmitting to an auditor the indication of the series of outcomes and the audit data. For example, audit data may be emailed to an auditor.

In various embodiments, audit data may be transmitted to a printing device. Various embodiments include receiving an indication of a series of outcomes; receiving audit data corresponding to the series of outcome; and transmitting to a printing device an indication of the series of outcomes and the audit data. The printing device may then print the audit data. The printed audit data may then be provided to a player and/or auditor.

Various embodiments include filming a gaming device as it generates a series of outcomes, thereby creating a film clip; and transmitting the film clip to an auditor.

A central server and/or other entity may determine a price for a slot book in various ways. Various embodiments include determining a slot book; determining an attribute of the slot book; and determining a price for the slot book based on the attribute. Determining an attribute may include determining at least one of a number of outcomes; a denomination of each outcome; a number of lines played per outcome; an implied wager for each outcome; and an amount of a subsidy associated with the slot book. Determining a price may include determining a price that is proportional to the number of outcomes in the slot book. For example, a price may be equal to twenty-five cents multiplied by the number of outcomes in the slot book (e.g., if the denomination of each outcome in the slot book is twenty-five cents).

Various embodiments include determining a slot book; determining an attribute of the slot book; determining a preliminary price of the slot book based on the attribute; determining an amount to be provided by a third party to subsidize the price of the slot book; and determining a final price based on the preliminary price and the amount. An amount provided by a third party as a subsidy may include an amount that a third party pays the casino whenever the casino provides the slot book to a player. The payment to the casino may compensate the casino for the expected cost of providing payouts to players. A third party may be willing to provide a subsidy, for example, if the slot book contains promotions of the third party, or is part of a promotion of the third part. For example, the slot book may be gift wrapped with a card that says, "A gift to you from XYZ corporation." The consumer may thereby establish goodwill with the third party merchant. Various embodiments further include selling the slot book at the final price; and collecting the subsidy amount from the third party.

EXAMPLES

The following examples illustrate some embodiments and features of the present invention, and should not be construed as limiting the scope of the invention in any way. Various other embodiments and examples of embodiments are discussed in further detail herein, and others will be apparent to those skilled in the art in light of the present disclosure.

Example 1 of an embodiment: Martha had spent an enjoyable week in Las Vegas. She was now checking out of her casino-hotel to head back to her home in Ohio. At the check-out desk, the hotel clerk gave her a small wrapped package as a parting gift. Martha put the package in her pocket, hailed a cab, and went to the airport. Once she was on the plane, Martha took out the package and examined it. On the packaging was a picture of a fruit slot machine, and a label reading, "200 spins, 5-cent denomination."

Martha unwrapped the package to find a pad containing a number of paper leaves backed by a cardboard base leaf. The leaves were bound together at their top edges. The pad fit neatly into the palm of her hand, and was about ¼ inch thick. Martha examined the first paper leaf. A large image of the front of a slot machine took up almost the entire space on the leaf. The image of the slot machine depicted three reels, a "win meter," a "payout meter," and a payout table. The image of the slot machine also depicted various buttons, a handle, and decorative illustrations of an orchard on the housing of the slot machine. In the center of the leaf, near the lower edge, was a page number. This first page was numbered "1."

Looking at the reels, Martha could see three symbols lined up, "cherry-orange-bar." She saw from the payout table that an outcome beginning in cherry paid 2 credits. Sure enough, the payout meter read "2" and the win meter read "2".

Martha now flipped the page to reveal the second page. In doing so, she noticed text on the back of the first page. The text said that each credit won was redeemable for 5 cents. The text also said that only the cardboard base leaf was necessary to redeem winnings. The rest of the pages could be disposed of. Page 2 showed the same slot machine, but with a different outcome: "bell-bar-plum." The payout meter read "0" and the win meter still read "2". Martha flipped to page 3, where the outcome was "orange-orange-orange." The payout meter read "20" and the win meter now read "22."

Martha continued flipping through the pages of outcomes. It seemed to her like a rather fun way to pass the time on the airplane. By the time she reached the last page before the base leaf, Martha's win meter read "800." When she came to the base leaf, she saw the following message: "Congratulations, you have won 800 credits! You can redeem this slot book for $40. Just visit www.slotoutcomebook.com, enter your name and address, and the following code: 89X452B79. You will receive a check for $40 within two weeks. Alternatively, you can send this cardboard leaf to 123 Main Street; Sunnyville, USA together with a self-addressed stamped envelope, and we will send you a check in your envelope."

When she got home, Martha visited the indicated Web site, and entered the required information. She received her check a few days later. Included with the check was a letter. The letter thanked Martha for playing, and encouraged her to visit the casino again.

Example 2 of an embodiment: John frequently visited a particular casino, and would always purchase a few slot books to take home with him. One time, he bought a video poker slot book. Every odd page of the slot book showed an initial hand, and every even page of the slot book showed the same hand after certain cards were replaced. The slot book advertised on its wrapper that hands were played with "perfect strategy."

In this particular slot book, John seemed to be missing draws quite frequently. For example, he would have four cards to a flush and draw for the fifth card, but fail to complete his flush. John became a bit suspicious and wished to see how the outcomes of his slot book were generated. When he got to the base leaf of the slot book, John typed in the Web site address printed there. He entered a code from his base leaf, and then mouse-clicked on a hyperlink labeled, "See a film clip of how your outcomes were generated on a real video poker machine."

A portion of his browser window then displayed a streaming video clip. The clip depicted a video poker machine. The video poker machine looked very much like the depiction of the machine John had seen on the pages of the outcomes. As he watched the clip, John even recognized some of the outcomes that were appearing on the video poker machine in the video—they were the same outcomes John had seen in his slot book. As John watched, he saw an initial hand appear on the video poker machine in the video clip. The hand was four cards to a royal flush, with one additional, irrelevant card. This was the hand that had most frustrated John, as he had won nothing. As he watched, the irrelevant card was automatically discarded, and a replacement card was dealt. The final hand was still a losing hand. John was now satisfied that his outcomes had been generated fairly on a real video poker machine.

Example 3 of an embodiment: Linda paid $25 for a book of 100 outcomes. Each outcome had a 25-cent denomination. As Linda paged through the slot book she noticed that more than half of the outcomes were losing outcomes. However, each page with a losing outcome was clearly printed with information that allowed it be used as a coupon. One losing outcome page including text, "Good for 25 cents off any 10 oz. carton of Glacier Yogurt at participating Produce Den grocery stores." Linda thought it was neat that she could use losing outcomes to get discounts. She noticed that each coupon was for at least 25 cents, so it was almost as if she were getting at least her money back on every outcome. In fact, some of the coupons were for a dollar or more. Getting a valuable coupon was sometimes even better than winning.

Additional Embodiments

According to some embodiments, a consumer may purchase a subscription to slot books. In one embodiment, a consumer pays a fixed amount to the casino up front. In return, the casino sends the consumer slot books on a periodic basis. For example, the consumer might receive one slot book per week for a year, or three slot books on the first of every month for the next year. The price of a subscription might be equal to the price of a slot book multiplied by the number of slot books in a subscription. Alternatively, the consumer may receive a discount over the sum of the prices of the individual slot books because the consumer is buying in bulk.

In some embodiments, the central server may assemble a slot book from a variable number of outcomes, depending on predetermined criteria and the payouts of the outcomes. In one example, predetermined criteria dictate that the slot book must have a redemption value of either zero or more than $100. A purchaser of the slot book is assumed to start out with 50 credits (worth $50) One credit is deducted from this balance for each outcome, while credits are added based on the payouts of winning outcomes. Therefore, the slot book may sell for $50. As outcomes are generated for the slot book, the central server tracks the credit balance based on the starting credit balance, the number of outcomes generated thus far, and the payouts associated with the outcomes. If the credit balance is neither zero nor more than one hundred, then the central server directs an additional outcome to be generated for the slot book. Once the credit balance has reached zero or more than one hundred, the central server directs all the outcomes to be packaged into a slot book and wrapped. The wrapper may advertise that the slot book is guaranteed to have a redemption value of either zero or more than $100. One advantage of such a slot book is that the consumer need not be bothered with redeeming a slot book for small amounts, such as for $3. In some embodiments, slot books may be padded with empty leaves. In this way, even though a slot book has a variable number of outcomes, a consumer would not be able to examine a packaged slot book and determine whether it had a relatively large number of outcomes, or a relatively few number of outcomes.

In some embodiments, the outcomes contained in slot books may have progressive payouts as potential prizes. The awarding of progressive prizes for outcomes of slot books presents unique challenges. A consumer sitting at a slot machine in a casino who wins a progressive payout might immediately receive the progressive payout. However, a consumer who wins via a slot book outcome might have considerable discretion as to when to submit an identifier of the slot book, and therefore as to when to claim the progressive prize. Does the size of the progressive payout continue to grow even after the consumer knows he has won, but before the consumer has submitted his winning outcome?

In some embodiments, the size of a progressive prize as relates to a particular consumer or to a particular outcome may become fixed at a particular point in time. The consumer may only win this fixed progressive prize even though the size of the progressive prize may later increase. Following are several exemplary points in time at which the size of a progressive prize may be fixed include:

The size of a progressive prize may be fixed at the moment at which a particular outcome is generated on a gaming device. For example, if outcome number 1234 is generated at 12:54 on May 19, 2005, when the size of the progressive prize is $900,000, then the outcome may only win $900,000, even though the size of the progressive prize may later increase to $1,000,000.

The size of a progressive prize may be fixed at the moment at which a particular outcome is made a part of a slot book.

The size of a progressive prize may be fixed at the moment at which a particular outcome or its associated slot book is sold to a consumer.

The size of a progressive prize may be fixed at the end of a particular period of time during which an outcome or its associated slot book is sold. For example, the size of the progressive prize as relates to a particular outcome becomes fixed at 12:00 midnight on the day following the day during which the outcome was purchased. The size of the progressive may also become fixed at midnight on the Sunday following the day on which the outcome was sold, or at midnight on the first of the month following the month on which the outcome was sold.

In some embodiments, the size of the progressive payouts may depend on the number of slot books sold in any given period of time. For example, suppose a first winning outcome is sold. The size of the progressive payout is thereupon immediately fixed. Thereafter, any outcomes sold contribute to the next progressive payout. One percent of the implied wager for each outcome sold contributes to the progressive jackpot. For example, each 10-cent denomination outcome that is sold adds 1/10 cent to the size of the progressive payout. The progressive payout continues to build until a second winning outcome is sold. The second winning outcome results in the win of all the contributions to the progressive payout since the first winning outcome was sold, plus any seed money contributed by the central server (the casino).

In some embodiments, the sales device immediately provides an alert when a progressive outcome is sold. In this way, the progressive payout can be provided to the consumer immediately, and the size of the next progressive payout can be accurately advertised. In another embodiment, a consumer is not alerted when he is sold an outcome that wins the progressive payout. However, the central server may record the sale, and may thereupon reduce the advertised size of the progressive payout to reflect the fact that the consumer may eventually claim the current progressive payout.

In some embodiments, only outcomes of similar denominations contribute to a given progressive payout. In other embodiments, outcomes of multiple different denominations contribute. A lower denomination outcome may allow its owner to win only a portion of the progressive payout. For example, if a $1 denomination outcome can win the full amount of the progressive payout, then a 25-cent denomination outcome may win only one fourth of the progressive payout. The remainder of the progressive payout may remain for other consumers to win.

A consumer may have a limited period of time in which to claim any progressive payout. If the consumer does not claim the progressive payout due him, then the payout amount may remain in the progressive pool for other consumers to win.

In some embodiments, multiple consumers may win the same progressive payout. For example, Joe and Bill each buy a slot book. Joe buys his on June 2, and Bill buys his on June 9. The size of the progressive payout becomes fixed for each on July 1. If multiple consumers do win, then the progressive payout may be divided evenly between the two.

In some embodiments that have been described, a consumer receives payment for a slot book that is equal to the sum of all the payouts of the outcomes contained in the slot book. However, the consumer's payout may be based on other circumstances as well. In one embodiment, a consumer's payout for a slot book is the sum of all the payouts of the outcomes in the slot book minus the sum of "wagers" for each outcome. In this way, a consumer's running balance of winnings as he progresses through a slot book resembles what his credit balance might be were he actually at a casino. That is, each outcome has an associated cost (analogous to a wager at a casino), and each outcome may have winnings. As a consumer goes through the slot book, his running balance of winnings decreases by the wagers he makes, and increases by the winnings he receives. While the consumer is not actually using more of his own money to place the wagers, the wagers are being deducted from a running credit balance associated with the outcomes of his slot book. This embodiment also allows for the possibility that the payout associated with a slot book would be negative (the sum of the wagers is greater than the sum of all the payouts). The consumer will not necessarily be responsible for paying more money to the casino if the payout for a slot book turns out to be negative. However, in some embodiments, a consumer must pay the casino for any negative payouts associated with a slot book. A consumer might therefore not have to pay upfront for a slot book, but may instead provide a credit card number, for example, so that the credit card can be charged if the slot book turns out to have a negative associated payout. In practice, the central server might have a record of the payout for the slot book, and may therefore charge the consumer's credit card immediately once the consumer receives a slot book with a negative payout. However, the central server might refrain from charging the consumer so as to give the consumer time to enjoy the outcomes.

In some embodiments, a consumer might start out with a certain balance of winnings even before looking at the first outcome in a slot book. For example, the consumer starts with one hundred coins. In this way, a consumer's balance can be used to make the wagers necessary for each outcome in the slot book. In this example, even if there are one hundred outcomes, and all are losing outcomes, the consumer will still not end up in the negative, as his initial hundred-coin balance would have paid for the all the wagers.

If there are wagers associated with each outcome, then the cost of a slot book might be lower than would otherwise be reasonable. This is because a player's expected winnings from a slot book will tend to be lower when a portion of those winnings are used as wagers within the slot book, assuming pay tables and probabilities for outcomes are held constant. Therefore a slot book with one hundred outcomes of 25-cent denomination might cost $25 if there are no wagers, but might cost only $5 if there are. However, if pay tables or probabilities are varied, then two slot books of the same denomination might cost the same amount, even though a first uses wagers, and a second does not. The first slot book may, for example, pay back an average of 150%, whereas the second pays back only 90%.

Slot books may contain extra outcomes or outcome leaves beyond the number advertised. For example, a slot book advertised to contain one hundred outcomes may actually contain one hundred three. In one embodiment, a particular outcome may be "free spin." During the outcome generation process, the central server may detect a "free spin" outcome and thereby direct the generation of an extra outcome, and the inclusion of the extra outcome in the slot book.

An outcome leaf may reveal only a partial outcome, such as the first two indicia of an outcome that normally consists of three indicia. The consumer who purchased the outcome leaf may later return to the casino, where a gaming device may randomly generate the remainder of the outcome. For example, a consumer purchases a slot book with initial hands from a video poker game. One of the hands is: As Ks Qs Js 2d. The player may bring this outcome leaf to a casino, and insert it into a video poker machine. The video poker machine may thereupon allow the player to discard the 2d, and may randomly deal a replacement card. In another example, an outcome leaf reveals two of three reels of a reel slot machine. The consumer may return to a casino to have the third reel symbol generated by a slot machine.

An outcome contained in a slot book may depend on a real event that has not occurred at the time the slot book was printed. For example, an outcome might pay $10 if a particular baseball player hits a home run in an upcoming game.

A slot book may contain multiple leaves that serve as frames in a bonus round sequence. For example, a first leaf shows a snake deciding which of three eggs to steal. The next frame shows the snake devouring one of the eggs. The third frame shows the snake with his mouth open, to reveal the bonus amount (that had been hidden in one of the eggs). In one embodiment, multiple frames of a bonus round sequence are printed on a corner of multiple consecutive outcome leaves. A player can then see the bonus round as an animated sequence by paging quickly through the outcome leaves, while watching the corner in which the bonus frames are printed.

In one embodiment, a consumer may decide the denomination of the outcomes of a slot book when he purchases the slot book, even though the outcomes have already been generated and printed. The payout for each outcome may then be proportional to the denomination the player has chosen. For example, a given outcome might pay twenty-five cents if the chosen denomination is five cents, and $1.25 if the chosen denomination is twenty-five cents. Of course, the higher the chosen denomination for the slot book, the more the player might pay for it. However, the player might pay proportionally less if he chooses to increase the denomination of the outcomes of a slot book. For example, a player might pay $10 for a slot book if all outcomes are often-cent denomination, but only $19.80 if all outcomes are of twenty-cent denomination.

A player might also choose from among two or more possible pay tables for a given slot book at the time when he purchases the slot book. The payouts the player receives may then depend on his chosen pay table. Each outcome leaf might then display multiple payouts, each corresponding to a different pay table the player might have chosen. The price of the slot book may also depend on the pay table chosen by the player. For example, a pay table with relatively higher payouts might make the price of the slot book relatively high when compared to the same slot book with a pay table having relatively lower payouts. A player might even customize his own pay table. In customizing the pay table, the player may be bound by certain constraints. One constraint would require the payback percentage of the pay table to fall within a predetermined range.

In one embodiment, a consumer might wish to pay for only a portion of the outcomes contained in a typical slot book. Rather than unwrapping the slot book and dividing it in two, the central server may sell the entire slot book to the consumer, but record the fact that only a certain number of the outcomes are valid. For example, a consumer wishes to purchase twenty outcomes, but slot books are sold in groups of one hundred outcomes. The central server may record the fact that only the first twenty outcomes are valid, and may allow the consumer to purchase the slot book for one-fifth its normal price. When the consumer later redeems the slot book, the consumer may receive only the payouts for the first twenty outcomes in the slot book.

The payouts associated with outcomes may take the form of prepaid phone minutes. For example, an outcome leaf may have a phone number and personal identification number (PIN) printed on it. A consumer would be able to dial the phone number, enter his PIN, and then make a phone call. In some embodiments, all the outcomes of a slot book contribute to a single pool of phone minutes. The consumer may dial a number and enter a PIN from the base leaf of the slot book, and may speak for up to the total number of minutes provided by all the outcomes of his slot book.

Although outcomes have been described primarily as being printed on thin sheets of material called outcome leaves, outcomes could appear in a number of other forms. Outcomes might be printed on candy wrappers or on candy itself. For example, a chocolate bar might have "bell-bar-cherry" inscribed on it. A consumer might collect a payout associated with the outcome on the chocolate bar by, for example, submitting the uniform price code (UPC) from the chocolate bar to the central server. Outcomes may appear on the backside of photographs. The photographs may be taken by the casino and show the consumer at the casino engaged in various gaming activities. Outcomes may, in general, appear on any tangible material substrate. Outcomes may even take electronic or magnetic form. For example, the outcomes of a slot book could be sold on a floppy disk. The player might view the outcomes by inserting the floppy disk into a computer and executing a program to display the outcomes.

In one embodiment a slot book is arranged so that multiple outcome leafs form a page, and multiple pages together form the slot book. For example, a single page consists of three outcome leafs joined side by side at their perforated edges. The slot book as a whole might then contain one hundred pages.

One or more of the devices described in this invention may be combined. In particular, the sales device and the redemption device may be one and the same. Similarly the printing device and the packaging device may be one and the same. Additionally, as previously described in various embodiments, the gaming device and the redemption device may be combined. That is, a consumer may communicate a slot book identifier to a gaming device, and receive immediate payment from the gaming device.

In some embodiments a consumer may receive complimentary (comp) points for purchasing a slot book. For example, the sales device may receive information about the consumer and transmit such information to the central server. The central server may then credit the consumer with a number of comp points appropriate to the purchase price of the slot book. For example, the consumer might receive a given number of comp points per dollar of purchase price.

In one embodiment, outcome leaves and/or slot books may be generated only upon request by a consumer. A consumer may thereby feel as if the secrecy of the outcomes is less likely to have been compromised.

In some embodiments, the outcomes of a slot book may be generated with atypically high payback percentages. For example, the payback percentage for an outcome might be 105% of the implied wager. Normally, gambling outcomes must pay back less than 100% of the player's wager so as to result in a profit for the casino. However, a casino may benefit from selling slot books with outcomes paying more than 100% because, in redeeming the slot books, a player may be encouraged to return to the casino, or at least to interact with the casino in some way.

In some embodiments, a casino may ensure that a slot book has more than a minimum threshold of associated winnings. For example, a casino could advertise that a player may always redeem a slot book for 60% of its purchase price, regardless of the outcomes contained within. In this way, not only is the player better motivated to purchase the slot book, but the player is encouraged to return to the casino, or interact with the casino, to redeem the slot book.

In some embodiments, outcomes may be printed in black and white, or using any number of colors.

In one embodiment, outcomes may appear on outcome leaves as lenticular images. When viewed from one angle, the images may show pictures of blurred, spinning reels. When viewed from another angle, the images may show fully resolved outcomes.

What is claimed is:

1. A method of operating a gaming system, said method comprising:

determining, with a random number generator, first data indicative of a first outcome at a gaming device;

determining, with the random number generator, second data indicative of a second outcome at the gaming device;

determining third data based on the first data, the second data and at least one statistic selected from the group consisting of: a number of consecutive winning outcomes, a number of consecutive losing outcomes, a number of consecutive outcomes in which a strategy failed, an outcome number of the first outcome in a sequence of outcomes, and an outcome number of the second outcome in the sequence of outcomes; and providing an indication of at least one of the first, second, and third data to a player in a format where the player need not be at the gaming device to ascertain the first and second outcomes and the player may determine a benefit due the player based on the third data.

2. The method of claim 1 wherein providing the first, second, and third data to the player comprises providing the first, second, and third data to the player in a printed format.

3. The method of claim 1 wherein providing the first, second, and third data to the player comprises providing the first, second, and third data to the player in an electronic format.

4. The method of claim 3 wherein providing the first, second, and third data to the player in an electronic format comprises providing the first, second, and third data to the player on a floppy disc.

5. The method of claim 1 further comprising providing audit data to the player.

6. The method of claim 5 wherein providing audit data to the player comprises providing a video clip showing generation of at least one of the first outcome and the second outcome.

7. The method of claim 6 wherein the video clip shows the gaming device generating outcomes and incorporating the outcomes into a slot book.

8. The method of claim 1 further comprising generating audit data to authenticate the first outcome and the second outcome.

9. The method of claim 8 further comprising transmitting the audit data to a central server.

10. The method of claim 9 further comprising storing the audit data in a memory device associated with the central server.

11. The method of claim 8 further comprising transmitting the audit data to a user device.

12. The method of claim 8 further comprising storing the audit data in at least one selected from the group consisting of: a hard disk, a compact disk, and a floppy disk.

13. The method of claim 8 further comprising storing the audit data locally on the gaming device.

14. The method of claim 8 further comprising transmitting the audit data to an auditor.

15. The method of claim 8 further comprising securing a seal of authenticity from an auditor based on the audit data.

16. The method of claim 15 further comprising affixing the seal of authenticity to a medium on which the indication is provided to the player.

17. The method of claim 8 further comprising enabling the player to view the audit data through a web site.

18. A gaming system comprising:

a user interface; and a control system operatively coupled to the user interface and adapted to:

determine, with a random number generator, first data indicative of a first outcome at a gaming device;

determine, with the random number generator, second data indicative of a second outcome at the gaming device;

determine third data based on the first data, and the second data and at least one statistic selected from the group consisting of: a number of consecutive winning outcomes, a number of consecutive losing outcomes, a number of consecutive outcomes in which a strategy failed, an outcome number of the first outcome in a sequence of outcomes, and an outcome number of the second outcome in the sequence of outcomes; and generate an output comprising an indication of at least one of the first, second, and third data in a format such that a player need not be at the gaming device to ascertain the first and second outcomes and the player may determine a benefit due the player based on the third data.

19. A non-transitory computer readable medium comprising software with instructions to:

determine, with a random number generator, first data indicative of a first outcome at a gaming device;

determine, with the random number generator, second data indicative of a second outcome at the gaming device;

determine third data based on the first data, the second data and at least one statistic selected from the group consisting of: a number of consecutive winning outcomes, a number of consecutive losing outcomes, a number of consecutive outcomes in which a strategy failed, an outcome number of the first outcome in a sequence of outcomes, and an outcome number of the second outcome in the sequence of outcomes; and provide an indication of at least one of the first, second, and third data to a player in a format where the player need not be at the gaming device to ascertain the first and second outcomes and the player may determine a benefit due the player based on the third data.

* * * * *